US006500590B2

(12) United States Patent
Irving et al.

(10) Patent No.: US 6,500,590 B2
(45) Date of Patent: Dec. 31, 2002

(54) DUAL PROCESS COMPATIBLE COLOR PHOTOTHERMOGRAPHIC ELEMENT COMPRISING DRY THERMAL DEVELOPMENT

(75) Inventors: Mark E. Irving, Rochester, NY (US); David T. Southby, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/863,595

(22) Filed: May 23, 2001

(65) Prior Publication Data

US 2002/0022200 A1 Feb. 21, 2002

Related U.S. Application Data

(60) Provisional application No. 60/211,446, filed on Jun. 13, 2000.

(51) Int. Cl.[7] ..... G03C 11/00; G03C 5/16; G03C 7/305; G03C 8/40

(52) U.S. Cl. ..... 430/21; 430/351; 430/442; 430/505; 430/566; 430/617; 430/955; 430/957; 430/959

(58) Field of Search ..... 430/351, 21, 566, 430/959, 363, 364, 380, 442, 505, 617, 957

(56) References Cited

U.S. PATENT DOCUMENTS

| | | | | |
|---|---|---|---|---|
| 4,789,623 A | * | 12/1988 | Sato et al. | 430/351 |
| 4,983,494 A | | 1/1991 | Kitaguchi et al. | |
| 6,013,420 A | | 1/2000 | Wingender et al. | |
| 6,242,166 B1 | * | 6/2001 | Irving et al. | 430/351 |

FOREIGN PATENT DOCUMENTS

EP 2 072 366 A 9/1981

OTHER PUBLICATIONS

Database WPI, Section Ch, Week 199929, Derwent Publications Ltd., London, GB; AN 1999–342905, XP002186340 & JP 11 125887 A (Fuji Photo Film Co. Ltd), May 11, 1999 abstract.

Database WPI, Section Ch, Week 200024, Derwent Publications Ltd., London, GB; AN 2000–277386, XP002186341 & JP 2000 075453 A (Konica Corp.), Mar. 14, 2000, abstract.

* cited by examiner

*Primary Examiner*—Thorl Chea
(74) *Attorney, Agent, or Firm*—Chris P. Konkol

(57) ABSTRACT

The present invention is directed to a method of processing color photographic film that has been imagewise exposed in a camera, said film having at least three light-sensitive units which have their individual sensitivities in different wavelength regions, each of the units comprising at least one light-sensitive silver-halide emulsion, binder, and dye-providing coupler, which method in order comprises: (a) thermally developing the film step without any externally applied developing agent, comprising heating said film to a temperature greater than 80° C. in an essentially dry process, such that an internally located blocked developing agent in reactive association with each of said three light-sensitive units becomes unblocked to form a developing agent, whereby the unblocked developing agent forms dyes by reacting with the dye-providing couplers to form a color negative image; (b) processing the developed film of step(a) by contacting it with a non-blocked developing agent, under agitation at a temperature of 30 to 50° C. under aqueous alkaline conditions, without forming a color negative image in the film by reaction of the non-blocked developing agent with the dye-providing couplers inside the silver-halide emulsions, and (c) desilvering said film in one or more desilvering solutions to remove unwanted silver and/or silver halide, thereby forming a color negative image; and (d) thereafter forming a positive-image color print from the desilvered film.

20 Claims, 2 Drawing Sheets

DUAL PROCESS COMPATIBLE COLOR PHOTOTHERMOGRAPHIC ELEMENT COMPRISING DRY THERMAL DEVELOPMENT

This application claims the benefit of Provisional Application No. 60/211,446, filed Jun. 13, 2000.

FIELD OF THE INVENTION

This invention relates to a method of processing a color photothermographic elements capable of dry thermal development that is sequentially compatible with traditional wet-chemical processing.

BACKGROUND OF THE INVENTION

In conventional color photography, films containing light-sensitive silver halide are employed in hand-held cameras. Upon exposure, the film carries a latent image that is only revealed after suitable processing. These elements have historically been processed by treating the camera-exposed film with at least a developing solution having a developing agent that acts to form an image in cooperation with components in the film.

It is always desirable to limit the amount of solvent or processing chemicals used in the processing of silver-halide films. A traditional photographic processing scheme for color film involves development, fixing and bleaching, and washing, each step typically involving immersion in a tank holding the necessary chemical solution. By scanning the film following development, the subsequent processing solutions could be eliminated for the purposes of obtaining a color positive print. Instead the scanned image could be used to directly provide the color positive print.

By the use of photothermographic film, it would be possible to eliminate processing solutions altogether, or alternatively, to minimize the amount of processing solutions and the complex chemicals contained therein. A photothermographic (PTG) film by definition is a film that requires energy, typically heat, to effectuate development. A dry photothermographic film requires only heat. A solution-minimized photothermographic film may require small amounts of aqueous alkaline solution to effectuate development, which amounts may be only that required to swell the film without excess solution. Development is the process whereby silver ion is reduced to metallic silver and in a color system, a dye is created in an image-wise fashion. In all photothermographic films, the silver is retained in the coating after the heat development.

It can be difficult, however, to scan through imagewise exposed and photo processed silver halide films when the undeveloped silver halide is not removed from the film during processing. The retained silver halide is reflective and this reflectivity appears as density in a scanner. The retained silver halide scatters light, decreasing sharpness and raising the overall density of the film, to the point in high silver films of making the film unsuitable for scanning. High densities result in the introduction of Poisson noise into the electronic form of the scanned image and this in turn results in decreased image quality. Furthermore, the retained silver halide can printout to ambient/viewing/scanning light, rendering non-imagewise density, degrading signal-to noise of the original scene, and raising density even higher.

It is therefore an object of the present invention to improve the processing of dry-developed photothermographic film in which the film can be optionally processed by a traditional wet-chemical process in order to obtain a completely desilvered film for a higher quality print, archival film, and/or optical printing.

SUMMARY OF THE INVENTION

The present invention is directed to a method of processing color photographic film that has been imagewise exposed in a camera, said film having at least three light-sensitive units which have their individual sensitivities in different wavelength regions, each of the units comprising at least one light-sensitive silver-halide emulsion, binder, and dye-providing coupler, which method in order comprises: (a) thermally developing the film without any externally applied developing agent, comprising heating said film to a temperature greater than 80° C. in an essentially dry process, such that an internally located blocked developing agent in reactive association with each of said three light-sensitive units becomes unblocked to form a developing agent, whereby the unblocked developing agent forms dyes by reacting with the dye-providing couplers to form a color negative image; (b) processing the developed film of step(a) by contacting it with a non-blocked developing agent, under agitation at a temperature of 30 to 50° C. under aqueous alkaline conditions, without forming a color negative image in the film by reaction of the non-blocked developing agent with the dye-providing couplers inside the silver-halide emulsions, and (c) desilvering said film in one or more desilvering solutions to remove unwanted silver and/or silver halide, thereby forming a color negative image; and (d) thereafter forming a positive-image color print from the desilvered film;

In one embodiment of the present invention, the film comprises at least one blocked inhibitor that is released upon thermal development which inhibitor has substantially no effect in dry thermal development such that development proceeds in the usual manner, and wherein when the thermal development and concomitant release of the inhibitor precedes the wet-chemical process, the effect in the wet-chemical process is such that no development occurs. However, the use of the blocked inhibitor may improve image discrimination, but is not essential, to the practice of the present invention. According to the present invention, the photothermographic film can be thermally developed, even exposed to light, and then re-developed through a C-41 type of process, including bleaching and fixing, resulting in an acceptable and stable image in the film for scanning or optical printing.

In one preferred embodiment, the film is backwards compatible with respect to thermal development and wet-chemical processing and comprises at least one blocked inhibitor that is released upon thermal development which inhibitor has substantially no effect in dry thermal development such that development proceeds in the usual manner, and wherein the wet-chemical process does not have the capability to release the inhibitor, so development also can proceed in the usual manner, but wherein when thermal development and concomitant release of the inhibitor precedes the wet-chemical process, the effect in the wet-chemical process is such that no development occurs.

Thermal activation preferably occurs at temperatures ranging from about 80 to 180° C., preferably 100 to 160° C. In one preferred embodiment of the invention, the photothermographic element comprises an effective amount of a thermal solvent. In another preferred embodiment of the invention, the photothermographic element comprises a mixture of organic silver salts (inclusive of complexes) at least one of which is a silver donor.

DETAILED DESCRIPTION OF THE INVENTION

Figure 1:
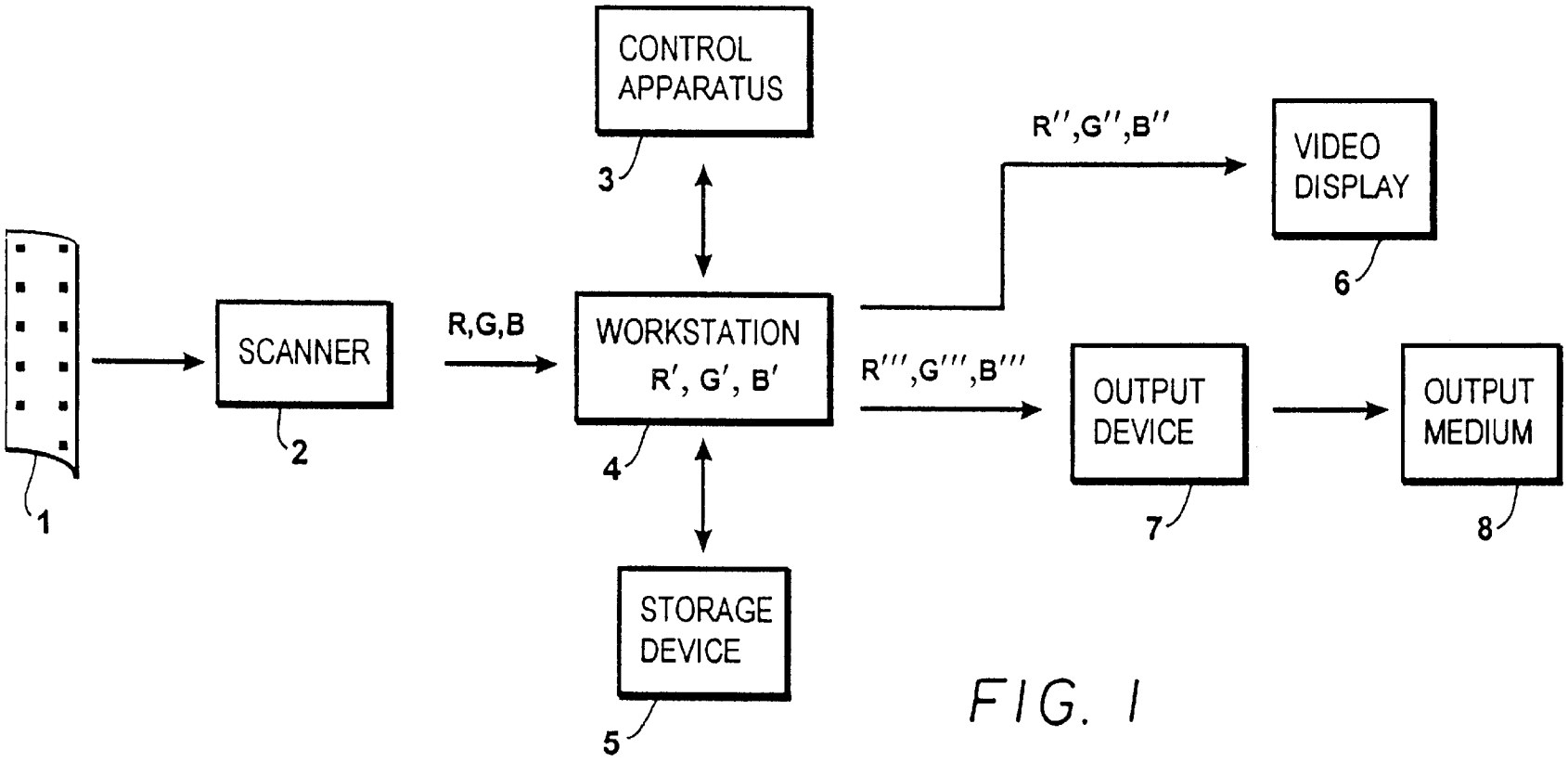
FIG. 1 shows in block diagram form an apparatus for processing and viewing image formation obtained by scanning the elements of the invention.

As indicated above, the invention relates to a dry photothermographic process employing blocked developers that decomposes (i.e., unblocks) on thermal activation to release a developing agent. In dry processing embodiments, thermal activation preferably occurs at temperatures between about 80 to 180° C., preferably 100 to 160° C. By a "dry thermal process" is meant herein a process involving, after imagewise exposure of the photographic element, developing the resulting latent image by the use of heat to raise the temperature of the photothermographic element or film to a temperature of at least about 80° C., preferably at least about 100° C., more preferably at about 120° C. to 180° C., without liquid processing of the film, preferably in an essentially dry process without the application of aqueous solutions. By an essentially dry process is meant a process that does not involve the uniform saturation of the film with a liquid, solvent, or aqueous solution. Thus, contrary to photothermographic processing involving low-volume liquid processing, the amount of water required is less than 1 times, preferably less than 0.4 times and more preferably less than 0.1 times the amount required for maximally swelling total coated layers of the film excluding a back layer. Most preferably, no liquid is required or applied added to the film during thermal treatment. Preferably, no laminates are required to be intimately contacted with the film in the presence of aqueous solution.

Preferably, during thermal development an internally located locked developing agent in reactive association with each of three light-sensitive units becomes unblocked to form a developing agent, whereby the unblocked developing agent is imagewise oxidized on development and this oxidized form reacts with the dye-providing couplers to form a dye and thereby a color image. While the formed image can be a positive working or negative working image, a negative working image is preferred.

This thermal development typically involves heating the photothermographic element until a developed image is formed, such as within about 0.5 to about 60 seconds. By increasing or decreasing the thermal processing temperature a shorter or longer time of processing is useful. Heating means known in the photothermographic arts are useful for providing the desired processing temperature for the exposed photothermographic element. The heating means is, for example, a simple hot plate, iron, roller, heated drum, microwave heating means, heated air, vapor or the like. Thermal processing is preferably carried out under ambient conditions of pressure and humidity. Conditions outside of normal atmospheric pressure and humidity are useful.

The components of the photothermographic element can be in any location in the element that provides the desired image. If desired, one or more of the components can be in one or more layers of the element. For example, in some cases, it is desirable to include certain percentages of the reducing agent, toner, thermal solvent, stabilizer and/or other addenda in the overcoat layer over the photothermographic image recording layer of the element. This, in some cases, reduces migration of certain addenda in the layers of the element.

It is necessary that the components of the photographic combination be "in association" with each other in order to produce the desired image. The term "in association" herein means that in the photothermographic element the photographic silver halide and the image-forming combination are in location with respect to each other that enables the desired processing and forms useful image. This may include the location of components in different layers.

Preferably, development processing is carried out (i) for less than 60 seconds, (ii) at the temperature from 120 to 180° C., and (iii) without the application of any aqueous solution.

Dry thermal development of a color photothermographic film for general use with respect to consumer cameras provides significant advantages in processing ease and convenience, since they are developed by the application of heat without wet processing solutions. Such film is especially amenable to development at kiosks, with the use of essentially dry equipment. Thus, it is envisioned that a consumer could bring an imagewise exposed photothermographic film, for development and printing, to a kiosk located at any one of a number of diverse locations, optionally independent from a wet-development lab, where the film could be developed and printed without requiring manipulation by third-party technicians. It is also envisioned that a consumer could own and operate such film development equipment at home, particularly since the system is dry and does not involve the application and use of complex or hazardous chemicals. Thus, the dry photothermographic system opens up new opportunities for greater convenience, accessibility, and speed of development (from the point of image capture by the consumer to the point of prints in the consumer's hands), even essentially "immediate" development in the home for a wide cross-section of consumers.

By kiosk is meant an automated free-standing machine, self-contained and (in exchange for certain payments or credits) capable of developing a roll of imagewise exposed film on a roll-by-roll basis, without requiring the intervention of technicians or other third-party persons such as necessary in wet-chemical laboratories. Typically, the customer will initiate and control the carrying out of film processing and optional printing by means of a computer interface. Such kiosks typically will be less than 6 cubic meters in dimension, preferably about 3 cubic meters or less in dimension, and hence commercially transportable to diverse locations. Such kiosks may optionally comprise a heater for color development, a scanner for digitally recording the color image, and a device for transferring the color image to a display element.

Assuming the availability and accessibility of such kiosks, such photothermographic films could potentially be developed at any time of day, "on demand," in a matter minutes, without requiring the participation of third-party processors, multiple-tank equipment and the like. Such photothermographic processing could potentially be done on an "as needed" basis, even one roll at a time, without necessitating the high-volume processing that would justify, in a commercial setting, equipment capable of high-throughput. The kiosks thus envisioned would be capable of heating the film to develop a negative color image and then subsequently scanning the film on an individual consumer basis, with the option of generating a display element corresponding to the developed color image. Details of useful scanning and image manipulation schemes are disclosed in co-filed and commonly assigned U.S. Ser. No 09/592,836 and U.S. Ser. No. 09/592,816, both hereby incorporated by reference in their entirety.

In view of advances in the art of scanning technologies, it has now become natural and practical for photothermographic color films such as disclosed in EP 0762 201 to be scanned, which can be accomplished without the necessity of removing the silver or silver-halide from the negative, although special arrangements for such scanning can be made to improve its quality. See, for example, Simons U.S. Pat. No. 5,391,443. Method for the scanning of such films are also disclosed in commonly assigned U.S. Ser. No. 60/211,364 and U.S. Ser. No. 60/211,061, hereby incorporated by reference in their entirety.

Nevertheless, the retained silver halide can scatter light, decrease sharpness and raise the overall density of the film, thus leading to impaired scanning. Further, retained silver halide can printout to ambient/viewing/scanning light, render non-imagewise density, degrade signal-to noise of the original scene, and raise density even higher. Finally, the retained silver halide and organic silver salt can remain in reactive association with the other film chemistry, making the film unsuitable as an archival media. Removal or stabilization of these silver sources are necessary to render the photothermographic film to an archival state.

Furthermore, the silver coated in the photothermographic film (silver halide, silver donor, and metallic silver) is unnecessary to the dye image produced, and this silver is valuable and the desire to recover it is high.

Thus, it may be desirable to remove, in subsequent processing steps, one or more of the silver containing components of the film: the silver halide, one or more silver donors, the silver-containing thermal fog inhibitor if present, and/or the silver metal. The three main sources are the developed metallic silver, the silver halide, and the silver donor. Alternately, it may be desirable to stabilize the silver halide in the photothermographic film. Silver can be wholly or partially stabilized/removed based on the total quantity of silver and/or the source of silver in the film.

The removal of the silver halide and silver donor can be accomplished with a common fixing chemical as known in the photographic art. Specific examples of useful chemicals include: thioethers, thioureas, thiols, thiones, thionamides, amines, quaternary amine salts, ureas, thiosulfates, thiocyanates, bisulfites, amine oxides, iminodiethanol-sulfur dioxide addition complexes, amphoteric amines, bis-sulfonylmethanes, and the carbocyclic and heterocyclic derivatives of these compounds. These chemicals have the ability to form a soluble complex with silver ion and transport the silver out of the film into a receiving vehicle.

The stabilization of the silver halide and silver donor can also be accomplished with a common stabilization chemical. The previously mentioned silver salt removal compounds can be employed in this regard. Such chemicals have the ability to form a reactively stable and light-insensitive compound with silver ion. With stabilization, the silver is not necessarily removed from the film, although the fixing agent and stabilization agents could very well be a single chemical. The physical state of the stabilized silver is no longer in large (>50 nm) particles as it was for the silver halide and silver donor, so the stabilized state is also advantaged in that light scatter and overall density is lower, rendering the image more suitable for scanning.

The removal of the metallic silver is more difficult than removal of the silver halide and silver donor. In general, two reaction steps are involved. The first step is to bleach the metallic silver to silver ion. The second step may be identical to the removal/stabilization step(s) described for silver halide and silver donor above. Metallic silver is a stable state that does not compromise the archival stability of the photothermographic film. Therefore, if stabilization of the photothermographic film is favored over removal of silver, the bleach step can be skipped and the metallic silver left in the film. In cases where the metallic silver is removed, the bleach and fix steps can be done together (called a blix) or sequentially (bleach+fix).

As indicated above, the present invention allows photothermographic films to be consecutively/sequentially processed by dry thermal development and then by a traditional wet-chemical process such as all or part of a commercial C-41 (or equivalent) process (it is also possible to have the films alternatively backwards compatible, as discussed above, and sequentially compatible). For example such processes, and particularly the C-41 process, have a bleach and fix tail end that is very effective for removing silver from coatings. However, since all trade processors are set up with development as the first step, if a photothermographic film has already been developed by heat, then a second development through the C-41 process would destroy the photothermographic image by over-development. In order to use a C-41 process for post-development processing of a dry photothermographic film, for example as a remediation step for photothermographic films, the C-41 process can be reconfigured by removing the development stage. Alternatively, to minimize cost and simplify operations, a photothermographic film can be designed to be both backwards compatible and sequentially dual processable whereby silver is remediated through the complete C-41 trade process without modification after thermal development has already occurred. The additional capability this provides is more clearly outlined by the following processing schemes:

heat development=>rapid, low quality scan=>C-41 process=>slow, high quality scan 1)

In one embodiment of the invention, this process involves the use of a blocked inhibitor that is released upon thermal development. This inhibitor has a weak effect in dry physical development, so development proceeds in the usual manner. The C-41 process does not have the capability to release the inhibitor, so development also proceeds in the usual manner. However, when thermal development (and concomitant release of the inhibitor) precedes the C-41 process, the effect in the wet process is that the inhibitor, by preventing further development, can improve the image quality. Examples of such a blocked compounds follows.

A-1

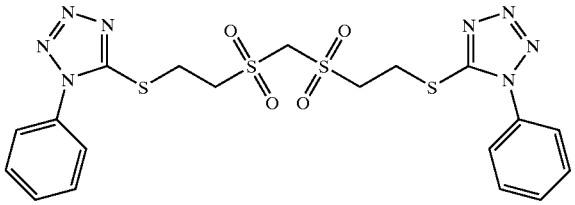

A-2

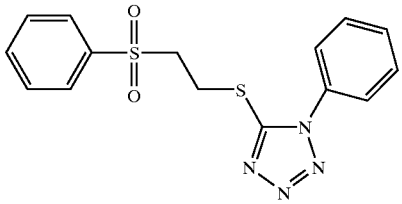

-continued

A-3

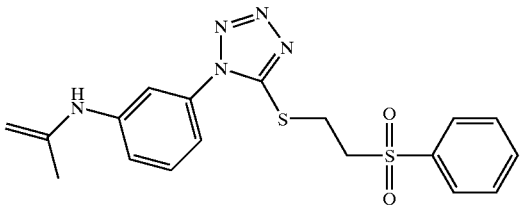

A-4

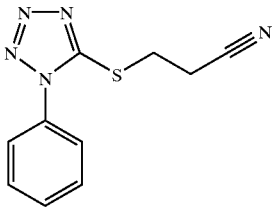

A-5

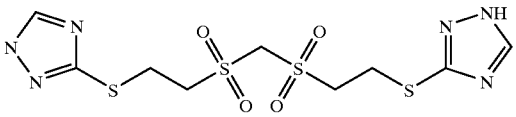

The process of the present invention preferably employs films that are backwards compatible with traditional wet-chemical processing. This is because thermal processing may not (at least initially) be as accessible as conventional C-41 processing, which are widely available as a mature industry standard. The unavailability of thermal processors and associated equipment can hinder the adoption of dry photothermographic films by the consumer. For example, accessibility of thermal processors or processing may vary with the geographical location of different consumers or the same consumer at different times. Photothermographic films that can also be processed by C-41 chemistry or the equivalent overcomes this disadvantage or problem.

Thus, photothermographic films that are backwards compatible are preferred, at least initially during commercialization, in order to permit the consumer to enjoy the benefits unique to thermal processing (kiosk processing, low environmental impact, and the like) when thermal processing is accessible, but also allow the consumer to take advantage of the current ubiquity of C-41 processing when thermal processing may not be accessible. Consequently, the film can be designed so that the consumer who submits the film for development can make the choice of either color development route described above. (In one embodiment of the invention, the blocked developing agent in the photothermographic film, after being unblocked, may be the same compound as the non-blocked developing agent.) Thus, a dry photothermographic system can be made backwards compatible for use with a conventional wet-development process.

In the case of the same photothermographic film designed for alternatively (at the discretion of the consumer) traditional wet-processing or dry thermal processing, a requirement is that the components in the photothermographic film that are designed exclusively for the dry photothermographic development (for example the blocked developing agent and certain fog inhibitors) do not adversely affect or interfere with obtaining the results otherwise achieved by traditional wet-processing. In the case of sequential development, in which an initial dry photothermographic film is followed by a conventional wet process, the requirement is somewhat different. The photothermographically developed film image must not be affected by the development step in the traditional wet-processing, but must be effectively subjected with subsequent post-development steps such as fixing and bleaching.

Preferably the present films are made dual processible by the use of a second silver complex or salt of a organic compound having have a cLogP of 0.1 to 10 and a $pK_{sp}$ of 14 to 21. For example, mercapto-heterocyclic compounds, at levels in the range of 5–3,000 g/mol, can effectively inhibit fog during thermal processing (a so-called "thermal fog inhibitor") of chromogenic photothermographic films comprising a silver donor but at the same time not inhibit normal wet-chemical processing. If the thermal fog inhibitor were not in the form of a metallic salt or complex, the thermal fog inhibitor would then interfere with wet-chemical processing. Other antifoggants such as triazolium thiolate have also been found to inhibit conventional C-41 processing and need to be excluded from films to render them backwards compatible.

In one embodiment of the invention, the color photothermographic element comprises at least three imaging layers comprising a blocked developer, a coupler, silver halide, and a mixture of at least two organic silver salts, wherein the first organic silver salt exhibits a cLogP of 0.1 to 10 and a $pK_{sp}$ of 7 to 14 and wherein the second organic silver salt exhibits a cLogP of 0.1 to 10 and a $pK_{sp}$ of 14 to 21. Both organic silver salts are present at levels above 5 g/mol of silver halide in the emulsion or imaging layer. In this embodiment, the first organic silver salt, which may be referred to as the silver donor, which is its primary function, is present, at levels in the range of 5 to 3,000 g/mol of imaging silver. The second organic silver salt, which may be referred to as the thermal fog inhibitor, which is its primary function, is present at levels in the range of 5 to 3,000 g/mol of imaging silver.

The log of the partition coefficient, clogP, characterizes the octanol/water partition equilibrium of the compound in question. Partition coefficients can be experimentally determined. As an estimate, clogP values can be calculated by fragment additivity relationships. These calculations are relatively simple for additional methylene unit in a hydrocarbon chain, but are more difficult in more complex structural variations. An expert computer program, MEDCHEM, Pomona Medchem Software, Pomona College, California (ver. 3.54), permits consistent calculation of partition coefficients as the log value, clogP, from molecular structure inputs and is used in the present invention to calculate these values as a first estimate.

The activity solubility product or $pK_{sp}$ of an organic silver salt is a measure of its solubility in water. Some organic silver salts are only sparingly soluble and their solubility products are disclosed, for example, in Chapter 1 pages 7–10 of *The Theory of the Photographic Process,* by T. H. James, Macmillan Publishing Co. Inc., New York (fourth edition 1977). Many of the organic silver salts consist of the replacement of a ligand proton with Ag+. The silver salts derived from mercapto compounds are relatively less soluble. The compound PMT has a $pK_{sp}$ of 16.2 at 25° C. as reported by Z. C. H. Tan et al., *Anal. Chem.,* 44, 411 (1972); Z. C. H. Tan, *Phototgr. Sci. Eng.,* 19, 17 (1975). In comparison, benzotriazole, for example, has a $pK_{sp}$ of 13.5 at a temperature of 25° C. as reported by C. J. Battaglia, *Photogr. Sci. Eng.,* 14, 275 (1970).

The preferred mercapto-heterocyclic compound is 1 -phenyl-5-mercapto-tetrazole (PMT). If such levels of PMT were incorporated in a film system intended to be processed conventionally, the film would show unacceptable speed and suppression of image formation. In a photothermographic system, however, PMT succeeds in suppressing the formation of Dmin with little or no penalty in imaging speed or Dmax formation. In many instances, the effect of the PMT may be to enhance Dmax.

Thus, one embodiment of the present invention (for purposes of making the photothermographic film dual processible or compatible with traditional or standard wet-chemical processes) involves the use of a compound such s 1-phenyl-5mercapto-tetrazole (PMT) the form of a silver salt in combination with a (primary) silver donor. The use of the silver salt of PMT or the like (a) prevents desorption of sensitizing dyes from the imaging silver halide grains, which otherwise can lead to speed losses; and (b) prevents defects in the film coatings such as surface roughness, which otherwise might occur in the presence of high levels of PMT not in the form of a silver salt, since such PMT tends to be present in the film as a solid particle dispersion.

Other particulars of a backwards compatible chromogenic dry photothermographic (PTG) film is disclosed in commonly assigned U.S. Ser. No. 60/211,058, hereby incorporated by reference in its entirety. Photothermographic films containing a silver donor capable of contributing to physical development and an antifoggant that is a silver salt of a mercapto compound are disclosed in commonly assigned U.S. Ser. No. 60/211,258, hereby incorporated by reference in its entirety.

In trade process, the blocked antifoggants are not released so development occurs as normal. Once they are released in thermal process, the film becomes undevelopable by trade process. This allows bleaching and fixing of thermally processed film through a complete trade process (including developer) rather than just a trade tail end.

Photothermographic films containing other specified blocked development inhibitors that modify curve shape in the thermal process, but do not inhibit in the trade process (not unblocked) are disclosed in commonly assigned U.S. Ser. No. 09/746,050, hereby incorporated by reference in its entirety. This allows for backward process compatible photothermographic film with improved tone scale, including control of the D/logH curve without latitude reduction by non-imagewise thermal release of the blocked development inhibitors. Again, these blocked inhibitors are not released in C-41 processing or the like.

Photographic elements designed to be processed thermally (involving dry physical development processes) and then scanned may be designed to achieve different responses to optically printed film elements. The dye image characteristic curve gamma is generally lower than in optically printed film elements, so as to achieve an exposure latitude of at least 2.7 log E, which is a minimum acceptable exposure latitude of a multicolor photographic element. An exposure latitude of at least 3.0 log E is preferred, since this allows for a comfortable margin of error in exposure level selection by a photographer. Even larger exposure latitudes are specifically preferred, since the ability to obtain accurate image reproduction with larger exposure errors is realized. Whereas in color negative elements intended for printing, the visual attractiveness of the printed scene is often lost when gamma is exceptionally low, when color negative elements are scanned to create digital dye image records, contrast can be increased by adjustment of the electronic signal information. For this reason, it is advantageous to control the gamma of the film to be scanned by emulsion design, laydown or coupler laydown to give two examples of useful methods, known in the art. If the film element is also to be processed using an aqueous development (chemical development process) such as is used for conventional or rapid access films, for example KODAK C-41, the gamma obtained may be further suppressed and be too low to be effectively scanned, such that the signal to noise of the photographic response is less than desired. It is therefore advantageous to design the film to be processed in either system, thermal or aqueous prior to scanning. The action of certain blocked inhibiting agents are active in reducing the gamma of the thermally developed film, but when the same film is alternatively processed in an aqueous medium, they have only a minimal effect. In this way they help create similarly good sensitometric responses from each development protocol, that can be scanned. The blocked inhibiting agents release inhibitor thermally at rates that make them effective as contrast controllers. When processed in an aqueous system, where hydrolysis rather than thermal elimination is the chemical process for inhibitor release,(a) the release may still occur, but the inhibitor released is too weak in the aqueous system to have a major effect on the developing silver halide, or (b) the release does not occur adequately within the time-scale of development. The blocked inhibiting agents may be too hydrophobic and so for solubility reasons will not be available to the aqueous phase, or the rate of hydrolysis may be too slow.

A photothermographic (PTG) film by definition is a film that requires only energy to effectuate development. Development is the process whereby silver ion is reduced to metallic silver and in a color system, a dye is created in an image-wise fashion. In all photothermographic films, the silver is retained in the coating after the heat development. This retained silver is problematic in several different ways:

With respect to "traditional kind of wet-chemical processing" or, synonymously, "wet-chemical processing" is herein meant a commercially standardized process in which the imagewise exposed color photographic element is completely immersed in a solution containing a developing agent, preferably phenylenediamine or its equivalent under agitation at a temperature of under 60° C., preferably 30 to 45° C., in order to form a color image from a latent image, wherein said developer solution comprises an unblocked developing agent that (after oxidation) forms dyes by reacting with the dye-providing couplers inside the silver-halide emulsions.

Preferably, the wet-chemical development processing is carried out (i) for from 60 to 220, preferably 150 seconds to 200 seconds, (ii) at the temperature of a color developing solution of from 35 to 40° C., and (iii) using a color developing solution containing from 10 to 20 mmol/liter of a phenylenediamine developing agent. Such processing (wet-chemical processing) are well known in the art, will now be described in more detail. Photographic elements comprising the composition of the invention can be processed in any of a number of well-known photographic processes utilizing any of a number of well-known processing compositions, described, for example, in *Research Disclosure II,* or in T. H. James, editor, *The Theory of the Photographic Process,* 4th Edition, Macmillan, New York, 1977. The development process may take place for a specified length of time and temperature, with minor variations, which process parameters are suitable to render an acceptable image.

In the case of wet-chemical processing a negative working element, the element is treated with a color developing agent (that is one which will form the colored image dyes with the color couplers), and then with an oxidizer and a solvent to remove silver and silver halide. The developing agents are of the phenylenediamine type, as described below. Preferred color developing agents are p-phenylenediamines, especially any one of the following:

4-amino N,N-diethylaniline hydrochloride, 4-amino-3-methyl-N,N-diethylaniline hydrochloride, 4-amino-3-methyl-N-ethyl-N-(2-(methanesulfonamido) ethylaniline sesquisulfate hydrate, 4-amino-3-methyl-N-ethyl-N-(2-hydroxyethyl)aniline sulfate, 4-amino-3 -β-(methanesulfonamido)ethyl-N,N-diethylaniline hydrochloride and 4-amino-N-ethyl-N-(2-methoxyethyl)-m-toluidine di-p-toluene sulfonic acid.

In the traditional wet-chemical process, such as C-41, the color developer composition can be easily prepared by mixing a suitable color developer in a suitable solution. Water can be added to the resulting composition to provide the desired composition. And the pH can be adjusted to the desired value with a suitable base such as sodium hydroxide. The color developer solution for wet-chemical development can include one or more of a variety of other addenda which are commonly used in such compositions, such as antioxidants, alkali metal halides such as potassium chloride, metal sequestering agents such as aminocarboxylic acids, buffers to maintain the pH from about 9 to about 13, such as carbonates, phosphates, and borates, preservatives, development accelerators, optical brightening agents, wetting agents, surfactants, and couplers as would be understood to the skilled artisan. The amounts of such additives are well known in the art.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, Research Disclosure, Vol. 116, December, 1973, Item 11660, and Bissonette Research Disclosure, Vol. 148, August, 1976, Items 14836, 14846 and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EPO 0487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

In traditional wet-chemical processing, development is followed by desilvering, such as bleach-fixing, in a single or multiple steps, typically involving tanks, to remove silver or silver halide, washing and drying. The desilvering in a wet-chemical process may include the use of bleaches or bleach fixes. Bleaching agents of this invention include compounds of polyvalent metal such as iron (III), cobalt (III), chromium (VI), and copper (II), persulfates, quinones, and nitro compounds. Typical bleaching agents are iron (III) salts, such as ferric chloride, ferricyanides, bichromates, and organic complexes of iron (III) and cobalt (III). Polyvalent metal complexes, such as ferric complexes, of aminopolycarboxylic acids and persulfate salts are preferred bleaching agents, with ferric complexes of aminopolycarboxylic acids being preferred for bleach-fixing solutions. Examples of useful ferric complexes include complexes of:

nitrilotriacetic acid, ethylenediaminetetraacetic acid, 3-propylenediamine tetraacetic acid, diethylenetriamine pentaacetic acid, ethylenediamine succinic acid, ortho-diamine cyclohexane tetraacetic acid ethylene glycol bis(aminoethyl ether)tetraacetic acid, diaminopropanol tetraacetic acid, N-(2-hydroxyethyl)ethylenediamine triacetic acid, ethyliminodipropionic acid, methyliminodiacetic acid, ethyliminodiacetic acid, cyclohexanediaminetetraacetic acid glycol ether diamine tetraacetic acid.

Preferred aminopolycarboxylic acids include 1,3-propylenediamine tetraacetic acid, methyliminodiactic acid and ethylenediamine tetraacetic acid. The bleaching agents may be used alone or in a mixture of two or more; with useful amounts typically being at least 0.02 moles per liter of bleaching solution, with at least 0.05 moles per liter of bleaching solution being preferred. Examples of ferric chelate bleaches and bleach-fixes, are disclosed in DE 4,031,757 and U.S. Pat. Nos. 4,294,914; 5,250,401; 5,250,402; EP 567,126; U.S. Pat. Nos. 5,250,401; 5,250,402 and U.S. patent application Ser. No. 08/128,626 filed Sep. 28, 1993.

Typical persulfate bleaches are described in Research Disclosure, December 1989, Item 308119, published by Kenneth Mason Publications, Ltd., Dudley Annex, 12a North Street, Emsworth, Hampshire P010 & DQ, England, the disclosures of which are incorporated herein by reference. This publication will be identified hereafter as Research Disclosure BL. Useful persulfate bleaches are also described in Research Disclosure, May, 1977, Item 15704; Research Disclosure, August, 1981, Item 20831; and DE 3,919,551. Sodium, potassium and ammonium persulfates are preferred, and for reasons of economy and stability, sodium persulfate is most commonly used.

A bleaching composition may be used at a pH of 2.0 to 9.0. The preferred pH of the bleach composition is between 3 and 7. If the bleach composition is a bleach, the preferred pH is 3 to 6. If the bleach composition is a bleach-fix, the preferred pH is 5 to 7. In one embodiment, the color developer and the first solution with bleaching activity may be separated by at least one processing bath or wash (intervening bath) capable of interrupting dye formation. This intervening bath may be an acidic stop bath, such as sulfuric or acetic acid; a bath that contains an oxidized developer scavenger, such as sulfite; or a simple water wash. Generally an acidic stop bath is used with persulfate bleaches.

Examples of counterions which may be associated with the various salts in these bleaching solutions are sodium, potassium, ammonium, and tetraalkylammonium cations. It may be preferable to use alkali metal cations (especially sodium and potassium cations) in order to avoid the aquatic toxicity associated with ammonium ion. In some cases, sodium may be preferred over potassium to maximize the solubility of the persulfate salt. Additionally, a bleaching solution may contain anti-calcium agents, such as 1-hydroxyethyl-1, 1-diphosphonic acid; chlorine scavengers such as those described in G. M. Einhaus and D. S. Miller, Research Disclosure, 1978, vol 175, p. 42, No. 17556; and corrosion inhibitors, such as nitrate ion, as needed.

Bleaching solutions may also contain other addenda known in the art to be useful in bleaching compositions, such as sequestering agents, sulfites, non-chelated salts of aminopolycarboxylic acids, bleaching accelerators, re-halogenating agents, halides, and brightening agents. In addition, water-soluble aliphatic carboxylic acids such as acetic acid, citric acid, propionic acid, hydroxyacetic acid, butyric acid, malonic acid, succinic acid and the like may be utilized in any effective amount. Bleaching compositions may be formulated as the working bleach solutions, solution concentrates, or dry powders. The bleach compositions of this invention can adequately bleach a wide variety of photographic elements in 30 to 240 seconds.

Bleaches may be used with any compatible fixing solution. Examples of fixing agents which may be used in either the fix or the bleach fix are water-soluble solvents for silver halide such as: a thiosulfate (e.g., sodium thiosulfate and ammonium thiosulfate); a thiocyanate (e.g., sodium thiocyanate and ammonium thiocyanate); a thioether compound (e.g., ethylenebisthioglycolic acid and 3,6-dithia-1,8-octanediol); or a thiourea. These fixing agents can be used singly or in combination. Thiosulfate is preferably used. The concentration of the fixing agent per liter is preferably about 0.2 to 2 mol. The pH range of the fixing solution is preferably 3 to 10 and more preferably 5 to 9. In order to adjust the pH of the fixing solution an acid or a base may be added, such as hydrochloric acid, sulfuric acid, nitric acid, acetic acid, bicarbonate, ammonia, potassium hydroxide, sodium hydroxide, sodium carbonate or potassium carbonate.

The fixing or bleach-fixing solution may also contain a preservative such as a sulfite (e.g., sodium sulfite, potassium sulfite, and ammonium sulfite), a bisulfite (e.g., ammonium bisulfite, sodium bisulfite, and potassium bisulfite), and a metabisulfite (e.g., potassium metabisulfite, sodium metabisulfite, and ammonium metabisulfite). The content of these compounds is about 0 to 0.50 mol/liter, and more preferably 0.02 to 0.40 mol/liter as an amount of sulfite ion. Ascorbic acid, a carbonyl bisulfite acid adduct, or a carbonyl compound may also be used as a preservative.

The above mentioned bleach and fixing baths may have any desired tank configuration including multiple tanks, counter current and/or co-current flow tank configurations. A stabilizer bath is commonly employed for final washing and hardening of the bleached and fixed photographic element prior to drying. Alternatively, a final rinse may be used. A bath can be employed prior to color development, such as a prehardening bath, or the washing step may follow the stabilizing step. Other additional washing steps may be utilized. Conventional techniques for processing are illustrated by Research Disclosure BL, Paragraph XIX.

A "backwards compatible" or "dual processible film" according to the present invention is a film that that can be developed not only by dry thermal development, but also in a traditional wet chemical process or its wet-chemical equivalent as follows:

(1) development→bleaching→fixing
(2) development→bleach fixing
(3) development→bleach fixing→fixing
(4) development→bleaching→bleach fixing
(5) development→bleaching→bleach fixing→fixing
(6) development→bleaching→washing→fixing
(7) development→washing or rinsing→bleaching→fixing
(8) development→washing or rinsing→bleach fixing
(9) development→fixing→bleach fixing
(10) development→stopping→bleaching→fixing
(11) development→stopping→bleach fixing A typical color negative film construction useful in the practice of the invention is illustrated by the following element, SCN-1:

| ELEMENT SCN-1 | |
|---|---|
| SOC | Surface Overcoat |
| BU | Blue Recording Layer Unit |
| IL1 | First Interlayer |
| GU | Green Recording Layer Unit |
| IL2 | Second Interlayer |
| RU | Red Recording Layer Unit |
| AHU | Antihalation Layer Unit |
| S | Support |
| SOC | Surface Overcoat |

The support S can be either reflective or transparent, which is usually preferred. When reflective, the support is white and can take the form of any conventional support currently employed in color print elements. When the support is transparent, it can be colorless or tinted and can take the form of any conventional support currently employed in color negative elements—e.g., a colorless or tinted transparent film support. Details of support construction are well understood in the art. Examples of useful supports are poly(vinylacetal) film, polystyrene film, poly(ethyleneterephthalate) film, poly(ethylene naphthalate) film, polycarbonate film, and related films and resinous materials, as well as paper, cloth, glass, metal, and other supports that withstand the anticipated processing conditions. The element can contain additional layers, such as filter layers, interlayers, overcoat layers, subbing layers, antihalation layers and the like. Transparent and reflective support constructions, including subbing layers to enhance adhesion, are disclosed in Section XV of *Research Disclosure I*.

Photographic elements of the present invention may also usefully include a magnetic recording material as described in *Research Disclosure,* Item 34390, November 1992, or a transparent magnetic recording layer such as a layer containing magnetic particles on the underside of a transparent support as in U.S. Pat. No. 4,279,945, and U.S. Pat. No. 4,302,523.

Each of blue, green and red recording layer units BU, GU and RU are formed of one or more hydrophilic colloid layers and contain at least one radiation-sensitive silver halide emulsion and coupler, including at least one dye image-forming coupler. It is preferred that the green, and red recording units are subdivided into at least two recording layer sub-units to provide increased recording latitude and reduced image granularity. In the simplest contemplated construction each of the layer units or layer sub-units consists of a single hydrophilic colloid layer containing emulsion and coupler. When coupler present in a layer unit or layer sub-unit is coated in a hydrophilic colloid layer other than an emulsion containing layer, the coupler containing hydrophilic colloid layer is positioned to receive oxidized color developing agent from the emulsion during development. Usually the coupler containing layer is the next adjacent hydrophilic colloid layer to the emulsion containing layer.

In order to ensure excellent image sharpness, and to facilitate manufacture and use in cameras, all of the sensitized layers are preferably positioned on a common face of the support. When in spool form, the element will be spooled such that when unspooled in a camera, exposing light strikes all of the sensitized layers before striking the face of the support carrying these layers. Further, to ensure excellent sharpness of images exposed onto the element, the total thickness of the layer units above the support should be controlled. Generally, the total thickness of the sensitized layers, interlayers and protective layers on the exposure face of the support are less than 35 μm.

Any convenient selection from among conventional radiation-sensitive silver halide emulsions can be incorporated within the layer units and used to provide the spectral absorptances of the invention. Most commonly high bromide emulsions containing a minor amount of iodide are employed. To realize higher rates of processing, high chloride emulsions can be employed. Radiation-sensitive silver chloride, silver bromide, silver iodobromide, silver iodochloride, silver chlorobromide, silver bromochloride, silver iodochlorobromide and silver iodobromochloride grains are all contemplated. The grains can be either regular or irregular (e.g., tabular). Tabular grain emulsions, those in which tabular grains account for at least 50 (preferably at least 70 and optimally at least 90) percent of total grain projected area are particularly advantageous for increasing speed in relation to granularity. To be considered tabular a grain requires two major parallel faces with a ratio of its equivalent circular diameter (ECD) to its thickness of at least 2. Specifically preferred tabular grain emulsions are those having a tabular grain average aspect ratio of at least 5 and, optimally, greater than 8. Preferred mean tabular grain thickness are less than 0.3 μm (most preferably less than 0.2 μm). Ultrathin tabular grain emulsions, those with mean tabular grain thickness of less than 0.07 μm, are specifically contemplated. The grains preferably form surface latent images so that they produce negative images when processed in a surface developer in color negative film forms of the invention.

Illustrations of conventional radiation-sensitive silver halide emulsions are provided by *Research Disclosure I,* cited above, I. Emulsion grains and their preparation. Chemical sensitization of the emulsions, which can take any conventional form, is illustrated in section IV. Chemical sensitization. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C. Spectral sensitization and sensitizing dyes, which can take any conventional form, are illustrated by section V. Spectral sensitization and desensitization. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol or as a dispersion of solid particles. The emulsion layers also typically include one or more antifoggants or stabilizers, which can take any conventional form, as illustrated by section VII. Antifoggants and stabilizers.

The silver halide grains to be used in the invention may be prepared according to methods known in the art, such as those described in *Research Disclosure I,* cited above, and James, The Theory of the Photographic Process. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure I,* Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in *Research Disclosure* Item 36736 published November 1994, here incorporated by reference.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure, I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers. The vehicle can be present in the emulsion in any amount useful in photographic emulsions. The emulsion can also include any of the addenda known to be useful in photographic emulsions.

While any useful quantity of light sensitive silver, as silver halide, can be employed in the elements useful in this invention, it is preferred that the total quantity be less than 10 g/m$^2$ of silver. Silver quantities of less than 7 g/m$^2$ are preferred, and silver quantities of less than 5 g/m$^2$ are even more preferred. The lower quantities of silver improve the optics of the elements, thus enabling the production of sharper pictures using the elements. These lower quantities of silver are additionally important in that they enable rapid development and desilvering of the elements. Conversely, a silver coating coverage of at least 1.5 g of coated silver per m$^2$ of support surface area in the element is necessary to realize an exposure latitude of at least 2.7 log E while maintaining an adequately low graininess position for pictures intended to be enlarged.

BU contains at least one yellow dye image-forming coupler, GU contains at least one magenta dye image-forming coupler, and RU contains at least one cyan dye image-forming coupler. Any convenient combination of conventional dye image-forming couplers can be employed. Conventional dye image-forming couplers are illustrated by *Research Disclosure I,* cited above, X. Dye image formers and modifiers, B. Image-dye-forming couplers. The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference.

It is common practice to coat one, two or three separate emulsion layers within a single dye image-forming layer unit. When two or more emulsion layers are coated in a single layer unit, they are typically chosen to differ in sensitivity. When a more sensitive emulsion is coated over a less sensitive emulsion, a higher speed is realized than when the two emulsions are blended. When a less sensitive emulsion is coated over a more sensitive emulsion, a higher contrast is realized than when the two emulsions are blended. It is preferred that the most sensitive emulsion be located nearest the source of exposing radiation and the slowest emulsion be located nearest the support.

One or more of the layer units of the invention is preferably subdivided into at least two, and more preferably three or more sub-unit layers. It is preferred that all light sensitive silver halide emulsions in the color recording unit have spectral sensitivity in the same region of the visible spectrum. In this embodiment, while all silver halide emulsions incorporated in the unit have spectral absorptances according to invention, it is expected that there are minor differences in spectral absorptance properties between them. In still more preferred embodiments, the sensitizations of the slower silver halide emulsions are specifically tailored to account for the light shielding effects of the faster silver halide emulsions of the layer unit that reside above them, in order to provide an imagewise uniform spectral response by the photographic recording material as exposure varies with low to high light levels. Thus higher proportions of peak light absorbing spectral sensitizing dyes may be desirable in the slower emulsions of the subdivided layer unit to account for on-peak shielding and broadening of the underlying layer spectral sensitivity.

The interlayers IL1 and IL2 are hydrophilic colloid layers having as their primary function color contamination reduction—i.e., prevention of oxidized developing agent from migrating to an adjacent recording layer unit before reacting with dye-forming coupler. The interlayers are in part effective simply by increasing the diffusion path length that oxidized developing agent must travel. To increase the effectiveness of the interlayers to intercept oxidized developing agent, it is conventional practice to incorporate oxidized developing agent. Antistain agents (oxidized developing agent scavengers) can be selected from among those disclosed by *Research Disclosure I,* X. Dye image formers and modifiers, D. Hue modifiers/stabilization, paragraph (2). When one or more silver halide emulsions in GU and RU are high bromide emulsions and, hence have significant native sensitivity to blue light, it is preferred to incorporate a yellow filter, such as Carey Lea silver or a yellow processing solution decolorizable dye, in IL1. Suitable yellow filter dyes can be selected from among those illustrated by *Research Disclosure I,* Section VIII. Absorbing and scattering materials, B. Absorbing materials. In elements of the instant invention, magenta colored filter materials are absent from IL2 and RU.

The antihalation layer unit AHU typically contains a processing solution removable or decolorizable light absorbing material, such as one or a combination of pigments and dyes. Suitable materials can be selected from among those disclosed in *Research Disclosure I,* Section VIII. Absorbing materials. A common alternative location for AHU is between the support S and the recording layer unit coated nearest the support.

The surface overcoats SOC are hydrophilic colloid layers that are provided for physical protection of the color negative elements during handling and processing. Each SOC also provides a convenient location for incorporation to of addenda that are most effective at or near the surface of the color negative element. In some instances the surface overcoat is divided into a surface layer and an interlayer, the latter functioning as spacer between the addenda in the surface layer and the adjacent recording layer unit. In another common variant form, addenda are distributed between the surface layer and the interlayer, with the latter containing addenda that are compatible with the adjacent recording layer unit. Most typically the SOC contains addenda, such as coating aids, plasticizers and lubricants, antistats and matting agents, such as illustrated by *Research Disclosure I,* Section IX. Coating physical property modifying addenda. The SOC overlying the emulsion layers additionally preferably contains an ultraviolet absorber, such as illustrated by *Research Disclosure I,* Section VI. UV dyes/optical brighteners/luminescent dyes, paragraph (1).

Instead of the layer unit sequence of element SCN-1, alternative layer units sequences can be employed and are particularly attractive for some emulsion choices. Using high chloride emulsions and/or thin (<0.2 $\mu$m mean grain thickness) tabular grain emulsions all possible interchanges of the positions of BU, GU and RU can be undertaken without risk of blue light contamination of the minus blue records, since these emulsions exhibit negligible native sensitivity in the visible spectrum. For the same reason, it is unnecessary to incorporate blue light absorbers in the interlayers.

When the emulsion layers within a dye image-forming layer unit differ in speed, it is conventional practice to limit the incorporation of dye image-forming coupler in the layer of highest speed to less than a stoichometric amount, based on silver. The function of the highest speed emulsion layer is to create the portion of the characteristic curve just above the minimum density—i.e., in an exposure region that is below the threshold sensitivity of the remaining emulsion layer or layers in the layer unit. In this way, adding the increased granularity of the highest sensitivity speed emulsion layer to the dye image record produced is minimized without sacrificing imaging speed.

In the foregoing discussion the blue, green and red recording layer units are described as containing yellow, magenta and cyan image dye-forming couplers, respectively, as is conventional practice in color negative elements used for printing. The invention can be suitably applied to conventional color negative construction as illustrated. Color reversal film construction would take a similar form, with the exception that colored masking couplers would be completely absent; in typical forms, development inhibitor releasing couplers would also be absent. In preferred embodiments, the color negative elements are intended exclusively for scanning to produce three separate electronic color records. Thus the actual hue of the image dye produced is of no importance. What is essential is merely that the dye image produced in each of the layer units be differentiable from that produced by each of the remaining layer units. To provide this capability of differentiation it is contemplated that each of the layer units contain one or more dye image-forming couplers chosen to produce image dye having an absorption half-peak bandwidth lying in a different spectral region. It is immaterial whether the blue, green or red recording layer unit forms a yellow, magenta or cyan dye having an absorption half peak bandwidth in the blue, green or red region of the spectrum, as is conventional in a color negative element intended for use in printing, or an absorption half-peak bandwidth in any other convenient region of the spectrum, ranging from the near ultraviolet (300–400 nm) through the visible and through the near infrared (700–1200 nm), so long as the absorption half-peak bandwidths of the image dye in the layer units extend over substantially non-coextensive wavelength ranges. The term "substantially non-coextensive wavelength ranges" means that each image dye exhibits an absorption half-peak band width that extends over at least a 25 (preferably 50) nm spectral region that is not occupied by an absorption half-peak band width of another image dye. Ideally the image dyes exhibit absorption half-peak band widths that are mutually exclusive.

When a layer unit contains two or more emulsion layers differing in speed, it is possible to lower image granularity in the image to be viewed, recreated from an electronic record, by forming in each emulsion layer of the layer unit a dye image which exhibits an absorption half-peak band width that lies in a different spectral region than the dye images of the other emulsion layers of layer unit. This technique is particularly well suited to elements in which the layer units are divided into sub-units that differ in speed. This allows multiple electronic records to be created for each layer unit, corresponding to the differing dye images formed by the emulsion layers of the same spectral sensitivity. The digital record formed by scanning the dye image formed by an emulsion layer of the highest speed is used to recreate the portion of the dye image to be viewed lying just above minimum density. At higher exposure levels second and, optionally, third electronic records can be formed by scanning spectrally differentiated dye images formed by the remaining emulsion layer or layers. These digital records contain less noise (lower granularity) and can be used in recreating the image to be viewed over exposure ranges above the threshold exposure level of the slower emulsion layers. This technique for lowering granularity is disclosed in greater detail by Sutton U.S. Pat. No. 5,314,794, the disclosure of which is here incorporated by reference.

Each layer unit of the color negative elements of the invention produces a dye image characteristic curve gamma of less than 1.5, which facilitates obtaining an exposure latitude of at least 2.7 log E. A minimum acceptable exposure latitude of a multicolor photographic element is that which allows accurately recording the most extreme whites (e.g., a bride's wedding gown) and the most extreme blacks (e.g., a bride groom's tuxedo) that are likely to arise in photographic use. An exposure latitude of 2.6 log E can just accommodate the typical bride and groom wedding scene. An exposure latitude of at least 3.0 log E is preferred, since this allows for a comfortable margin of error in exposure level selection by a photographer. Even larger exposure latitudes are specifically preferred, since the ability to obtain accurate image reproduction with larger exposure errors is realized. Whereas in color negative elements intended for printing, the visual attractiveness of the printed scene is often lost when gamma is exceptionally low, when color negative elements are scanned to create digital dye image records, contrast can be increased by adjustment of the electronic signal information. When the elements of the invention are scanned using a reflected beam, the beam travels through the layer units twice. This effectively doubles gamma ($\Delta D \div \Delta \log E$) by doubling changes in density ($\Delta D$). Thus, gamma's as low as 1.0 or even 0.6 are contemplated and exposure latitudes of up to about 5.0 log E or higher are feasible. Gammas of about 0.55 are preferred. Gammas of between about 0.4 and 0.5 are especially preferred.

Instead of employing dye-forming couplers, any of the conventional incorporated dye image generating compounds employed in multicolor imaging can be alternatively incorporated in the blue, green and red recording layer units. Dye images can be produced by the selective destruction, formation or physical removal of dyes as a function of exposure. For example, silver dye bleach processes are well known and commercially utilized for forming dye images by the selective destruction of incorporated image dyes. The silver dye bleach process is illustrated by *Research Disclosure I,* Section X. Dye image formers and modifiers, A. Silver dye bleach.

It is also well known that preformed image dyes can be incorporated in blue, green and red recording layer units, the dyes being chosen to be initially immobile, but capable of releasing the dye chromophore in a mobile moiety as a function of entering into a redox reaction with oxidized developing agent. These compounds are commonly referred to as redox dye releasers (RDR's). By washing out the released mobile dyes, a retained dye image is created that can be scanned. It is also possible to transfer the released mobile dyes to a receiver, where they are immobilized in a mordant layer. The image-bearing receiver can then be scanned. Initially the receiver is an integral part of the color negative element. When scanning is conducted with the receiver remaining an integral part of the element, the receiver typically contains a transparent support, the dye image bearing mordant layer just beneath the support, and a white reflective layer just beneath the mordant layer. Where the receiver is peeled from the color negative element to facilitate scanning of the dye image, the receiver support can be reflective, as is commonly the choice when the dye image is intended to be viewed, or transparent, which allows transmission scanning of the dye image. RDR's as well as dye image transfer systems in which they are incorporated are described in *Research Disclosure,* Vol. 151, November 1976, Item 15162.

It is also recognized that the dye image can be provided by compounds that are initially mobile, but are rendered immobile during imagewise development. Image transfer systems utilizing imaging dyes of this type have long been used in previously disclosed dye image transfer systems. These and other image transfer systems compatible with the practice of the invention are disclosed in *Research Disclosure,* Vol. 176, December 1978, Item 17643, XXIII. Image transfer systems.

A number of modifications of color negative elements have been suggested for accommodating scanning, as illustrated by *Research Disclosure I*, Section XIV. Scan facilitating features. These systems to the extent compatible with the color negative element constructions described above are contemplated for use in the practice of this invention.

It is also contemplated that the imaging element of this invention may be used with non-conventional sensitization schemes. For example, instead of using imaging layers sensitized to the red, green, and blue regions of the spectrum, the light-sensitive material may have one white-sensitive layer to record scene luminance, and two color-sensitive layers to record scene chrominance. Following development, the resulting image can be scanned and digitally reprocessed to reconstruct the full colors of the original scene as described in U.S. Pat. No. 5,962,205. The imaging element may also comprise a pan-sensitized emulsion with accompanying color-separation exposure. In this embodiment, the developers of the invention would give rise to a colored or neutral image which, in conjunction with the separation exposure, would enable full recovery of the original scene color values. In such an element, the image may be formed by either developed silver density, a combination of one or more conventional couplers, or "black" couplers such as resorcinol couplers. The separation exposure may be made either sequentially through appropriate filters, or simultaneously through a system of spatially discreet filter elements (commonly called a "color filter array").

The imaging element of the invention may also be a black and white image-forming material comprised, for example, of a pan-sensitized silver halide emulsion and a developer of the invention. In this embodiment, the image may be formed by developed silver density following processing, or by a coupler that generates a dye which can be used to carry the neutral image tone scale.

When conventional yellow, magenta, and cyan image dyes are formed to read out the recorded scene exposures following chemical development of conventional exposed color photographic materials, the response of the red, green, and blue color recording units of the element can be accurately discerned by examining their densities. Densitometry is the measurement of transmitted light by a sample using selected colored filters to separate the imagewise response of the RGB image dye forming units into relatively independent channels. It is common to use Status M filters to gauge the response of color negative film elements intended for optical printing, and Status A filters for color reversal films intended for direct transmission viewing. In integral densitometry, the unwanted side and tail absorptions of the imperfect image dyes leads to a small amount of channel mixing, where part of the total response of, for example, a magenta channel may come from off-peak absorptions of either the yellow or cyan image dyes records, or both, in neutral characteristic curves. Such artifacts may be negligible in the measurement of a film's spectral sensitivity. By appropriate mathematical treatment of the integral density response, these unwanted off-peak density contributions can be completely corrected providing analytical densities, where the response of a given color record is independent of the spectral contributions of the other image dyes. Analytical density determination has been summarized in the *SPSE Handbook of Photographic Science and Engineering,* W. Thomas, editor, John Wiley and Sons, New York, 1973, Section 15.3, Color Densitometry, pp. 840–848.

Image noise can be reduced, where the images are obtained by scanning exposed and processed color negative film elements to obtain a manipulatable electronic record of the image pattern, followed by reconversion of the adjusted electronic record to a viewable form. Image sharpness and colorfulness can be increased by designing layer gamma ratios to be within a narrow range while avoiding or minimizing other performance deficiencies, where the color record is placed in an electronic form prior to recreating a color image to be viewed. Whereas it is impossible to separate image noise from the remainder of the image information, either in printing or by manipulating an electronic image record, it is possible by adjusting an electronic image record that exhibits low noise, as is provided by color negative film elements with low gamma ratios, to improve overall curve shape and sharpness characteristics in a manner that is impossible to achieve by known printing techniques. Thus, images can be recreated from electronic image records derived from such color negative elements that are superior to those similarly derived from conventional color negative elements constructed to serve optical printing applications. The excellent imaging characteristics of the described element are obtained when the gamma ratio for each of the red, green and blue color recording units is less than 1.2. In a more preferred embodiment, the red, green, and blue light sensitive color forming units each exhibit gamma ratios of less than 1.15. In an even more preferred embodiment, the red and blue light sensitive color forming units each exhibit gamma ratios of less than 1.10. In a most preferred embodiment, the red, green, and blue light sensitive color forming units each exhibit gamma ratios of less than 1.10. In all cases, it is preferred that the individual color unit(s) exhibit gamma ratios of less than 1.15, more preferred that they exhibit gamma ratios of less than 1.10 and even more preferred that they exhibit gamma ratios of less than 1.05. The gamma ratios of the layer units need not be equal. These low values of the gamma ratio are indicative of low levels of interlayer interaction, also known as interlayer interimage effects, between the layer units and are believed to account for the improved quality of the images after scanning and electronic manipulation. The apparently deleterious image characteristics that result from chemical interactions between the layer units need not be electronically suppressed during the image manipulation activity. The interactions are often difficult if not impossible to suppress properly using known electronic image manipulation schemes.

Elements having excellent light sensitivity are best employed in the practice of this invention. The elements should have a sensitivity of at least about ISO 50, preferably have a sensitivity of at least about ISO 100, and more preferably have a sensitivity of at least about ISO 200. Elements having a sensitivity of up to ISO 3200 or even higher are specifically contemplated. The speed, or sensitivity, of a color negative photographic element is inversely related to the exposure required to enable the attainment of a specified density above fog after processing. Photographic speed for a color negative element with a gamma of about 0.65 in each color record has been specifically defined by the American National Standards Institute (ANSI) as ANSI Standard Number pH 2.27–1981 (ISO (ASA Speed)) and relates specifically the average of exposure levels required to produce a density of 0.15 above the minimum density in each of the green light sensitive and least sensitive color recording unit of a color film. This definition conforms to the International Standards Organization (ISO) film speed rating. For the purposes of this application, if the color unit gammas differ from 0.65, the ASA or ISO speed is to be calculated by linearly amplifying or deamplifying the gamma vs. log E (exposure) curve to a value of 0.65 before determining the speed in the otherwise defined manner.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. The one-time-use cameras employed in this invention can be any of those known in the art. These cameras can provide specific features as known in the art such as shutter means, film winding means, film advance means, waterproof housings, single or multiple lenses, lens selection means, variable aperture, focus or focal length lenses, means for monitoring lighting conditions, means for adjusting shutter times or lens characteristics based on lighting conditions or user provided instructions, and means for camera recording use conditions directly on the film. These features include, but are not limited to: providing simplified mechanisms for manually or automatically advancing film and resetting shutters as described at Skarman, U.S. Pat. No. 4,226,517; providing apparatus for automatic exposure control as described at Matterson et al, U.S. Pat. No. 4,345,835; moisture-proofing as described at Fujimura et al, U.S. Pat. No. 4,766,451; providing internal and external film casings as described at Ohmura et al, U.S. Pat. No. 4,751,536; providing means for recording use conditions on the film as described at Taniguchi et al, U.S. Pat. No. 4,780,735; providing lens fitted cameras as described at Arai, U.S. Pat. No. 4,804,987; providing film supports with superior anti-curl properties as described at Sasaki et al, U.S. Pat. No. 4,827,298; providing a viewfinder as described at Ohmura et al, U.S. Pat. No. 4,812,863; providing a lens of defined focal length and lens speed as described at Ushiro et al, U.S. Pat. No. 4,812,866; providing multiple film containers as described at Nakayama et al, U.S. Pat. No. 4,831,398 and at Ohmura et al, U.S. Pat. No. 4,833,495; providing films with improved anti-friction characteristics as described at Shiba, U.S. Pat. No. 4,866,469; providing winding mechanisms, rotating spools, or resilient sleeves as described at Mochida, U.S. Pat. No. 4,884,087; providing a film patrone or cartridge removable in an axial direction as described by Takei et al at U.S. Pat. Nos. 4,890,130 and 5,063,400; providing an electronic flash means as described at Ohmura et al, U.S. Pat. No. 4,896,178; providing an externally operable member for effecting exposure as described at Mochida et al, U.S. Pat. No. 4,954,857; providing film support with modified sprocket holes and means for advancing said film as described at Murakami, U.S. Pat. No. 5,049,908; providing internal mirrors as described at Hara, U.S. Pat. No. 5,084,719; and providing silver halide emulsions suitable for use on tightly wound spools as described at Yagi et al, European Patent Application 0,466,417 A.

While the film may be mounted in the one-time-use camera in any manner known in the art, it is especially preferred to mount the film in the one-time-use camera such that it is taken up on exposure by a thrust cartridge. Thrust cartridges are disclosed by Kataoka et al U.S. Pat. No. 5,226,613; by Zander U.S. Pat. No. 5,200,777; by Dowling et al U.S. Pat. No. 5,031,852; and by Robertson et al U.S. Pat. No. 4,834,306. Narrow bodied one-time-use cameras suitable for employing thrust cartridges in this way are described by Tobioka et al U.S. Pat. No. 5,692,221.

Cameras may contain a built-in processing capability, for example a heating element. Designs for such cameras including their use in an image capture and display system are disclosed in U.S. patent application Ser. No. 09/388,573 filed Sep. 1, 1999, incorporated herein by reference. The use of a one-time use camera as disclosed in said application is particularly preferred in the practice of this invention.

Photographic elements of the present invention are preferably imagewise exposed using any of the known techniques, including those described in *Research Disclosure I,* Section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like). The photothermographic elements are also exposed by means of various forms of energy, including ultraviolet and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide.

The photothermographic elements of the present invention are preferably of type B as disclosed in *Research Disclosure I.* Type B elements contain in reactive association a photosensitive silver halide, a reducing agent or developer, optionally an activator, a coating vehicle or binder, and a salt or complex of an organic compound with silver ion. In these systems, this organic complex is reduced during development to yield silver metal. The organic silver salt will be referred to as the silver donor. References describing such imaging elements include, for example, U.S. Pat. Nos. 3,457,075; 4,459,350; 4,264,725 and 4,741,992. In the type B photothermographic material it is believed that the latent image silver from the silver halide acts as a catalyst for the described image-forming combination upon processing. In these systems, a preferred concentration of photographic silver halide is within the range of 0.01 to 100 moles of photographic silver halide per mole of silver donor in the photothermographic material.

The Type B photothermographic element comprises an oxidation-reduction image forming combination that contains an organic silver salt oxidizing agent. The organic silver salt is a silver salt which is comparatively stable to light, but aids in the formation of a silver image when heated to 80° C. or higher in the presence of an exposed photocatalyst (i.e., the photosensitive silver halide) and a reducing agent.

Suitable organic silver donors include silver salts of a compound comprising a nitrogen acid (imine) group, which group can optionally be part of the ring structure of a heterocyclic compound. Aliphatic and aromatic carboxylic acids such as silver behenate or silver benzoate, in which the silver is associated with the carboxylic acid moiety, are specifically excluded as the organic silver donor compound, although compounds that have both a nitrogen acid moiety and carboxylic acid moiety may be included as donors of this invention only insofar as the silver ion is associated with the nitrogen acid rather than the carboxylic acid group. The donor can also contain a mercapto residue, provided that the sulfur does not bind silver too strongly, and is preferably not a thiol or thione compound.

Preferably, the silver donor is a silver salt of a compound containing an imino group and a heterocyclic nucleus. Typical preferred heterocyclic nuclei include triazole, oxazole, thiazole, thiazoline, imidazoline, imidazole, diazole, pyridine and triazine.

The organic silver donor may also be the derivative of a tetrazole. Specific examples include but are not limited to 1H-tetrazole, 5-ethyl-1H-tetrazole, 5-amino-1H-tetrazole, 5-4'methoxyphenyl-1H-tetrazole, and 5-4'carboxyphenyl-1H-tetrazole.

The organic silver donor may also be a derivative of an imidazole. Specific examples include but are not limited to benzimidazole, 5-methyl-benzimidazole, imidazole, 2-methyl-benzimidazole, and 2-methyl-5-nitro-benzimidazole.

The first oganic silver salt may also be a derivative of a pyrazole. Specific examples include but are not limited to pyrazole, 3,4-methyl-pyrazole, and 3-phenyl-pyrazole.

The organic silver donor may also be a derivative of a triazole. Specific examples include but are not limited to benzotriazole, 1H-1,2,4-trazole, 3-amino-1,2,4 triazole, 3-amino-5-benzylmercapto-1,2,4-triazole, 5,6-dimethyl benzotriazole, 5-chloro benzotriazole, and 4-nitro-6-chloro-benzotriazole.

Other silver salts of nitrogen acids may also be used as a silver doner. Examples would include but not be limited to o-benzoic sulfimide, 4-hydroxy-6-methyl-1,3,3A,7-tetraazaindene, 4-hydroxy-6-methyl-1,2,3,3A,7-pentaazaindene, urazole, and 4-hydroxy-5-bromo-6-methyl-1,2,3,3A,7-pentaazaindene.

Most preferred examples of the organic silver donor compounds include the silver salts of benzotriazole, triazole, and derivatives thereof, as mentioned above and also described in Japanese patent publications 30270/69 and 18146/70, for example a silver salt of benzotriazole or methylbenzotriazole, etc., a silver salt of a halogen substituted benzotriazole, such as a silver salt of 5-chlorobenzotriazole, etc., a silver salt of 1,2,4-triazole, a silver salt of 3-amino-5-mercaptobenzyl-1,2,4-triazole, a silver salt of 1H-tetrazole as described in U.S. Pat. No. 4,220,709.

Preferably, in reactive association with the silver organic donor is a second silver organic salt which can function as a thermal fog inhibitor, according to the present invention include silver salts of thiol or thione substituted compounds having a heterocyclic nucleus containing 5 or 6 ring atoms, at least one of which is nitrogen, with other ring atoms including carbon and up to two hetero-atoms selected from among oxygen, sulfur and nitrogen are specifically contemplated. Typical preferred heterocyclic nuclei include triazole, oxazole, thiazole, thiazoline, imidazoline, imidazole, diazole, pyridine and triazine. Preferred examples of these heterocyclic compounds include a silver salt of 2-mercaptobenzimidazole, a silver salt of 2-mercapto-5-aminothiadiazole, a silver salt of 5-carboxylic-1-methyl-2-phenyl-4-thiopyridine, a silver salt of mercaptotriazine, a silver salt of 2-mercaptobenzoxazole.

The second organic silver salt may be a derivative of a thionamide. Specific examples would include but not be limited to the silver salts of 6-chloro-2-mercapto benzothiazole, 2-mercapto-thiazole, naptho(1,2-d)thiazole-2(1H)-thione,4-methyl-4-thiazoline-2-thione, 2-thiazolidinethione, 4,5-dimethyl4-thiazoline-2-thione, 4-methyl-5-carboxy-4-thiazoline-2-thione, and 3-(2-carboxyethyl)-4-methyl-4-thiazoline-2-thione.

Preferably, the second organic silver salt is a derivative of a mercapto-triazole. Specific examples would include, but not be limited to, a silver salt of 3-mercapto4-phenyl-1,2,4 triazole and a silver salt of 3-mercapto-1,2,4-triazole.

Most preferably the second organic salt is a derivative of a mercapto-tetrazole. In one preferred embodiment, a mercapto tetrazole compound useful in the present invention is represented by the following structure:

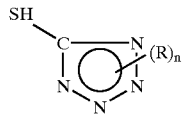

wherein n is 0 or 1, and R is independently selected from the group consisting of substituted or unsubstituted alkyl, aralkyl, or aryl. Substituents include, but are not limited to, C1 to C6 alkyl, nitro, halogen, and the like, which substituents do not adversely affect the thermal fog inhibiting effect of the silver salt. Preferably, n is 1 and R is an alkyl having 1 to 6 carbon atoms or a substituted or unsubstituted phenyl group. Specific examples include but are not limited to silver salts of 1-phenyl-5-mercapto-tetrazole, 1-(3-acetamido)-5-mercapto-tetrazole, or 1-[3-(2-sulfo)benzamidophenyl]-5-mercapto-tetrazole.

In one embodiment of the invention, the silver organic donor is a benzotriazole or derivative thereof and the second organic silver salt is a mercapto-functional compound, preferably mercapto-heterocyclic compound. The second organic silver salt, at levels in the range of 5 to 3,000 g/mol of imaging silver, can effectively inhibit fog during thermal processing of chromogenic photothermographic films comprising a silver donor.

A particularly preferred thermal fog inhibitor is 1-phenyl-5-mercapto-tetrazole (PMT). In contrast, if such levels of PMT were incorporated in a film system intended to be processed conventionally, the film would show s unacceptable speed and suppression of image formation. Surprisingly, in a photothermographic system, however, the thermal fog inhibitor succeeds in effectively suppressing the formation of Dmin with little or no penalty in imaging speed or Dmax formation. In many instances, enhancement of Dmax can even be shown by the use of the thermal fog inhibitor, an effect completely unexpected in comparison to the conventional system.

The use of a thermal fog inhibitor has been found to allow conventional wet processing of the photothermographic material to proceed. Such thermal fog inhibitor tends to be present in the film as a solid particle dispersion.

Without wishing to be bound by theory, the organic silver salt that inhibits thermal fog is believed not to function as a conventional fog inhibitor, by absorption to the silver halide particles, but rather by modulating the concentration of silver ion or Ag+ that becomes available from the silver donor during thermal activation. Accordingly, the thermal fog inhibitor is believed to hold back the halide ion pump rather than poisoning the silver metal. Since the thermal fog inhibitor has a lower water solubility (higher $pK_{sp}$) than the organic compound in the silver donor, the thermal fog inhibitor holds back the silver ion more strongly than the organic compound in the silver donor.

Silver salt complexes may be prepared by mixture of aqueous solutions of a silver ionic species, such as silver nitrate, and a solution of the organic ligand to be complexed with silver. The mixture process may take any convenient form, including those employed in the process of silver halide precipitation. A stabilizer may be used to avoid flocculation of the silver complex particles. The stabilizer may be any of those materials known to be useful in the photographic art, such as, but not limited to, gelatin, polyvinyl alcohol or polymeric or monomeric surfactants.

In general, the organic silver salt form of the thermal fog inhibitor is formed by mixing silver nitrate and other salts with the free base of the PMT of the like. By raising the pH sufficiently with alkaline base, the silver salt of PMT can be precipitated, typically in spheroids 20 nm in diameter and larger. The silver salt of PMT can optionally be ball milled to form a dispersion and added to the gelatin and silver-halide containing emulsion at a pH of 5–7.

The photosensitive silver halide grains and the organic silver salt are coated so that they are in catalytic proximity during development. They can be coated in contiguous layers, but are preferably mixed prior to coating. Conventional mixing techniques are illustrated by *Research Disclosure,* Item 17029, cited above, as well as U.S. Pat. No. 3,700,458 and published Japanese patent applications Nos. 32928/75, 13224/74, 17216/75 and 42729/76.

Examples of blocked developers that can be used in photographic elements of the present invention include, but are not limited to, the blocked developing agents described in U.S. Pat. No. 3,342,599, to Reeves; *Research Disclosure* (129 (1975) pp. 27–30) published by Kenneth Mason Publications, Ltd., Dudley Annex, 12a North Street, Emsworth, Hampshire P010 7DQ, ENGLAND; U.S. Pat. No. 4,157,915, to Hamaoka et al.; U.S. Pat. No. 4,060,418, to Waxman and Mourning; and in U.S. Pat. No. 5,019,492. Particularly useful are those blocked developers described in U.S. application Ser. No. 09/476,234, filed Dec. 30, 1999, IMAGING ELEMENT CONTAINING A BLOCKED PHOTOGRAPICALLY USEFUL COMPOUND; U.S. application Ser. No. 09/475,691, filed Dec. 30, 1999, IMAGING ELEMENT CONTAINING A BLOCKED PHOTOGRAPHICALLY USEFUL COMPOUND; U.S. application Ser. No. 09/475,703, filed Dec. 30, 1999, IMAGING ELEMENT CONTAINING A BLOCKED PHOTOGRAPHICALLY USEFUL COMPOUND; U.S. application Ser. No. 09/475,690, filed Dec. 30, 1999, IMAGING ELEMENT CONTAINING A BLOCKED PHOTOGRAPHICALLY USEFUL COMPOUND; and U.S. application Ser. No. 09/476,233, filed Dec. 30, 1999, PHOTOGRAPHIC OR photothermographic ELEMENT CONTAINING A BLOCKED PHOTOGRAPHICALLY USEFUL COMPOUND. Further improvements in blocked developers are disclosed in U.S. Ser. No. 09/710,341, U.S. Ser. No. 09/718,014, U.S. Ser. No. 09/711,769, and U.S. Ser. No. 09/710,348. Yet other improvements in blocked developers and their use in photothermographic elements are found in commonly assigned copending applications, filed concurrently herewith, U.S. Ser. No. 09/718,027 and U.S. Ser. No. 09/717,742.

In one embodiment of the invention blocked developer for use in the present invention may be represented by the following Structure I:

$$\text{DEV—(LINK 1)}_l\text{—(TIME)}_m\text{—(LINK2)}_n\text{—B} \qquad \text{I}$$

wherein,

DEV is a silver-halide color developing agent;

LINK 1 and LINK 2 are linking groups;

TIME is a timing group;

l is 0 or 1;

m is 0, 1, or 2;

n is 0 or 1;

l+n is 1 or 2;

B is a blocking group or B is:

$$\text{—B'—(LINK 2)}_n\text{—(TIME)}_m\text{—(LINK 1)}_l\text{—DEV}$$

wherein B' also blocks a second developing agent DEV.

In a preferred embodiment of the invention, LINK 1 or LINK 2 are of Structure II:

II

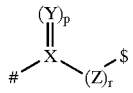

wherein

X represents carbon or sulfur;

Y represents oxygen, sulfur of N—$R_1$, where $R_1$ is substituted or unsubstituted alkyl or substituted or unsubstituted aryl;

p is 1 or 2;

Z represents carbon, oxygen or sulfur;

r is 0 or 1;

with the proviso that when X is carbon, both p and r are 1, when X is sulfur, Y is oxygen, p is 2 and r is 0;

# denotes the bond to PUG (for LINK 1) or TIME (for LINK 2):

$ denotes the bond to TIME (for LINK 1) or $T_{(t)}$ substituted carbon (for LINK 2).

Illustrative linking groups include, for example,

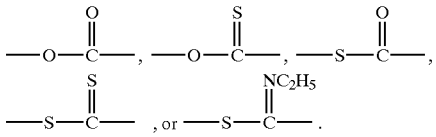

TIME is a timing group. Such groups are well-known in the art such as (1) groups utilizing an aromatic nucleophilic substitution reaction as disclosed in U.S. Pat. No. 5,262,291; (2) groups utilizing the cleavage reaction of a hemiacetal (U.S. Pat. No. 4,146,396, Japanese Applications 60-249148; 60-249149); (3) groups utilizing an electron transfer reaction along a conjugated system (U.S. Pat. Nos. 4,409,323; 4,421,845; Japanese Applications 57-188035; 58-98728; 58-209736; 58-209738); and (4) groups using an intramolecular nucleophilic substitution reaction (U.S. Pat. No. 4,248,962).

Illustrative timing groups are illustrated by formulae T-1 through T-4.

T-1

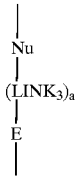

wherein:

Nu is a nucleophilic group;

E is an electrophilic group comprising one or more carbo- or hetero-aromatic rings, containing an electron deficient carbon atom;

LINK 3 is a linking group that provides 1 to 5 atoms in the direct path between the nucleopnilic site of Nu and the electron deficient carbon atom in E; and a is 0 or 1.

Such timing groups include, for example:

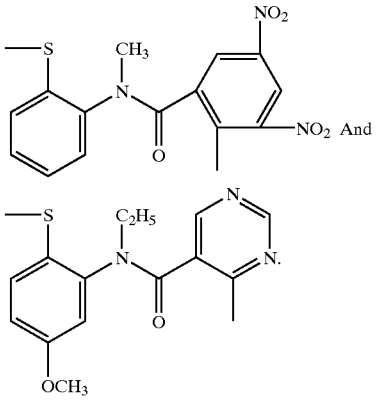

These timing groups are described more fully in U.S. Pat. No. 5,262,291, incorporated herein by reference.

T-2

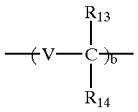

wherein

V represents an oxygen atom, a sulfur atom, or an

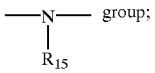

$R_{13}$ and $R_{14}$ each represents a hydrogen atom or a substituent group;

$R_{15}$ represents a substituent group; and b represents 1 or 2.

Typical examples of $R_{13}$ and $R_{14}$, when they represent substituent groups, and $R_{15}$ include

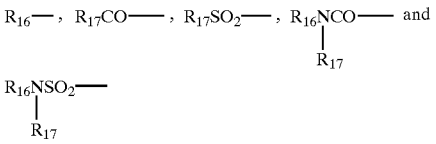

where, $R_{16}$ represents an aliphatic or aromatic hydrocarbon residue, or a heterocyclic group; and $R_{17}$ represents a hydrogen atom, an aliphatic or aromatic hydrocarbon residue, or a heterocyclic group, $R_{13}$, $R_{14}$ and $R_{15}$ each may represent a divalent group, and any two of them combine with each other to complete a ring structure. Specific examples of the group represented by formula (T-2) are illustrated below.

T-3

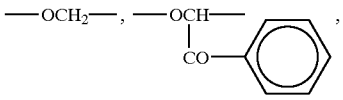

-continued

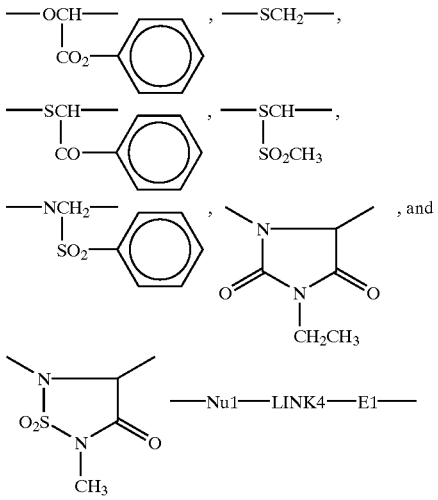

wherein Nu 1 represents a nucleophilic group, and an oxygen or sulfur atom can be given as an example of nucleophilic species; E1 represents an electrophilic group being a group which is subjected to nucleophilic attack by Nu 1; and LINK 4 represents a linking group which enables Nu 1 and E1 to have a steric arrangement such that an intramolecular nucleophilic substitution reaction can occur. Specific examples of the group represented by formula (T-3) are illustrated below.

T-4

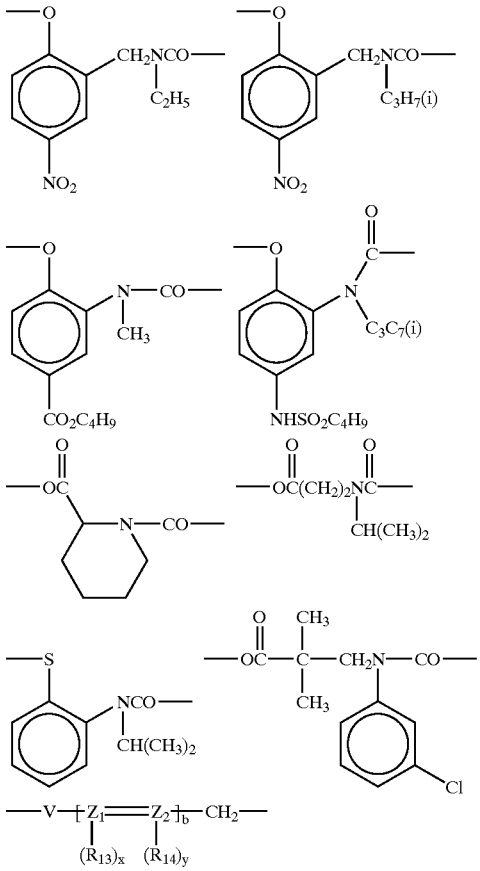

wherein V, $R_{13}$, $R_{14}$ and b all have the same meaning as in formula (T-2), respectively. In addition, $R_{13}$ and $R_{14}$ may be joined together to form a benzene ring or a heterocyclic ring, or V may be joined with $R_{13}$ or $R_{14}$ to form a benzene or heterocyclic ring $Z_1$ and $Z_2$ each independently represents a carbon atom or a nitrogen atom, and x and y each represents 0 or 1.

Specific examples of the timing group (T-4) are illustrated below.

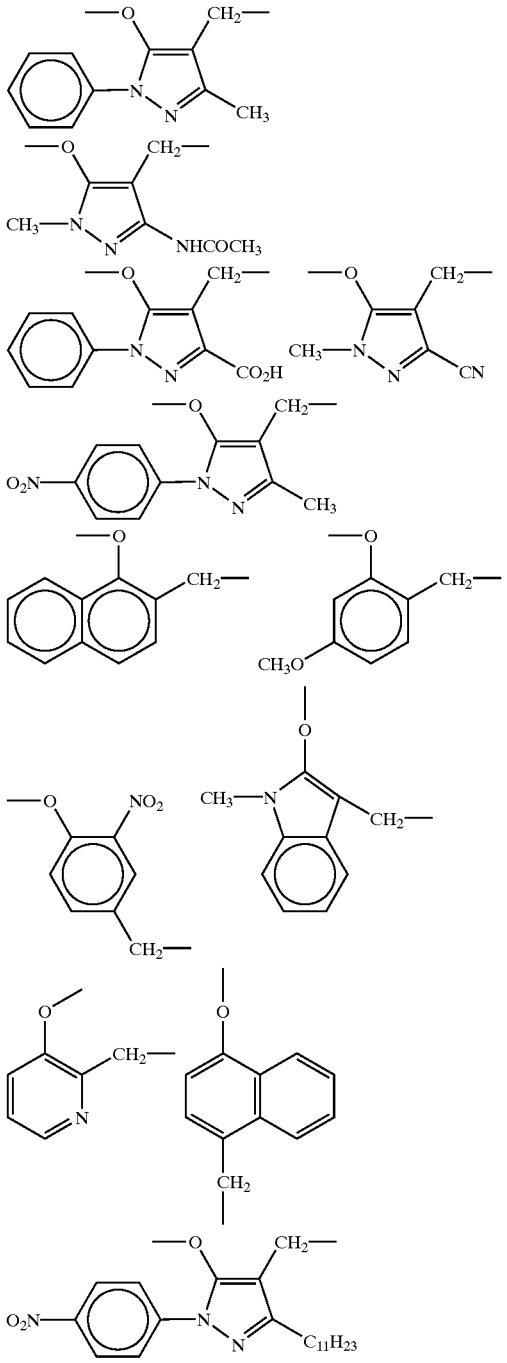

In a preferred embodiment of the invention, the color photothermographic element of the present invention comprises a blocked developer having a half life of less than or equal to 20 minutes and a peak discrimination, at a temperature of at least 60° C., of at least 2.0, which blocked developer is represented by the following Structure III:

III

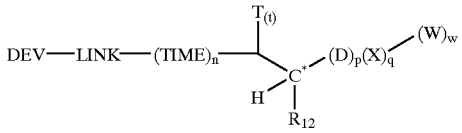

wherein:

DEV is a developing agent;

LINK is a linking group;

TIME is a timing group;

n is 0, 1, or 2;

t is 0, 1, or 2, and when t is not 2, the necessary number of hydrogens (2-t) are present in the structure;

C* is tetrahedral ($sp^3$ hybridized) carbon;

p is 0 or 1;

q is 0 or 1;

w is 0 or 1;

p+q=1 and when p is 1, q and w are both 0; when q is 1, then w is 1;

$R_{12}$ is hydrogen, or a substituted or unsubstituted alkyl, cycloalkyl, aryl or heterocyclic group or $R_{12}$ can combine with W to form a ring;

T is independently selected from a substituted or unsubstituted (referring to the following T groups) alkyl group, cycloalkyl group, aryl, or heterocyclic group, an inorganic monovalent electron withdrawing group, or an inorganic divalent electron withdrawing group capped with at least one C1 to C10 organic group (either an $R_{13}$ or an $R_{13}$ and $R_{14}$ group), preferably capped with a substituted or unsubstituted alkyl or aryl group; or T is joined with W or $R_{12}$ to form a ring; or two T groups can combine to form a ring;

T is an activating group when T is an (organic or inorganic) electron withdrawing group, an aryl group substituted with one to seven electron withdrawing groups, or a substituted or unsubstituted heteroaromatic group. Preferably, T is an inorganic group such as halogen, —$NO_2$, —CN; a halogenated alkyl group, for example —$CF_3$, or an inorganic electron withdrawing group capped by $R_{13}$ or by $R_{13}$ and $R_{14}$, for example, —$SO_2R_{13}$, —$OSO_2R_{13}$, —$NR_{14}(SO_2R_{13})$, —$CO_2R_{13}$, —$COR_{13}$, —$NR_{14}(COR_{13})$, etc. A particularly preferred T group is an aryl group substituted with one to seven electron withdrawing groups.

D is a first activating group selected from substituted or unsubstituted (referring to the following D groups) heteroaromatic group or aryl group or monovalent electron withdrawing group, wherein the heteroaromatic can optionally form a ring with T or $R_{12}$;

X is a second activating group and is a divalent electron withdrawing group. The X groups comprise an oxidized carbon, sulfur, or phosphorous atom that is connected to at least one W group. Preferably, the X group does not contain any tetrahedral carbon atoms except for any side groups attached to a nitrogen, oxygen, sulfur or phosphorous atom. The X groups include, for example, —CO—, —$SO_2$—, —$SO_2O$—, —COO—, —$SO_2N(R_{15})$—, —$CON(R_{15})$—, —$OPO(OR_{15})$—, —$PO(OR_{15})N(R_{16})$—, and the like, in which the atoms in the backbone of the X group (in a direct line between the C* and W) are not attached to any hydrogen atoms.

W is W' or a group represented by the following Structure IIIA:

IIIA

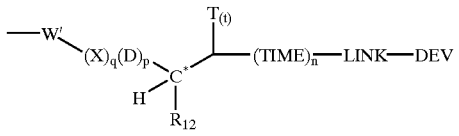

W' is independently selected from a substituted or unsubstituted (referring to the following W' groups) alkyl (preferably containing 1 to 6 carbon atoms), cycloalkyl (including bicycloalkyls, but preferably containing 4 to 6 carbon atoms), aryl (such as phenyl or naphthyl) or heterocyclic group; and wherein W' in combination with T or $R_{12}$ can form a ring (in the case of Structure IIIA, W' comprises a least one substituent, namely the moiety to the right of the W' group in Structure IIIA, which substituent is by definition activating, comprising either X or D);

W is an activating group when W has structure IIIA or when W' is an alkyl or cycloalkyl group substituted with one or more electron withdrawing groups; an aryl group substituted with one to seven electron withdrawing groups, a substituted or unsubstituted heteroaromatic group; or a non-aromatic heterocyclic when substituted with one or more electron withdrawing groups. More preferably, when W is substituted with an electron withdrawing group, the substituent is an inorganic group such as halogen, —$NO_2$, or —CN; or a halogenated alkyl group, e.g., —$CF_3$, or an inorganic group capped by $R_{13}$ (or by $R_{13}$ and $R_{14}$), for example —$SO_2R_{13}$, —$OSO_2R_{13}$, —$NR_{13}(SO_2R_{14})$, —$CO_2R_{13}$, —$COR_{13}$, —$NR_{13}(COR_{14})$, etc.

$R_{13}$, $R_{14}$, $R_{15}$, and $R_{16}$ can independently be selected from substituted or unsubstituted alkyl, aryl, or heterocyclic group, preferably having 1 to 6 carbon atoms, more preferably a phenyl or C1 to C6 alkyl group. Any two members (which are not directly linked) of the following set: $R_{12}$, T, and either D or W, may be joined to form a ring, provided that creation of the ring will not interfere with the functioning of the blocking group.

In one embodiment of the invention, the blocked developer is selected from Structure III with the proviso that when t is 0, then D is not —N or substituted or unsubstituted aryl and X is not —$SO_2$— when W is substituted or unsubstituted aryl or alkyl; and when t is not an activating group, then X is not —$SO_2$— when W is a substituted or unsubstituted aryl.

As indicated above, the specified half-life can be obtained by the use of activating groups in certain positions in the blocking moiety of the blocked developer of Structure III. More specifically, it has been found that the specified half-life can be obtained by the use of activating groups in the D or X position. Further activation to achieve the specified half-life may be obtained by the use of activating groups in one or more of the T and/or W positions in Structure III. As indicated above, the activating groups is herein meant electron withdrawing groups, heteroaromatic groups, or aryl groups substituted with one or more electron withdrawing groups. In one embodiment of the invention, the specified half life is obtained by the presence of activating groups, in addition to D or X, in at least one of the T or W groups.

By the term inorganic is herein meant a group not containing carbon excepting carbonates, cyanides, and cyanates. The term heterocyclic herein includes aromatic and non-aromatic rings containing at least one (preferably 1 to 3) heteroatoms in the ring. If the named groups for a symbol such as T in Structure III apparently overlap, the narrower named group is excluded from the broader named group solely to avoid any such apparent overlap. Thus, for example, heteroaromatic groups in the definition of T may be electron withdrawing in nature, but are not included under monovalent or divalent electron withdrawing groups as they are defined herein.

In has further been found that the necessary half-life can be obtained by the use of activating groups in the D or X position, with further activation as necessary to achieve the necessary half-life by the use of electron withdrawing or heteroaromatic groups in the T and/or W positions in Structure III. By the term activating groups is meant electron withdrawing groups, heteroaromatic groups, or aryl groups substituted with one or more electron withdrawing groups. Preferably, in addition to D or X, at least one of T or W is an activating group.

When referring to electron withdrawing groups, this can be indicated or estimated by the Hammett substituent constants ($\sigma_p$, $\sigma_m$), as described by L. P. Hammett in Physical Organic Chemistry (McGraw-Hill Book Co., NY, 1940), or by the Taft polar substituent constants ($\sigma_I$) as defined by R. W. Taft in Steric Effects in Organic Chemistry (Wiley and Sons, NY, 1956), and in other standard organic textbooks. The $\sigma_p$ and $\sigma_m$ parameters, which were used first to characterize the ability of benzene ring-substituents (in the para or meta position) to affect the electronic nature of a reaction site, were originally quantified by their effect on the pKa of benzoic acid. Subsequent work has extended and refined the original concept and data, and for the purposes of prediction and correlation, standard sets of $\sigma_p$ and $\sigma_m$ are widely available in the chemical literature, as for example in C. Hansch et al., J. Med. Chem., 17, 1207 (1973). For substituents attached to a tetrahedral carbon instead of aryl groups, the inductive substituent constant $\sigma_I$ is herein used to characterize the electronic property. Preferably, an electron withdrawing group on an aryl ring has a $\sigma_p$ or $\sigma_m$ of greater than zero, more preferably greater than 0.05, most preferably greater than 0.1. The $\sigma_p$ is used to define electron withdrawing groups on aryl groups when the substituent is neither para nor meta. Similarly, an electron withdrawing group on a tetrahedral carbon preferably has a $\sigma_I$ of greater than zero, more preferably greater than 0.05, and most preferably greater than 0.1. In the event of a divalent group such as —$SO_2$—, the $\sigma_I$ used is for the methyl substituted analogue such as —$SO_2CH_3$ ($\sigma_I$=0.59). When more than one electron withdrawing group is present, then the summation of the substituent constants is used to estimate or characterize the total effect of the substituents.

Illustrative developing agents that are useful as developers are:

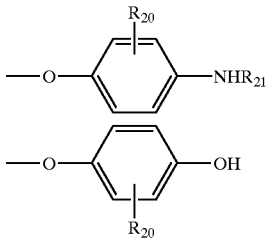

-continued

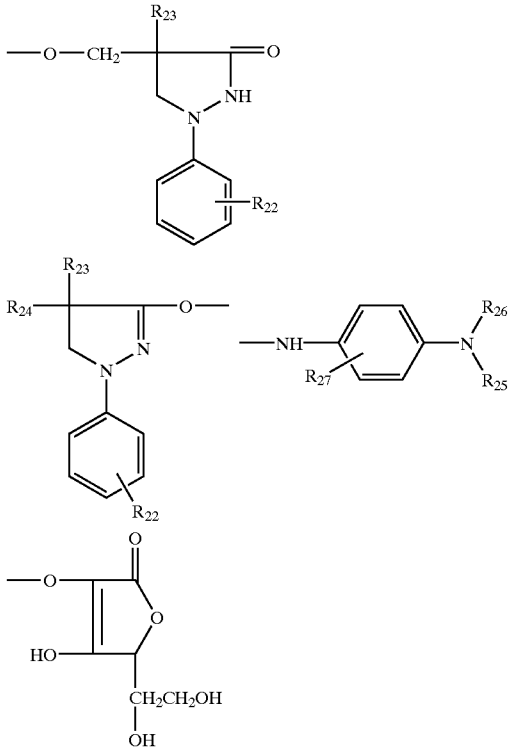

wherein $R_{20}$ is hydrogen, halogen, alkyl or alkoxy;

$R_{21}$ is a hydrogen or alkyl;

$R_{22}$ is hydrogen, alkyl, alkoxy or alkenedioxy; and $R_{23}$, $R_{24}$, $R_{25}$ $R_{26}$ and $R_{27}$ are hydrogen alkyl, hydroxyalkyl or sulfoalkyl.

More preferably, the blocked developers used in the present invention is within Structure I above, but represented by the following narrower Structure IIIB:

Structure IIIB

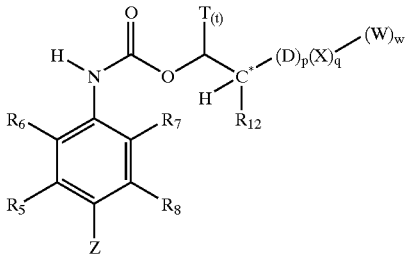

wherein:

Z is OH or $NR_2R_3$, where $R_2$ and $R_3$ are independently hydrogen or a substituted or unsubstituted alkyl group or $R_2$ and $R_3$ are connected to form a ring;

$R_5$, $R_6$, $R_7$, and $R_8$ are independently hydrogen, halogen, hydroxy, amino, alkoxy, carbonamido, sulfonamido, alkylsulfonamido or alkyl, or $R_5$ can connect with $R_3$ or $R_6$ and/or $R_8$ can connect to $R_2$ or $R_7$ to form a ring;

W is either W' or a group represented by the following Structure IIIC:

Structure IIIC

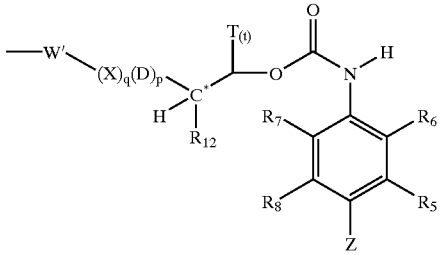

wherein T, t, C*, $R_{12}$, D, p, X, q, W' and w are as defined above, including, but not limited to, the preferred groups.

Again, the present invention includes photothermographic elements comprising blocked developers according to Structure III or IIIC which blocked developers have a half-life ($t_{1/2}$)≦20 min (as determined below).

When referring to heteroaromatic groups or substituents, the heteroaromatic group is preferably a 5- or 6-membered ring containing one or more hetero atoms, such as N, O, S or Se. Preferably, the heteroaromatic group comprises a substituted or unsubstituted benzimidazolyl, benzothiazolyl, benzoxazolyl, benzothienyl, benzofuryl, furyl, imidazolyl, indazolyl, indolyl, isoquinolyl, isothiazolyl, isoxazolyl, oxazolyl, picolinyl, purinyl, pyranyl, pyrazinyl, pyrazolyl, pyridyl, pyrimidinyl, pyrrolyl, quinaldinyl, quinazolinyl, quinolyl, quinoxalinyl, tetrazolyl, thiadiazolyl, thiatriazolyl, thiazolyl, thienyl, and triazolyl group. Particularly preferred are: 2-imidazolyl, 2-benzimidazolyl, 2-thiazolyl, 2-benzothiazolyl, 2-oxazolyl, 2-benzoxazolyl, 2-pyridyl, 2-quinolinyl, 1-isoquinolinyl, 2-pyrrolyl, 2-indolyl, 2-thiophenyl, 2-benzothiophenyl, 2-furyl, 2-benzofuryl, 2-,4-, or 5-pyrimidinyl, 2-pyrazinyl, 3-,4-, or 5-pyrazolyl, 3-indazolyl, 2- and 3-thienyl, 2-(1,3,4-triazolyl), 4-or 5-(1,2,3-triazolyl), 5-(1,2,3,4-tetrazolyl). The heterocyclic group may be further substituted. Preferred substituents are alkyl and alkoxy groups containing 1 to 6 carbon atoms.

When reference in this application is made to a particular moiety or group, "substituted or unsubstituted" means that the moiety may be unsubstituted or substituted with one or more substituents (up to the maximum possible number), for example, substituted or unsubstituted alkyl, substituted or unsubstituted benzene (with up to five substituents), substituted or unsubstituted heteroaromatic (with up to five substituents), and substituted or unsubstituted heterocyclic (with up to five substituents). Generally, unless otherwise specifically stated, substituent groups usable on molecules herein include any groups, whether substituted or unsubstituted, which do not destroy properties necessary for the photographic utility. Examples of substituents on any of the mentioned groups can include known substituents, such as: halogen, for example, chloro, fluoro, bromo, iodo; alkoxy, particularly those "lower alkyl" (that is, with 1 to 6 carbon atoms), for example, methoxy, ethoxy; substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); acid or acid salt groups such as any of those described below; and others known in the art. Alkyl substituents may specifically include "lower alkyl" (that is, having 1–6 carbon atoms), for example, methyl, ethyl, and the like. Cycloalkyl when appropriate includes bicycloalkyl. Further, with regard to any alkyl group or alkylene group, it will be understood that these can be branched, unbranched, or cyclic.

The following are representative examples of photographically useful blocked developers for use in the invention:

D-1

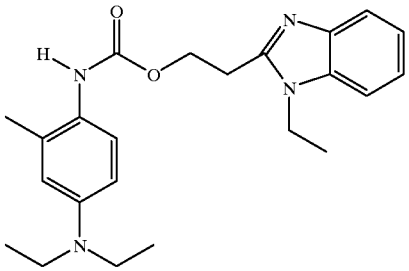

D-2

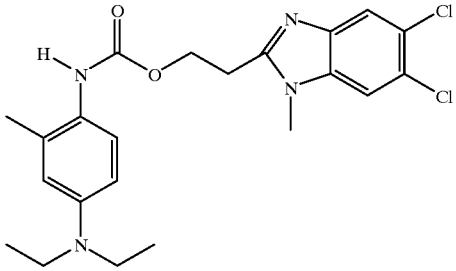

D-3

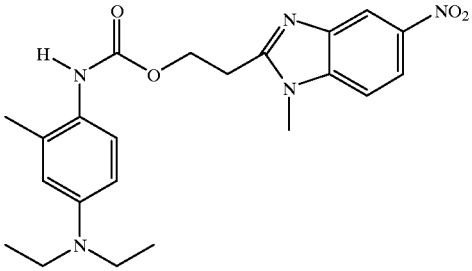

D-4

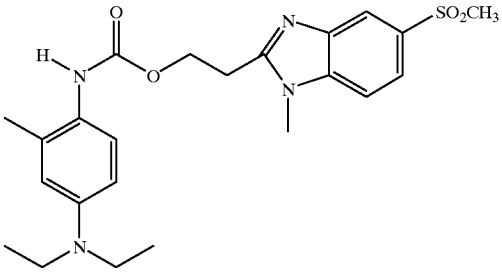

-continued

D-5

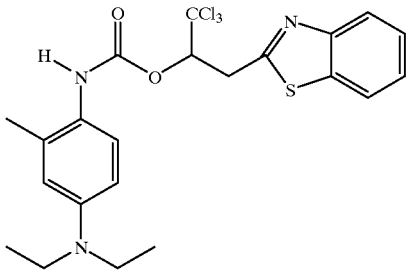

D-6

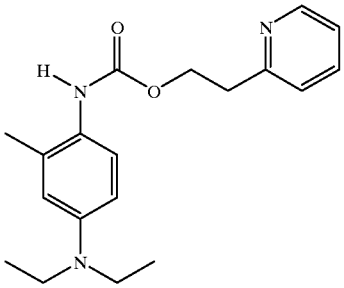

D-7

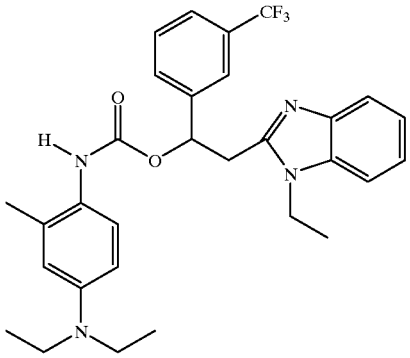

D-8

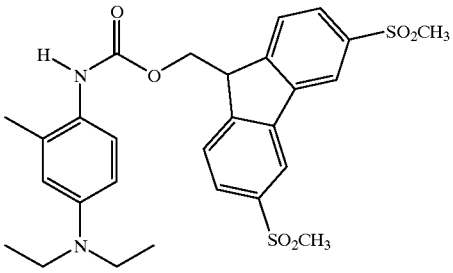

D-9

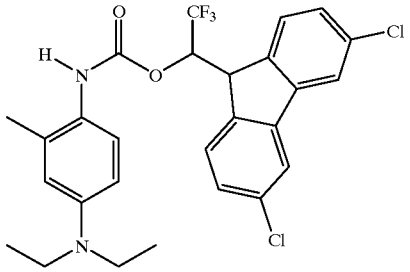

-continued
D-10
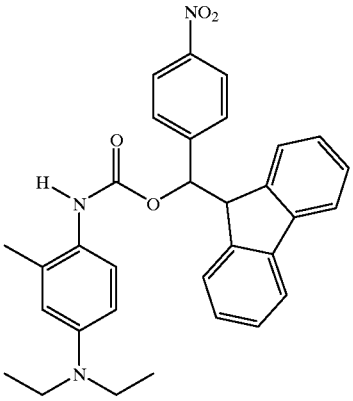
D-11
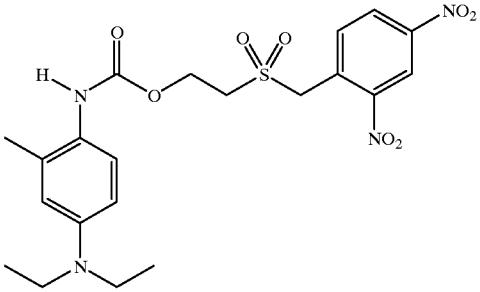
D-12
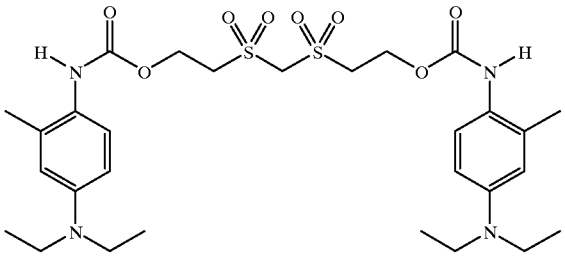
D-13
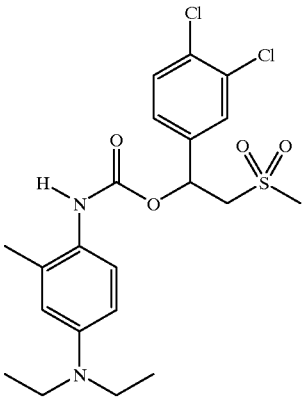
-continued
D-14
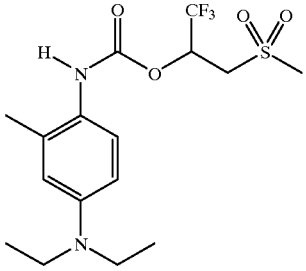
D-15
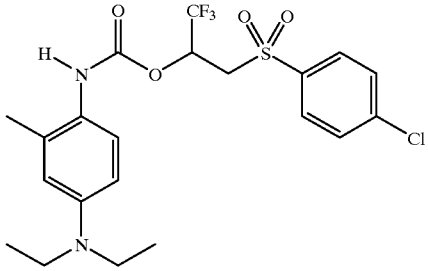
D-16
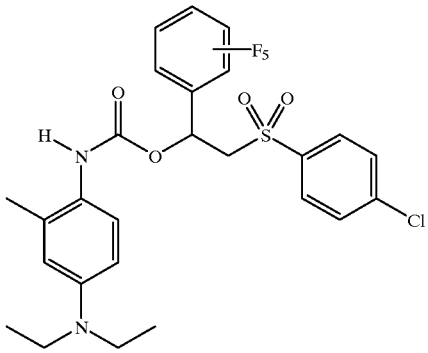
D-17
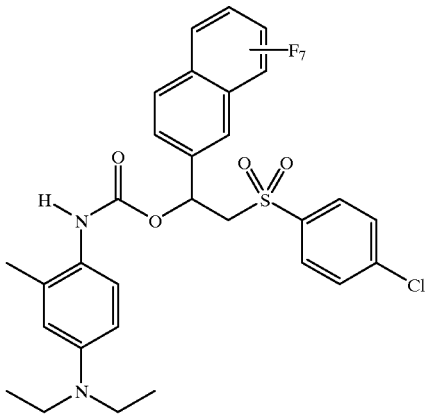

-continued
D-18
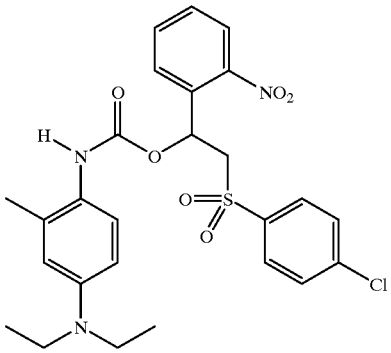
D-19
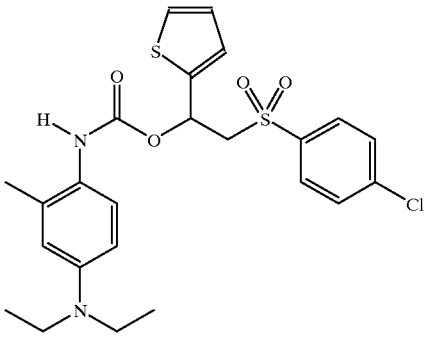
D-20
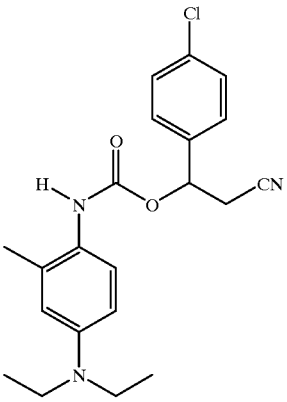
D-21
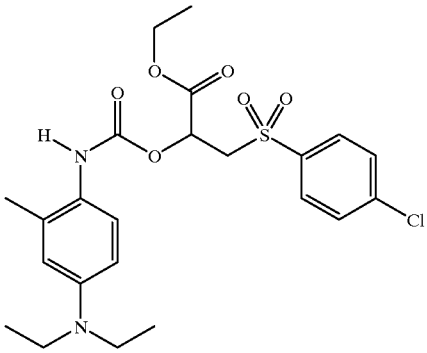
-continued
D-22
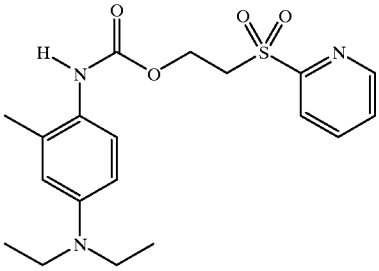
D-23
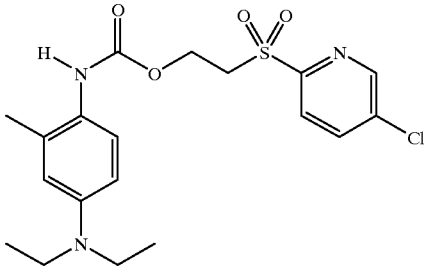
D-24
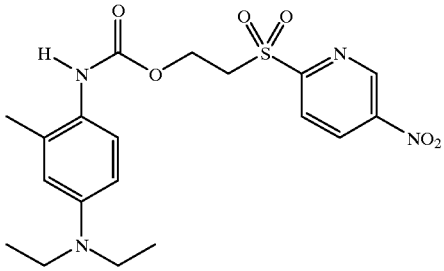
D-25
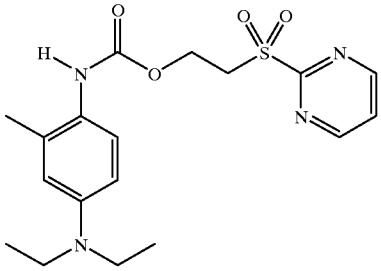
D-26
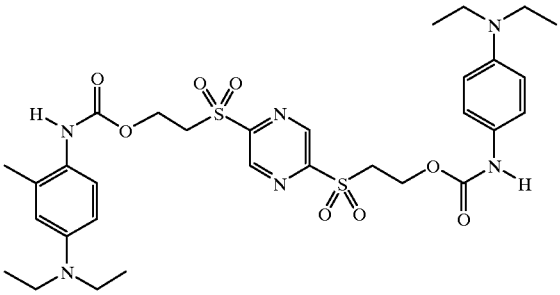

-continued
D-27
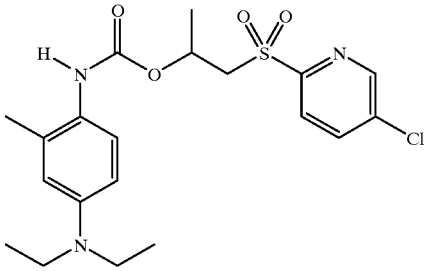
D-28
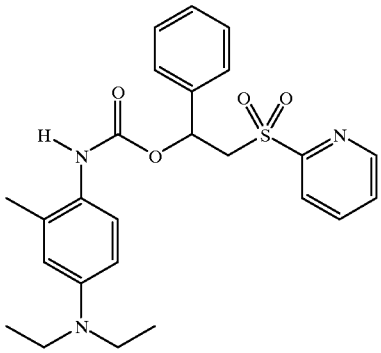
D-29
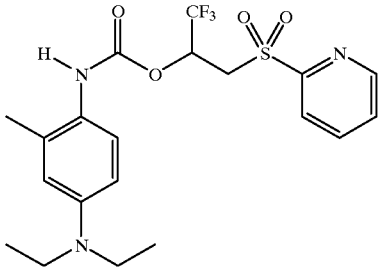
D-30
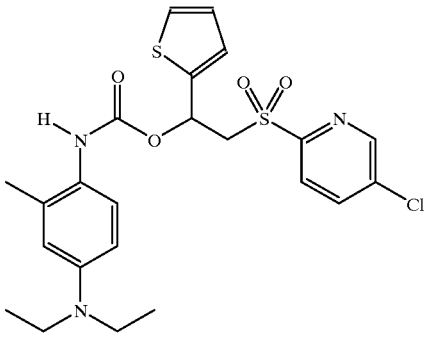
-continued
D-31
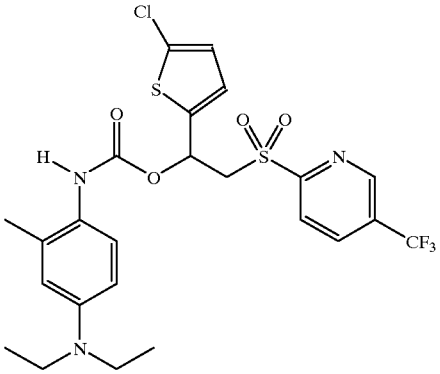
D-32
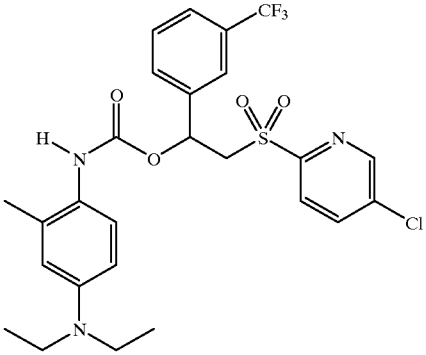
D-33
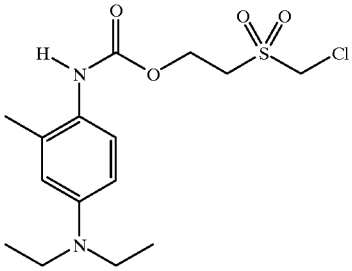
D-34
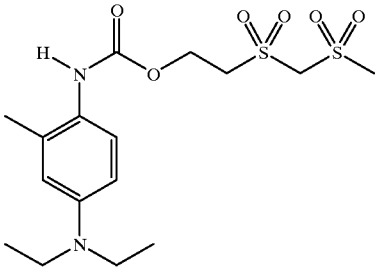
D-35
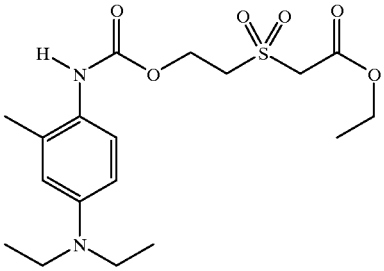

-continued
D-36
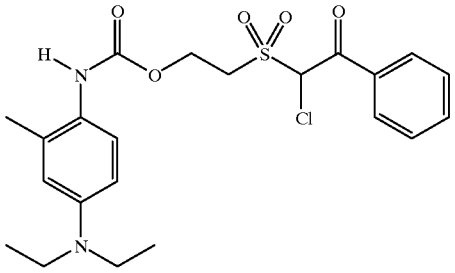
D-37
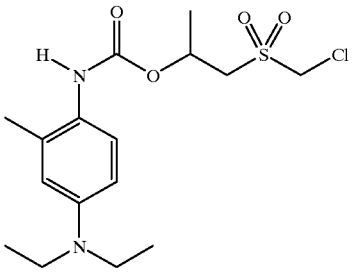
D-38
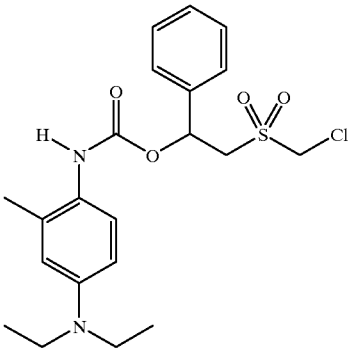
D-39
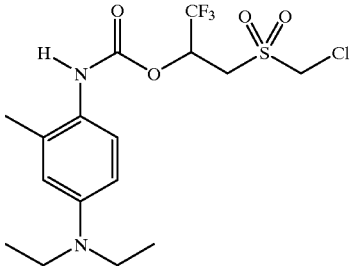
D-40
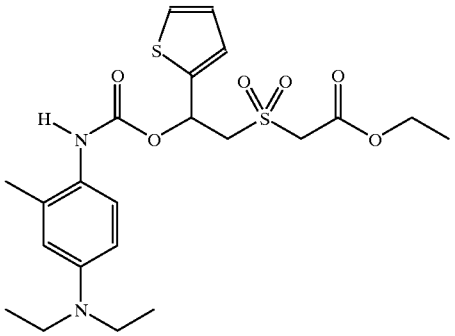
-continued
D-41
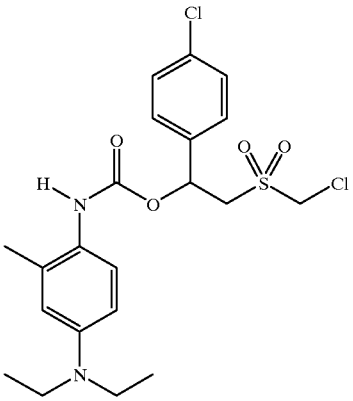
D-42
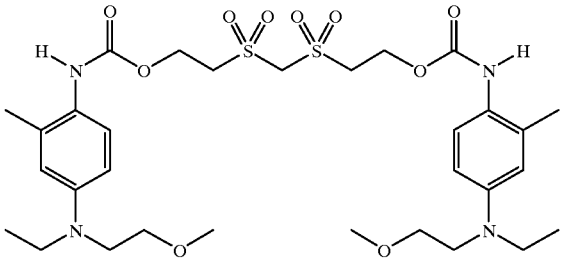
D-43
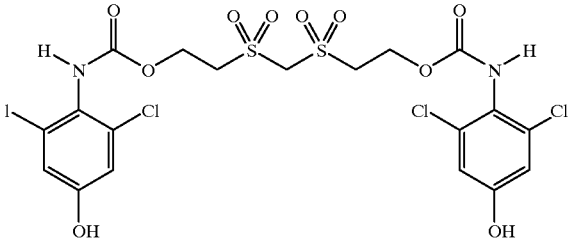
D-44
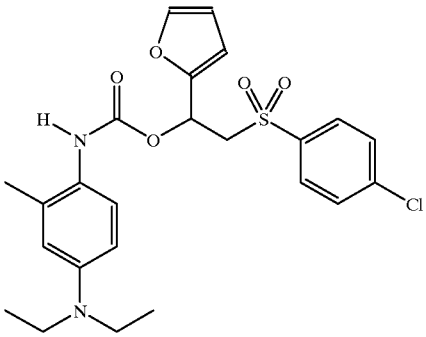
D-45
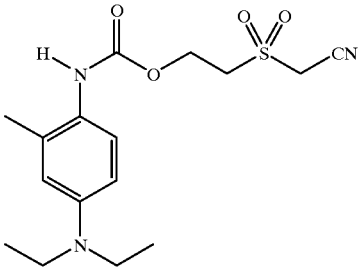

-continued

D-46

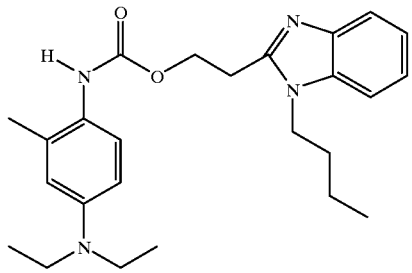

The blocked developer is preferably incorporated in one or more of the imaging layers of the imaging element. The amount of blocked developer used is preferably 0.01 to 5 $g/m^2$, more preferably 0.1 to 2 $g/m^2$ and most preferably 0.3 to 2 $g/m^2$ in each layer to which it is added. These may be color forming or non-color forming layers of the element. The blocked developer can be contained in a separate element that is contacted to the photographic element during processing.

After image-wise exposure of the imaging element, the blocked developer is activated during processing of the imaging element by the presence of acid or base in the processing solution, by heating the imaging element during processing of the imaging element, and/or by placing the imaging element in contact with a separate element, such as a laminate sheet, during processing. The laminate sheet optionally contains additional processing chemicals such as those disclosed in Sections XIX and XX of *Research Disclosure,* September 1996, Number 389, Item 38957 (hereafter referred to as ("*Research Disclosure I*"). All sections referred to herein are sections of *Research Disclosure I,* unless otherwise indicated. Such chemicals include, for example, sulfites, hydroxyl amine, hydroxamic acids and the like, antifoggants, such as alkali metal halides, nitrogen containing heterocyclic compounds, and the like, sequestering agents such as an organic acids, and other additives such as buffering agents, sulfonated polystyrene, stain reducing agents, biocides, desilvering agents, stabilizers and the like.

A reducing agent in addition to the blocked developer may be included in the photothermographic element. The reducing agent for the organic silver salt may be any material, preferably organic material, that can reduce silver ion to metallic silver. Conventional photographic developers such as 3-pyrazolidinones, hydroquinones, p-aminophenols, p-phenylenediamines and catechol are useful, but hindered phenol reducing agents are preferred. The reducing agent is preferably present in a concentration ranging from 5 to 25 percent of the photothermographic layer.

A wide range of reducing agents has been disclosed in dry silver systems including amidoximes such as phenylamidoxime, 2-thienylamidoxime and p-phenoxyphenylamidoxime, azines (e.g., 4-hydroxy-3,5-dimethoxybenzaldehydeazine); a combination of aliphatic carboxylic acid aryl hydrazides and ascorbic acid, such as 2,2'-bis(hydroxymethyl)propionylbetaphenyl hydrazide in combination with ascorbic acid; an combination of polyhydroxybenzene and hydroxylamine, a reductone and/or a hydrazine, e.g., a combination of hydroquinone and bis (ethoxyethyl)hydroxylamine, piperidinohexose reductone or formyl-4-methylphenylhydrazine, hydroxamic acids such as phenylhydroxamic acid, p-hydroxyphenyl-hydroxamic acid, and o-alaninehydroxamic acid; a combination of azines and sulfonamidophenols, e.g., phenothiazine and 2,6-dichloro-4-benzenesulfonamidophenol; α-cyano-phenylacetic acid derivatives such as ethyl α-cyano-2-methylphenylacetate, ethyl α-cyano-phenylacetate; bis-β-naphthols as illustrated by 2,2'-dihydroxyl-1-binaphthyl, 6,6'-dibromo-2,2'-dihydroxy-1,1'-binaphthyl, and bis(2-hydroxy-1-naphthyl) methane; a combination of bis-o-naphthol and a 1,3-dihydroxybenzene derivative, (e. g., 2,4-dihydroxybenzophenone or 2,4-dihydroxyacetophenone); 5-pyrazolones such as 3-methyl-1-phenyl-5-pyrazolone; reductones as illustrated by dimethylaminohexose reductone, anhydrodihydroaminohexose reductone, and anhydrodihydro-piperidone-hexose reductone; sulfamidophenol reducing agents such as 2,6-dichloro-4-benzenesulfon-amido-phenol, and p-benzenesulfonamidophenol; 2-phenylindane-1,3-dione and the like; chromans such as 2,2-dimethyl-7-t-butyl-6-hydroxychroman; 1,4-dihydropyridines such as 2,6-dimethoxy-3,5-dicarbethoxy-1,4-dihydropyridene; bisphenols, e.g., bis(2-hydroxy-3-t-butyl-5-methylphenyl)-methane; 2,2-bis(4-hydroxy-3-methylphenyl)propane; 4,4-ethylidene-bis(2-t-butyl-6-methylphenol); and 2,2-bis(3,5-dimethyl-4-hydroxyphenyl) propane; ascorbic acid derivatives, e.g., 1-ascorbyl-palmitate, ascorbylstearate and unsaturated aldehydes and ketones, such as benzyl and diacetyl; pyrazolidin-3-ones; and certain indane-1,3-diones.

An optimum concentration of organic reducing agent in the photothermographic element varies depending upon such factors as the particular photothermographic element, desired image, processing conditions, the particular organic silver salt and the particular oxidizing agent.

The photothermographic element can comprise a thermal solvent. Examples of useful thermal solvents. Examples of thermal solvents, for example, salicylanilide, phthalimide, N-hydroxyphthalimide, N-potassium-phthalimide, succinimide, N-hydroxy-1,8-naphthalimide, phthalazine, 1-(2H)-phthalazinone, 2-acetylphthalazinone, benzanilide, and benzenesulfonamide. Prior-art thermal solvents are disclosed, for example, in U.S. Pat. No. 6,013,420 to Windender. Examples of toning agents and toning agent combinations are described in, for example, *Research Disclosure,* June 1978, Item No. 17029 and U.S. Pat. No. 4,123,282.

Post-processing image stabilizers and latent image keeping stabilizers are useful in the photothermographic element. Any of the stabilizers known in the photothermographic art are useful for the described photothermographic element. Illustrative examples of useful stabilizers include photolytically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

The photothermographic elements preferably contain various colloids and polymers alone or in combination as vehicles and binders and in various layers. Useful materials are hydrophilic or hydrophobic. They are transparent or translucent and include both naturally occurring substances, such as gelatin, gelatin derivatives, cellulose derivatives, polysaccharides, such as dextran, gum arabic and the like; and synthetic polymeric substances, such as water-soluble polyvinyl compounds like poly(vinylpyrrolidone) and acrylamide polymers. Other synthetic polymeric compounds that are useful include dispersed vinyl compounds such as in latex form and particularly those that increase dimensional stability of photographic elements. Effective polymers include water insoluble polymers of acrylates, such as alkylacrylates and methacrylates, acrylic acid, sulfoacrylates, and those that have cross-linking sites. Preferred high molecular weight materials and resins include poly(vinyl butyral), cellulose acetate butyrate, poly (methylmethacrylate), poly(vinylpyrrolidone), ethyl cellulose, polystyrene, poly(vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates. When coatings are made using organic solvents, organic soluble resins may be coated by direct mixture into the coating formulations. When coating from aqueous solution, any useful organic soluble materials may be incorporated as a latex or other fine particle dispersion.

Photothermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in *Research Disclosure,* December 1978, Item No. 17643 and *Research Disclosure,* June 1978, Item No. 17029.

The layers of the photothermographic element are coated on a support by coating procedures known in the photographic art, including dip coating, air knife coating, curtain coating or extrusion coating using hoppers. If desired, two or more layers are coated simultaneously.

A photothermographic element as described preferably comprises a thermal stabilizer to help stabilize the photothermographic element prior to exposure and processing. Such a thermal stabilizer provides improved stability of the photothermographic element during storage. Preferred thermal stabilizers are 2-bromo-2-arylsulfonylacetamides, such as 2-bromo-2-p-tolysulfonylacetamide; 2-(tribromomethyl sulfonyl)benzothiazole; and 6-substituted-2,4-bis (tribromomethyl)-s-triazines, such as 6-methyl or 6-phenyl-2,4-bis(tribromomethyl)-s-triazine.

Imagewise exposure is preferably for a time and intensity sufficient to produce a developable latent image in the photothermographic element.

After imagewise exposure of the photothermographic element, the resulting latent image can be developed in a variety of ways. The simplest is by overall heating the element to thermal processing temperature. This overall heating merely involves heating the photothermographic element to a temperature within the range of about 90° C. to about 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 160° C. Heating means known in the photothermographic arts are useful for providing the desired processing temperature for the exposed photothermographic element. The heating means is, for example, a simple hot plate, iron, roller, heated drum, microwave heating means, heated air, vapor or the like.

It is contemplated that the design of the processor for the photothermographic element be linked to the design of the cassette or cartridge used for storage and use of the element. Further, data stored on the film or cartridge may be used to modify processing conditions or scanning of the element. Methods for accomplishing these steps in the imaging system are disclosed in commonly assigned, co-pending U.S. patent applications Ser. Nos. 09/206,586, 09/206,612, and 09/206,583 filed Dec. 7, 1998, which are incorporated herein by reference. The use of an apparatus whereby the processor can be used to write information onto the element, information which can be used to adjust processing, scanning, and image display is also envisaged. This system is disclosed in U.S. patent applications Ser. No. 09/206,914 filed Dec. 7, 1998 and Ser. No. 09/333,092 filed Jun. 15, 1999, which are incorporated herein by reference.

Thermal processing is preferably carried out under ambient conditions of pressure and humidity. Conditions outside of normal atmospheric pressure and humidity are useful.

The components of the photothermographic element can be in any location in the element that provides the desired image. If desired, one or more of the components can be in one or more layers of the element. For example, in some cases, it is desirable to include certain percentages of the reducing agent, toner, stabilizer and/or other addenda in the overcoat layer over the photothermographic image recording layer of the element. This, in some cases, reduces migration of certain addenda in the layers of the element.

Once yellow, magenta, and cyan dye image records have been formed in the processed photographic elements of the invention, conventional techniques can be employed for retrieving the image information for each color record and manipulating the record for subsequent creation of a color balanced viewable image. For example, it is possible to scan the photographic element successively within the blue, green, and red regions of the spectrum or to incorporate blue, green, and red light within a single scanning beam that is divided and passed through blue, green, and red filters to form separate scanning beams for each color record. A simple technique is to scan the photographic element point-by-point along a series of laterally offset parallel scan paths. The intensity of light passing through the element at a scanning point is noted by a sensor which converts radiation received into an electrical signal. Most generally this electronic signal is further manipulated to form a useful electronic record of the image. For example, the electrical signal can be passed through an analog-to-digital converter and sent to a digital computer together with location information required for pixel (point) location within the image. In another embodiment, this electronic signal is encoded with colorimetric or tonal information to form an electronic record that is suitable to allow reconstruction of the image into viewable forms such as computer monitor displayed images, television images, printed images, and so forth.

It is contemplated that imaging elements of this invention will be scanned prior to the removal of silver halide from the element. The remaining silver halide yields a turbid coating, and it is found that improved scanned image quality for such a system can be obtained by the use of scanners that employ diffuse illumination optics. Any technique known in the art for producing diffuse illumination can be used. Preferred systems include reflective systems, that employ a diffusing cavity whose interior walls are specifically designed to produce a high degree of diffuse reflection, and transmissive systems, where diffusion of a beam of specular light is accomplished by the use of an optical element placed in the beam that serves to scatter light. Such elements can be either glass or plastic that either incorporate a component that produces the desired scattering, or have been given a surface treatment to promote the desired scattering.

One of the challenges encountered in producing images from information extracted by scanning is that the number of pixels of information available for viewing is only a fraction of that available from a comparable classical photographic print. It is, therefore, even more important in scan imaging to maximize the quality of the image information available. Enhancing image sharpness and minimizing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily.

The number of pixels collected in this manner can be varied as dictated by the desired image quality. Very low resolution images can have pixel counts of 192×128 pixels per film frame, low resolution 384×256 pixels per frame, medium resolution 768×512 pixels per frame, high resolution 1536×1024 pixels per frame and very high resolution 3072×2048 pixels per frame or even 6144×4096 pixels per frame or even more. Higher pixel counts or higher resolution translates into higher quality images because it enables higher sharpness and the ability to distinguish finer details especially at higher magnifications at viewing. These pixel counts relate to image frames having an aspect ratio of 1.5 to 1. Other pixel counts and frame aspect ratios can be employed as known in the art. Most generally, a difference of four times between the number of pixels rendered per frame can lead to a noticeable difference in picture quality, while differences of sixteen times or sixty four times are even more preferred in situations where a low quality image is to be presented for approval or preview purposes but a higher quality image is desired for final delivery to a customer. On digitization, these scans can have a bit depth of between 6 bits per color per pixel and 16 bits per color per pixel or even more. The bit depth can preferably be between 8 bits and 12 bits per color per pixel. Larger bit depth translates into higher quality images because it enables superior tone and color quality.

The electronic signal can form an electronic record that is suitable to allow reconstruction of the image into viewable forms such as computer monitor displayed images, television images, optically, mechanically or digitally printed images and displays and so forth all as known in the art. The formed image can be stored or transmitted to enable further manipulation or viewing, such as in U.S. Ser. No. 09/592,816 titled AN IMAGE PROCESSING AND MANIPULATION SYSTEM to Richard P. Szajewski, Alan Sowinski and John Buhr.

The elements of the invention can have density calibration patches derived from one or more patch areas on a portion of unexposed photographic recording material that was subjected to reference exposures, as described by Wheeler et al U.S. Pat. No. 5,649,260, Koeng at al U.S. Pat. No. 5,563,717, and by Cosgrove et al U.S. Pat. No. 5,644,647.

Illustrative systems of scan signal manipulation, including techniques for maximizing the quality of image records, are disclosed by Bayer U.S. Pat. No. 4,553,156; Urabe et al U.S. Pat. No. 4,591,923; Sasaki et al U.S. Pat. No. 4,631,578; Alkofer U.S. Pat. No. 4,654,722; Yamada et al U.S. Pat. No. 4,670,793; Klees U.S. Pat. Nos. 4,694,342 and 4,962,542; Powell U.S. Pat. No. 4,805,031; Mayne et al U.S. Pat. No. 4,829,370; Abdulwahab U.S. Pat. No. 4,839,721; Matsunawa et al U.S. Pat. Nos. 4,841,361 and 4,937,662; Mizukoshi et al U.S. Pat. No. 4,891,713; Petilli U.S. Pat. No. 4,912,569; Sullivan et al U.S. Pat. Nos. 4,920,501 and 5,070,413; Kimoto et al U.S. Pat. No. 4,929,979; Hirosawa et al U.S. Pat. No. 4,972,256; Kaplan U.S. Pat. No. 4,977,521; Sakai U.S. Pat. No. 4,979,027; Ng U.S. Pat. No. 5,003,494; Katayama et al U.S. Pat. No. 5,008,950; Kimura et al U.S. Pat. No. 5,065,255; Osamu et al U.S. Pat. No. 5,051,842; Lee et al U.S. Pat. No. 5,012,333; Bowers et al U.S. Pat. No. 5,107,346; Telle U.S. Pat. No. 5,105,266; MacDonald et al U.S. Pat. No. 5,105,469; and Kwon et al U.S. Pat. No. 5,081,692. Techniques for color balance adjustments during scanning are disclosed by Moore et al U.S. Pat. No. 5,049,984 and Davis U.S. Pat. No. 5,541,645.

The digital color records once acquired are in most instances adjusted to produce a pleasingly color balanced image for viewing and to preserve the color fidelity of the image bearing signals through various transformations or renderings for outputting, either on a video monitor or when printed as a conventional color print. Preferred techniques for transforming image bearing signals after scanning are disclosed by Giorgianni et al U.S. Pat. No. 5,267,030, the disclosures of which are herein incorporated by reference. Further illustrations of the capability of those skilled in the art to manage color digital image information are provided by Giorgianni and Madden *Digital Color Management,* Addison-Wesley, 1998.

FIG. 1 shows, in block diagram form, the manner in which the image information provided by the color negative elements of the invention is contemplated to be used. An image scanner 2 is used to scan by transmission an image-wise exposed and photographically processed color negative element 1 according to the invention. The scanning beam is most conveniently a beam of white light that is split after passage through the layer units and passed through filters to create separate image records-red recording layer unit image record (R), green recording layer unit image record (G), and blue recording layer unit image record (B). Instead of splitting the beam, blue, green, and red filters can be sequentially caused to intersect the beam at each pixel location. In still another scanning variation, separate blue, green, and red light beams, as produced by a collection of light emitting diodes, can be directed at each pixel location. As the element 1 is scanned pixel-by-pixel using an array detector, such as an array charge-coupled device (CCD), or line-by-line using a linear array detector, such as a linear array CCD, a sequence of R, G, and B picture element signals are generated that can be correlated with spatial location information provided from the scanner. Signal intensity and location information is fed to a workstation 4, and the information is transformed into an electronic form R', G', and B', which can be stored in any convenient storage device 5.

In motion imaging industries, a common approach is to transfer the color negative film information into a video signal using a telecine transfer device. Two types of telecine transfer devices are most common: (1) a flying spot scanner using photomultiplier tube detectors or (2) CCD's as sensors. These devices transform the scanning beam that has passed through the color negative film at each pixel location into a voltage. The signal processing then inverts the electrical signal in order to render a positive image. The signal is then amplified and modulated and fed into a cathode ray tube monitor to display the image or recorded onto magnetic tape for storage. Although both analog and digital image signal manipulations are contemplated, it is preferred to place the signal in a digital form for manipulation, since the overwhelming majority of computers are now digital and this facilitates use with common computer peripherals, such as magnetic tape, a magnetic disk, or an optical disk.

A video monitor 6, which receives the digital image information modified for its requirements, indicated by R", G", and B", allows viewing of the image information received by the workstation. Instead of relying on a cathode ray tube of a video monitor, a liquid crystal display panel or any other convenient electronic image viewing device can be substituted. The video monitor typically relies upon a picture control apparatus 3, which can include a keyboard and cursor, enabling the workstation operator to provide image manipulation commands for modifying the video image displayed and any image to be recreated from the digital image information.

Any modifications of the image can be viewed as they are being introduced on the video display 6 and stored in the storage device 5. The modified image information R'", G'", and B'" can be sent to an output device 7 to produce a recreated image for viewing. The output device can be any convenient conventional element writer, such as a thermal dye transfer, inkjet, electrostatic, electrophotographic, electrostatic, thermal dye sublimation or other type of printer. CRT or LED printing to sensitized photographic paper is also contemplated. The output device can be used to control the exposure of a conventional silver halide color paper. The output device creates an output medium 8 that bears the recreated image for viewing. It is the image in the output medium that is ultimately viewed and judged by the end user for noise (granularity), sharpness, contrast, and color balance. The image on a video display may also ultimately be viewed and judged by the end user for noise, sharpness, tone scale, color balance, and color reproduction, as in the case of images transmitted between parties on the World Wide Web of the Internet computer network.

Using an arrangement of the type shown in FIG. 1, the images contained in color negative elements in accordance with the invention are converted to digital form, manipulated, and recreated in a viewable form. Color negative recording materials according to the invention can be used with any of the suitable methods described in U.S. Pat. No. 5,257,030. In one preferred embodiment, Giorgianni et al provides for a method and means to convert the R, G, and B image-bearing signals from a transmission scanner to an image manipulation and/or storage metric which corresponds to the trichromatic signals of a reference image-producing device such as a film or paper writer, thermal printer, video display, etc. The metric values correspond to those which would be required to appropriately reproduce the color image on that device. For example, if the reference image producing device was chosen to be a specific video display, and the intermediary image data metric was chosen to be the R', G', and B' intensity modulating signals (code values) for that reference video display, then for an input film, the R, G, and B image-bearing signals from a scanner would be transformed to the R', G', and B' code values corresponding to those which would be required to appropriately reproduce the input image on the reference video display. A data-set is generated from which the mathematical transformations to convert R, G, and B image-bearing signals to the aforementioned code values are derived. Exposure patterns, chosen to adequately sample and cover the useful exposure range of the film being calibrated, are created by exposing a pattern generator and are fed to an exposing apparatus. The exposing apparatus produces trichromatic exposures on film to create test images consisting of approximately 150 color patches. Test images may be created using a variety of methods appropriate for the application. These methods include: using exposing apparatus such as a sensitometer, using the output device of a color imaging apparatus, recording images of test objects of known reflectances illuminated by known light sources, or calculating trichromatic exposure values using methods known in the photographic art. If input films of different speeds are used, the overall red, green, and blue exposures must be properly adjusted for each film in order to compensate for the relative speed differences among the films. Each film thus receives equivalent exposures, appropriate for its red, green, and blue speeds. The exposed film is processed chemically. Film color patches are read by transmission scanner which produces R, G, and B image-bearing signals corresponding each color patch. Signal-value patterns of code value pattern generator produces RGB intensity-modulating signals which are fed to the reference video display. The R', G', and B' code values for each test color are adjusted such that a color matching apparatus, which may correspond to an instrument or a human observer, indicates that the video display test colors match the positive film test colors or the colors of a printed negative. A transform apparatus creates a transform relating the R, G, and B image-bearing signal values for the film's test colors to the R', G', and B' code values of the corresponding test colors.

The mathematical operations required to transform R, G, and B image-bearing signals to the intermediary data may consist of a sequence of matrix operations and look-up tables (LUT's).

Figure 2:
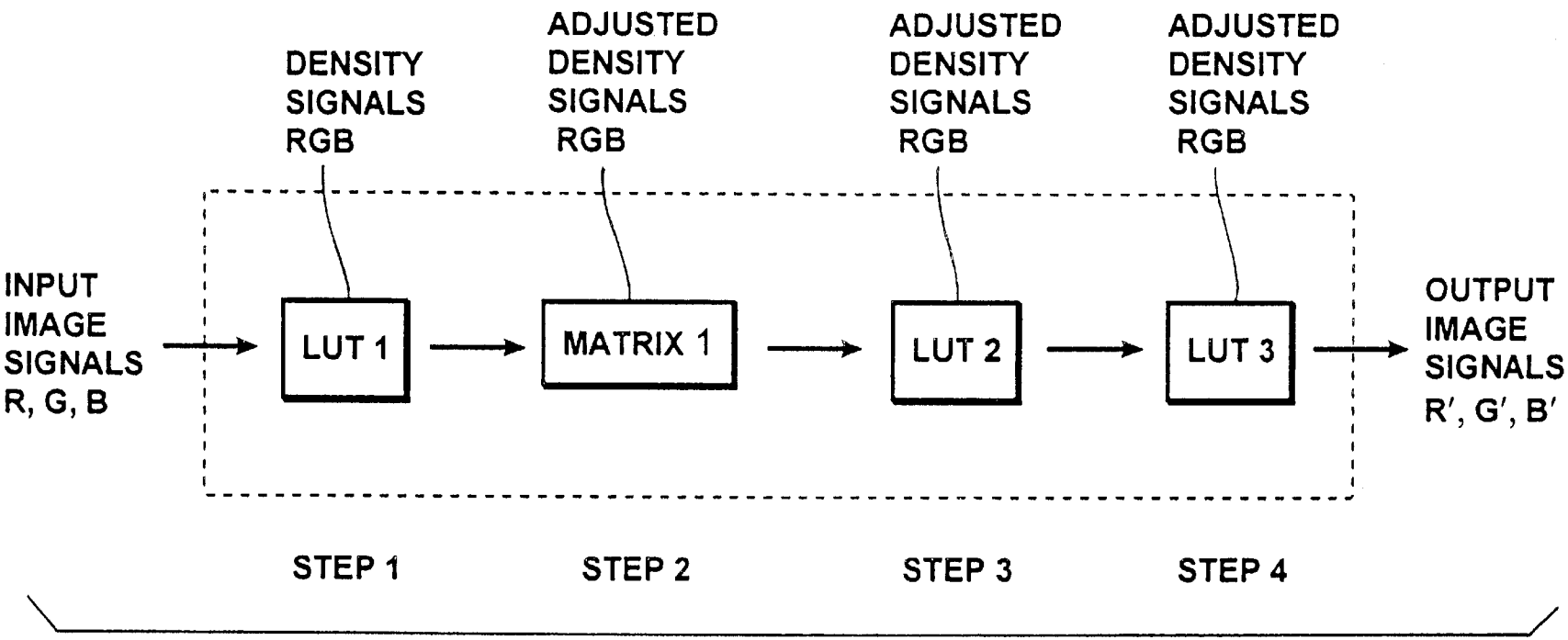
FIG. 2 shows a block diagram showing electronic signal processing of image bearing signals derived from scanning a developed color element according to the invention.

Referring to FIG. 2, in a preferred embodiment of the present invention, input image-bearing signals R, G, and B are transformed to intermediary data values corresponding to the R', G', and B' output image-bearing signals required to appropriately reproduce the color image on the reference output device as follows:

(1) The R, G, and B image-bearing signals, which correspond to the measured transmittances of the film, are converted to corresponding densities in the computer used to receive and store the signals from a film scanner by means of 1-dimensional look-up table LUT 1.

(2) The densities from step (1) are then transformed using matrix 1 derived from a transform apparatus to create intermediary image-bearing signals.

(3) The densities of step (2) are optionally modified with a 1-dimensional look-up table LUT 2 derived such that the neutral scale densities of the input film are transformed to the neutral scale densities of the reference.

(4) The densities of step (3) are transformed through a 1-dimensional look-up table LUT 3 to create corresponding R', G', and B' output image-bearing signals for the reference output device.

It will be understood that individual look-up tables are typically provided for each input color. In one embodiment, three 1-dimensional look-up tables can be employed, one for each of a red, green, and blue color record. In another embodiment, a multi-dimensional look-up table can be employed as described by D'Errico at U.S. Pat. No. 4,941,039. It will be appreciated that the output image-bearing signals for the reference output device of step 4 above may be in the form of device-dependent code values or the output image-bearing signals may require further adjustment to become device specific code values. Such adjustment may be accomplished by further matrix transformation or 1-dimensional look-up table transformation, or a combination of such transformations to properly prepare the output image-bearing signals for any of the steps of transmitting, storing, printing, or displaying them using the specified device.

In a second preferred embodiment of the invention, the R, G, and B image-bearing signals from a transmission scanner are converted to an image manipulation and/or storage metric which corresponds to a measurement or description of a single reference image-recording device and/or medium and in which the metric values for all input media correspond to the trichromatic values which would have been formed by the reference device or medium had it captured the original scene under the same conditions under which the input media captured that scene. For example, if the reference image recording medium was chosen to be a specific color negative film, and the intermediary image data metric was chosen to be the measured RGB densities of that reference film, then for an input color negative film according to the invention, the R, G, and B image-bearing signals from a scanner would be transformed to the R', G', and B' density values corresponding to those of an image which would have been formed by the reference color negative film had it been exposed under the same conditions under which the color negative recording material according to the invention was exposed.

Exposure patterns, chosen to adequately sample and cover the useful exposure range of the film being calibrated, are created by exposing a pattern generator and are fed to an exposing apparatus. The exposing apparatus produces trichromatic exposures on film to create test images consisting of approximately 150 color patches. Test images may be created using a variety of methods appropriate for the application. These methods include: using exposing apparatus such as a sensitometer, using the output device of a color imaging apparatus, recording images of test objects of known reflectances illuminated by known light sources, or calculating trichromatic exposure values using methods known in the photographic art. If input films of different speeds are used, the overall red, green, and blue exposures must be properly adjusted for each film in order to compensate for the relative speed differences among the films. Each film thus receives equivalent exposures, appropriate for its red, green, and blue speeds. The exposed film is processed chemically. Film color patches are read by a transmission scanner which produces R, G, and B image-bearing signals corresponding each color patch and by a transmission densitometer which produces R', G', and B' density values corresponding to each patch. A transform apparatus creates a transform relating the R, G, and B image-bearing signal values for the film's test colors to the measured R', G', and B' densities of the corresponding test colors of the reference color negative film. In another preferred variation, if the reference image recording medium was chosen to be a specific color negative film, and the intermediary image data metric was chosen to be the predetermined R', G', and B' intermediary densities of step 2 of that reference film, then for an input color negative film according to the invention, the R, G, and B image-bearing signals from a scanner would be transformed to the R', G', and B' intermediary density values corresponding to those of an image which would have been formed by the reference color negative film had it been exposed under the same conditions under which the color negative recording material according to the invention was exposed.

Thus, each input film calibrated according to the present method would yield, insofar as possible, identical intermediary data values corresponding to the R', G', and B' code values required to appropriately reproduce the color image which would have been formed by the reference color negative film on the reference output device. Uncalibrated films may also be used with transformations derived for similar types of films, and the results would be similar to those described.

The mathematical operations required to transform R, G, and B image-bearing signals to the intermediary data metric of this preferred embodiment may consist of a sequence of matrix operations and 1-dimensional LUTs. Three tables are typically provided for the three input colors. It is appreciated that such transformations can also be accomplished in other embodiments by employing a single mathematical operation or a combination of mathematical operations in the computational steps produced by the host computer including, but not limited to, matrix algebra, algebraic expressions dependent on one or more of the image-bearing signals, and n-dimensional LUTs. In one embodiment, matrix 1 of step 2 is a 3×3 matrix. In a more preferred embodiment, matrix 1 of step 2 is a 3×10 matrix. In a preferred embodiment, the 1-dimensional LUT 3 in step 4 transforms the intermediary image-bearing signals according to a color photographic paper characteristic curve, thereby reproducing normal color print image tone scale. In another preferred embodiment, LUT 3 of step 4 transforms the intermediary image-bearing signals according to a modified viewing tone scale that is more pleasing, such as possessing lower image contrast.

Due to the complexity of these transformations, it should be noted that the transformation from R, G, and B to R', G', and B' may often be better accomplished by a 3-dimensional LUT. Such 3-dimensional LUTs may be developed according to the teachings J. D'Errico in U.S. Pat. No. 4,941,039.

It is to be appreciated that while the images are in electronic form, the image processing is not limited to the specific manipulations described above. While the image is in this form, additional image manipulation may be used including, but not limited to, standard scene balance algorithms (to determine corrections for density and color balance based on the densities of one or more areas within the negative), tone scale manipulations to amplify film underexposure gamma, non-adaptive or adaptive sharpening via convolution or unsharp masking, red-eye reduction, and non-adaptive or adaptive grain-suppression. Moreover, the image may be artistically manipulated, zoomed, cropped, and combined with additional images or other manipulations known in the art. Once the image has been corrected and any additional image processing and manipulation has occurred, the image may be electronically transmitted to a remote location or locally written to a variety of output devices including, but not limited to, silver halide film or paper writers, thermal printers, electrophotographic printers, inkjet printers, display monitors, CD disks, optical and magnetic electronic signal storage devices, and other types of storage and display devices as known in the art.

In yet another embodiment of the invention, the luminance and chrominance sensitization and image extraction article and method described by Arakawa et al in U.S. Pat. No. 5,962,205 can be employed. The disclosures of Arakawa et al are incorporated by reference.

EXAMPLE 1

This Example illustrates the preparation of compound D-1, useful as a blocked developer in the present invention which is prepared according to the following reaction scheme:

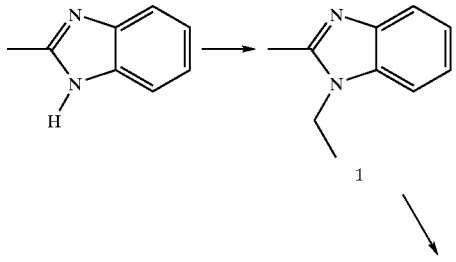

-continued

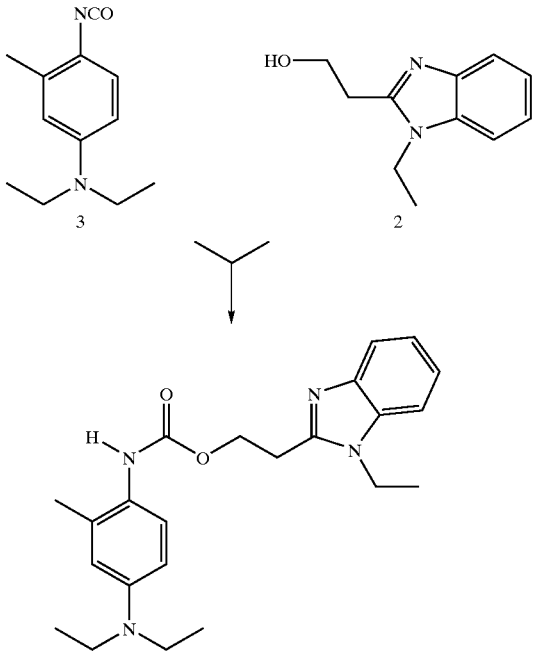

Preparation of Intermediate 1

To a mixture of KOH (85%) (7.3 g, 110 mmol), $K_2CO_3$ (6.8 g, 50 mmol), 2-methylbenzimidazole (Aldrich, 13.2 g, 100 mmol) and THF (70 mL) was added at ca. 15° C. diethyl sulfate (11.3 mL, 102 mmol) in 10 mL of THF. After stirring for four hours, 50 mL of ethyl acetate was added, and then the reaction mixture was filtered to remove solid materials. The filtrate was concentrated under reduced pressure to yield 15.5 g (97%) of 1 as a yellow oil.

Preparation of Intermediate 2

A pressure bottle was charged with compound 1 (8.0 g, 50 mmol), a 38% solution of formaldehyde (12 mL), pyridine (6 mL) and propanol (20 mL) and the reaction mixture was heated at 130° C. for 9 hours. The excess solvent was removed under reduced pressure and the residue recrystallized from ethyl acetate to yield compound 2 (14.5 g, 73%) as a solid; $^1$H NMR (300 MHz, $CDCl_3$): 1.40 (t, 3H, J=7.3 Hz), 3.04 (t, 2H, J=5.3 Hz), 4.10–4.20 (m, 5H), 7.18–7.34 (m, 3H), 7.65–7.72(m, 1H).

Preparation of D-1

To a mixture of 2 (5.7 g, 30 mmol), dichloromethane (30 mL) and two drops of dibutyltin diacetate was added compound 3, namely 4-(N,N-diethylamino)-2-methylphenyl isocyanate, the latter prepared as described in Brit. Pat. 1,152,877, (6.1 g, 30 mmol). After being stirred at room temperature for 14 hours the reaction mixture was concentrated under reduced pressure and diluted with ligroin. The precipitated solid material was isolated by filtration to yield D-1 (9.6 g, 81%); $^1$H NMR (300 MHz, $CDCl_3$): 1.12 (t, 6H, J=7.3 Hz), 1.30–1.46 (m, 3H), 2.18 (s, 3H), 3.20–3.35 (m, 6H), 4.10–4.35 (m, 3H), 4.60–4.68 (m,3H), 6.18 (bs, 1H), 6.40–6.55 (m, 2H), 7.20–7–44 (m, 4H), 7.69–7.75 (m, 1H).

EXAMPLE 2

This Example illustrates the preparation of compound D-12, useful as a blocked developer in the present invention, which is prepared according to the following reaction scheme:

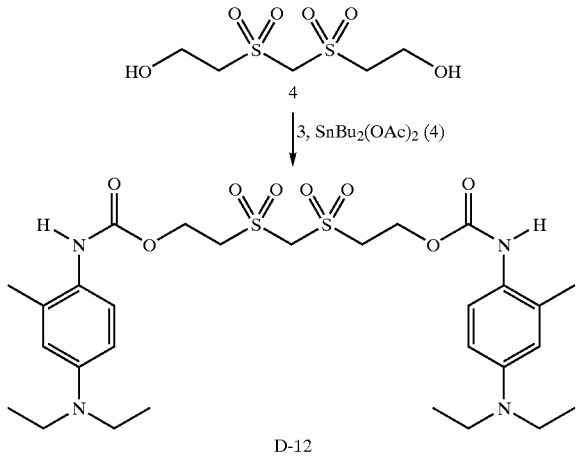

Preparation of D-12

A solution of the diol 4 (15.0 g, 64 mmol), compound 3 (27.0 g, 130 mmol) and dibutyltin diacetate (0.05 mL) in 150 mL of tetrahydrofuran was stirred at room temperature for 18 h. The reaction mixture was then filtered through a pad of Celite and the filtrate concentrated in vacuo, giving a solid, which was recrystallized from methanol. The yield of D-12 was 25.0 g (40 mmol, 61%), m.p. 131° C.

EXAMPLE 3

This Example illustrates the preparation of compound D-15, useful as a blocked developer in the present invention, which is prepared according to the following reaction scheme:

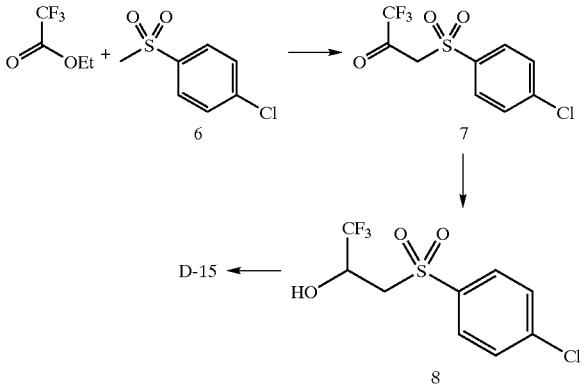

Preparation of Intermediate 7

A solution of sulfone 6 (19.07 g, 100 mmol) in 50 mL of N,N-dimethylformamide was added to a suspension of 60% sodium hydride (6.00 g, 150 mmol) in 100 mL of N,N-dimethylformamide, the mixture was stirred at 40° C. for 90 min and then cooled to 5° C. Neat ethyl trifluoroacetate (36 mL, 300 mmol) was added at 5° C. and then the reaction mixture stirred at room temperature for 30 min. The mixture was diluted with 1000 mL of brine and extracted with ether, giving an oil which was purified by column chromatography on silica gel. A solid was obtained which was further purified by crystallization from hexane-isopropyl ether. The yield of 7 was 18.47 g (64 mmol, 64%).

Preparation of Intermediate 8

Solid sodium borohydride (1.89 g, 50 mmol) was added in portions to a solution of 7 (14.33 g, 50 mmol) in 100 mL of methanol and the mixture stirred for 30 min. Water (200 mL) was then added and methanol distilled off. Extraction with ether and removal of the solvent gave 13.75 g (48 mmol, 95%) of 8.

Preparation of D-15

A solution of 7 (13.75 g, 48 mmol, 4-(N,N-diethylamino)-2-methylphenyl isocyanate (3,10.21 g, 50 mmol) and dibutyltin diacetate (0.01 mL) in 50 mL of dichloromethane was stirred at room temperature for 4 days. The solvent was distilled off and the crude product washed with hexane and dried. The yield of D-15 was 21.00 g (43 mmol, 85%), m.p. 140–143° C.

EXAMPLE 4

This Example illustrates the preparation of compound D-23, useful in the present invention, which is prepared according to the following reaction scheme:

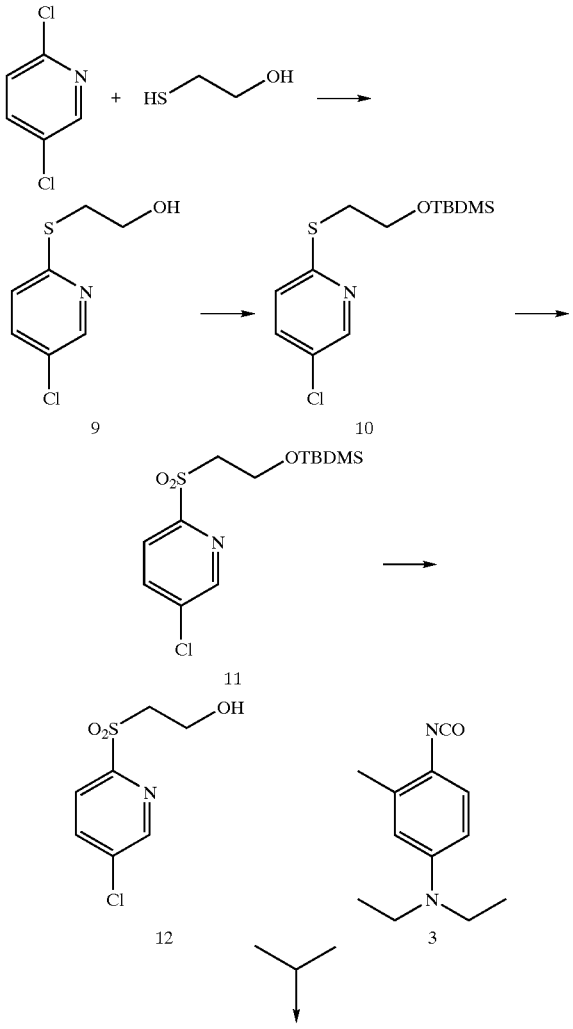

-continued

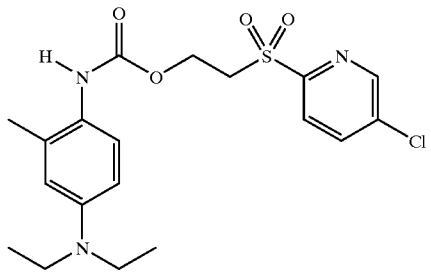

D-23

Preparation of Intermediate 9

A mixture consisting of 2,5-dichloropyridine (Aldrich, 14.80 g, 100 mmol), 2-mercaptoethanol (Fluka, 9.36 g, 120 mmol), potassium carbonate (19.34 g, 140 mmol), and acetone (200 mL) was refluxed for 36 h, cooled to room temperature and filtered. The filtrate was concentrated in vacuo, dissolved in ether (300 mL) and washed with brine 2×100 mL). The organic solution was concentrated and the crude product purified by column chromatography on silica gel with heptane/ethyl acetate. The yield of 9 was 12.05 g (64 mmol, 64%).

Preparation of Intermediate 10

Solid tert-butyldimethylsilyl chloride (Aldrich, TBDMSCl, 11.34 g, 75 mmol) was added in one portion to a solution of 9 (11.86 g, 62.5 mmol) and imidazole (5.97 g, 87.5 mmol) in tetrahydrofuran (160 mL), stirred at 5° C. Following the addition, the mixture was stirred at room temperature for 20 h and then worked up with saturated aqueous sodium bicarbonate and ether. The product was purified by column chromatography on silica gel with heptane/ethyl acetate. The yield of 10 was 17.69 g (58 mmol, 93%).

Preparation of Intermediate 11

A solution of meta-chloroperbenzoic acid (mCPBA, 77%, 27.01 g, 120 mmol) in dichloromethane (150 mL) was added in drops over a period of 30 min to a solution of 10 in dichloromethane (200 mL), stirred at 5° C. Following the addition the mixture was stirred at room temperature for 22 h and quenched with saturated aqueous sodium bicarbonate, followed by extraction with dichloromethane and column chromatography (silica, heptane/dichloromethane) which gave 11.67 g (35 mmol, 87%) of 11.

Preparation of Intermediate 12

A solution of 11 (10.08 g, 30 mmol) in tetrahydrofuran (90 mL)/water (90 mL)/acetic acid (270 mL) was kept at room temperature for 4 days. The solvents were distilled off and the residue crystallized from heptane/isopropyl ether. The yield of 12 was 6.41 g (29 mmol, 96%).

Preparation of D-23

A solution of 12 (4.43 g, 20 mmol) and compound 3, namely 4-(N,N-diethylamino)-2-methylphenyl isocyanate, the latter prepared as described in Brit. Pat. 1,152,877 (4.08 g, 20 mmol), and dibutyltin diacetate (0.01 mL) was stirred in 35 mL of tetrahydrofuran at room temperature for 24 hours. The solvent was distilled off and the crude oily product stirred with 50 mL of isopropyl ether, giving colorless crystals of D-23 (8.18 g, 19.2 mmol, 96%), m.p. 84–85° C.

EXAMPLE 5

This Example illustrates the preparation of compound D-33, useful in the present invention, which is prepared according to the following reaction scheme:

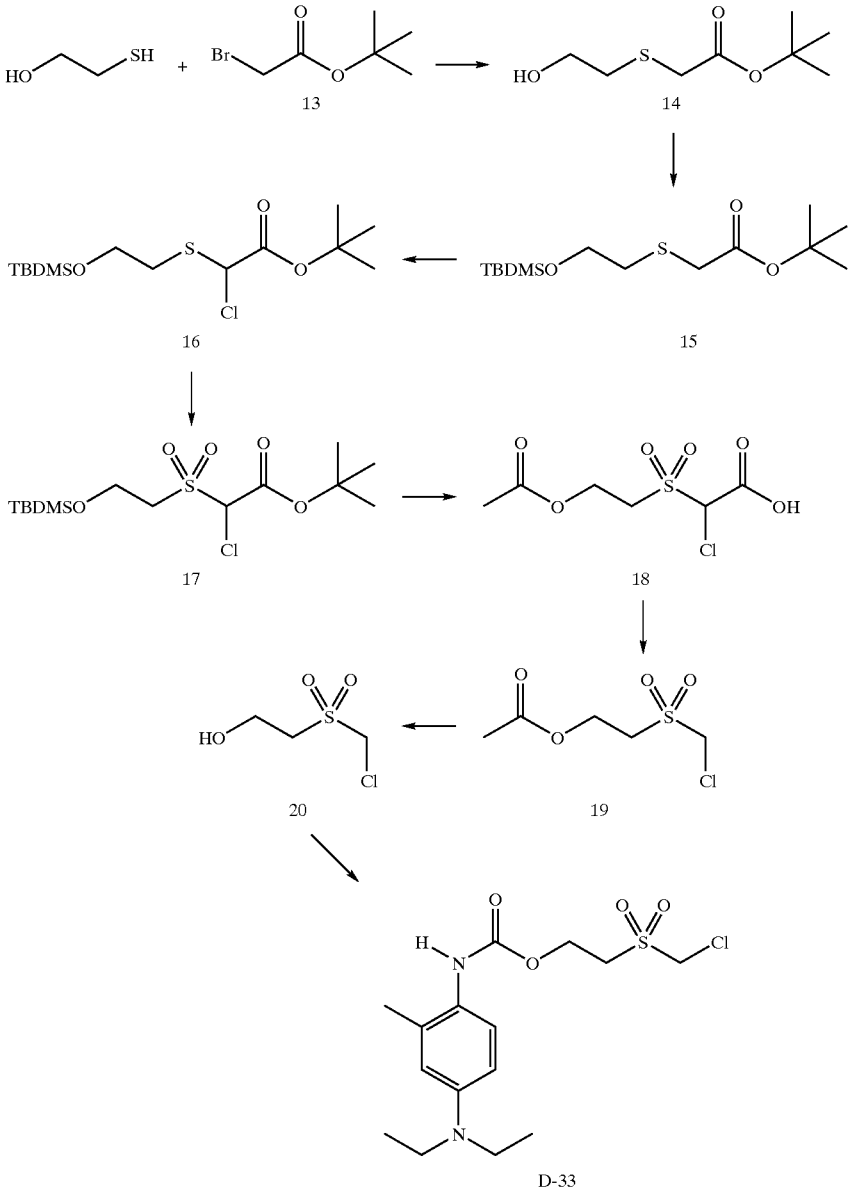

Preparation of Intermediate 14

A solution of t-butyl bromoacetate 13 (Aldrich, 19.51 g, 100 mmol) in 100 mL of acetonitrile was added in drops over a period of 30 min to a cooled (5° C.) solution of 2-mercaptoethanol (8.19 g, 105 mmol) in 100 mL of acetonitrile, containing potassium carbonate (15.20 g, 110 mmol). Following the addition the mixture was stirred at room temperature for 3 h and filtered. The filtrate was diluted with 200 mL of ether and washed with brine (50 mL). The ethereal solution was dried over sodium sulfate and concentrated in vacuo to give 19.24 g of 14 (100 mmol, 100%).

Preparation of Intermediate 15

Solid tert-butyldimethylsilyl chloride (TBDMSCl, 18.09 g, 120 mmol) was added in one portion to a solution of 14 (19.24 g, 100 mmol) and imidazole (9.55 g, 140 mmol) in 250 mL of tetrahydrofuran, stirred under nitrogen. After 2 h at room temperature the mixture was quenched with 200 mL of saturated aqueous sodium bicarbonate and extracted with ether. The crude product was filtered through silica gel (ether/heptane) giving 29.21 g (95 mmol, 95%) of 15.

Preparation of Intermediate 16

Solid N-chlorosuccinimide (6.68 g, 50 mmol) was added in portions over a period of 30 min to a solution of 15 (15.33 g, 50 mmol) in 100 mL of carbon tetrachloride that was stirred at 5° C. The reaction was run for 2 h and filtered. Removal of the solvent left 17.44 g of 16 as an oil (50 mmol, 100%).

Preparation of Intermediate 17

A solution of m-chloroperbenzoic acid (mCPBA, 77%, 24.75 g, 110 mmol) in 200 mL of dichloromethane was added in drops over a period of 30 min to a solution of 16 (17.44 g, 50 mmol) in 100 mL of dichloromethane, stirred at 5° C. Following the addition, the mixture was stirred at 5° C. for 2 h and then at room temperature for 1 h. The reaction was quenched with saturated aqueous sodium bicarbonate (250 mL) and the organic layer was dried and concentrated giving 18.66 g of 17 as an oil (50 mmol, 100%).

Preparation of Intermediate 18

A solution of 17 (11.26 g, 30.2 mmol), acetic anhydride (5 mL) and p-toluenesulfonic acid monohydrate (100 mg) in acetic acid (150 mL) was refluxed for 1 h. The solution was cooled to room temperature, diluted with 100 mL of water and stirred for 2 h. A solid was filtered off and the filtrate was concentrated in vacuo to produce 18 as a colorless oil.

Preparation of Intermediate 19

A solution of crude 18 and sodium acetate (2.46 g, 30 mmol) in acetic acid (30 mL) was refluxed for 15 min, cooled to room temperature and the solvent was distilled off. The residue was worked up with water and ethyl acetate, giving 5.66 g of 19 as an oil.

Preparation of Intermediate 20

A solution of crude 19 and concentrated hydrochloric acid (0.5 mL) in 75 mL of methanol was stirred at room temperature for 3 days. The solvent was distilled off leaving 4.61 g of 20 (29 mmol, 96% based on 17).

Preparation of D-33

A solution of 20 (1.59 g, 10 mmol), 3 (2.25 g, 11 mmol) and dibutyltin diacetate (0.02 mL) in acetonitrile (10 mL) was kept at room temperature in a stoppered flask for 24 h. The solvent was removed giving an oil which crystallized when stirred with isopropyl ether. The solid was collected, washed with isopropyl ether and dried. The yield of D-33 was 3.03 g (8.3 mmol, 83%), m.p. 96–98° C., ESMS: $ES^+$, m/z 363 (M+1, 95%).

Photographic Examples

EXAMPLE 6

This Example illustrates a method of determining the half life ($t_{1/2}$) or thermal activity of the blocked developers employed in the present invention. Except for blocked developers in which a heteroaromatic D group in Structure III above is present (see below), the blocked developers were tested for thermal activity as follows: The blocked developer was dissolved at a concentration of ~$1.6\times10^{-5}$ M in a solution consisting of 33% (v/v) EtOH in deionized water at 60° C. and pH 7.87 and ionic strength 0.125 in the presence of Coupler-1 (224PG, 0.0004 M) and $K_3Fe(CN)_6$ (0.00036 M). The reaction was followed by measurement of the magenta dye formed at 568 nm with a spectrophotometer (for example, a Hewlett-Packard 8451A Spectrophotometer or an equivalent). The reaction rate constant (k) is obtained from a fit of the following equation to the data:

$$A=A_0+A_\infty(1-e^{-kt})$$

where A is the absorbance at 568 nm at time t, and the subscripts denote time 0 and infinity (∞). The half-lives are calculated accordingly from $t_{1/2}=0.693/k$.

Coupler-1

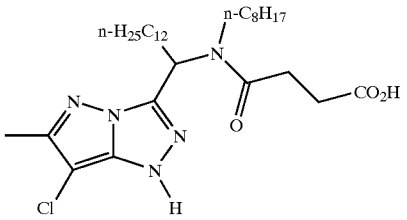

Results from such measurement for some blocked color developers are given below.

TABLE 6-1

| Developer | | $t_{1/2}$, min | |
|---|---|---|---|
| DC-1 | (D109CL) | D109CL | >500 |
| DC-2 | (D94BG) | D94BG | 50.8 |
| DC-3 | (D94BM) | BM | 127 |
| DC-5 | (D94EA) | EA | 72.2 |
| DC-6 | (D94EB) | EB | 74.6 |
| DC-7 | (D94GN) | GN | 36.5 |
| DC-4 | (D94BL) | BL | 362 |
| D-12 | (D94DT) | D94DT | 0.86 |
| D-42 | (D106BG) | D106BG | 1.47 |
| D-15 | (D94GU) | GU | 3.03 |
| D-18 | (D94HP) | HP | 13.7 |
| D-44 | (D94ES) | ES | 8.27 |
| D-19 | (D94ET) | ET | 13.8 |
| D-25 | (D94IA) | IA | 2.80 |
| D-22 | (D94II) | II | 17.9 |
| D-23 | (D94IM) | IM | 10.1 |
| D-45 | (D94JB) | JB | 0.37 |

DC-1

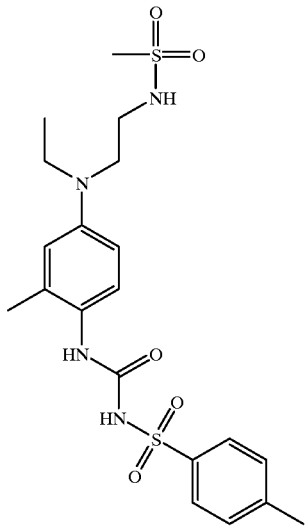

DC-2

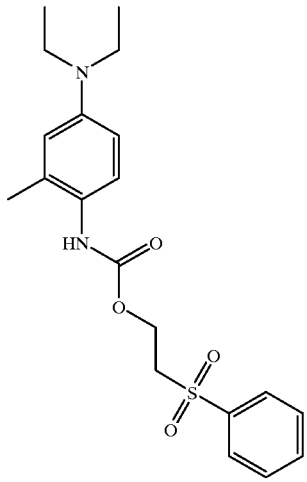

TABLE 6-1-continued

DC-3

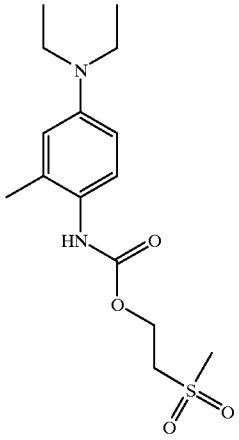

DC-4

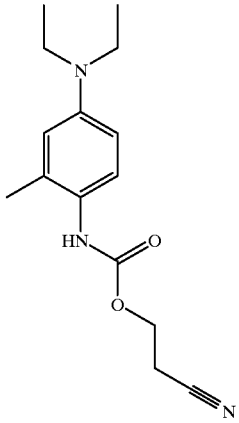

DC-5

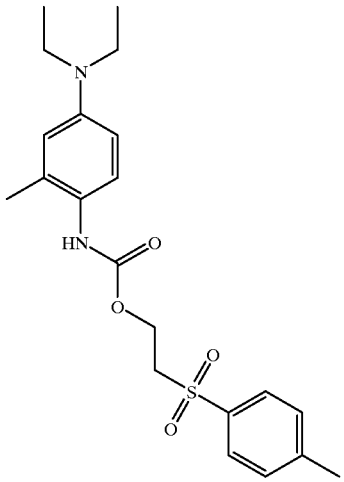

TABLE 6-1-continued

DC-6

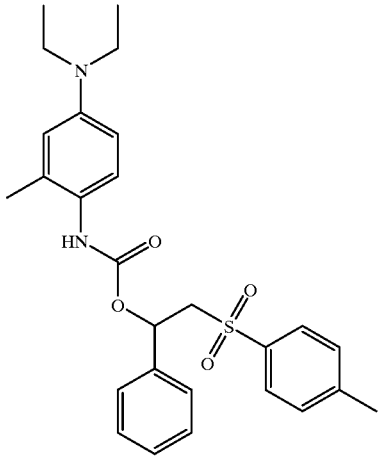

DC-7

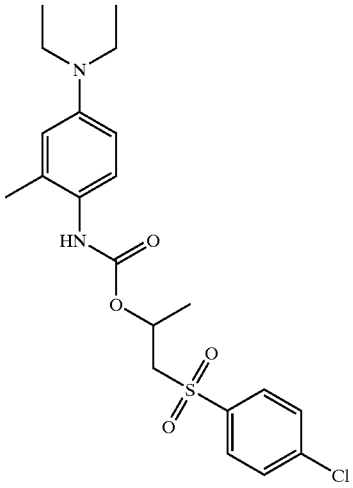

In comparison with the comparative compounds, lower onset temperatures are achieved with the described blocked compounds that show half-lives of 30 min or less. Preferably the half-lives are 25 min or less, more preferably 20 min or less.

To determine the half-lives of blocked developing agents of Structure I in which D is a heteroaromatic group, the blocked developer was dissolved at a concentration of ~$1.6\times10^{-5}$ M in a solution consisting dimethylsulfoxide (DMSO) solvent at 130° C. in the presence of 0.05 M of salicylanilide, which was first mixed with the DMSO solvent. The reaction kinetics was followed by high pressure liquid chromatography (HPLC) analysis of the reaction mixture, for example using a Hewlett-Packard LC 1100 System or an equivalent. The half-life measured for D-46 was 14.8, which shows a high reactivity under the conditions.

EXAMPLE 7

This example shows the advantages of a photothermographic element according to the present invention. The following components are used in the photographic element of this example.

Emulsion E-1

The silver halide emulsion used in this example was composed of 95.5% AgBr and 4.5% AgI. The grains had an effective circular diameter of 1.06 microns and a thickness of 0.126 microns. The emulsion was sensitized to magenta light by application of sensitizing dyes SM1 and SM2, and was chemically sensitized to optimum imaging performance as known in the art.

SM-1

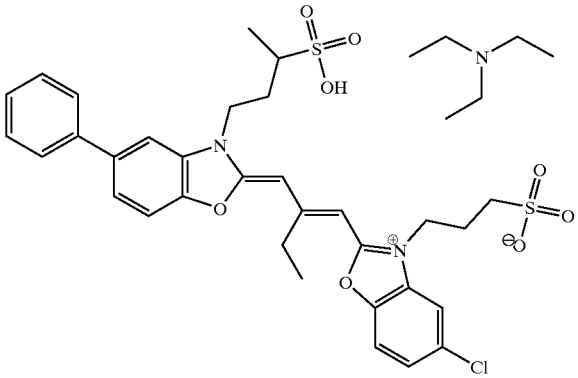

SM-2

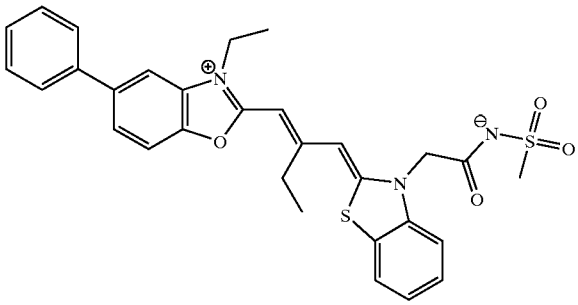

Silver Salt Dispersion SS-1

A stirred reaction vessel was charged with 431 g of lime processed gelatin and 6569 g of distilled water. A solution containing 214 g of benzotriazole, 2150 g of distilled water, and 790 g of 2.5 molar sodium hydroxide was prepared (Solution B). The mixture in the reaction vessel was adjusted to a pAg of 7.25 and a pH of 8.00 by additions of Solution B, nitric acid, and sodium hydroxide as needed. A 4 L solution of 0.54 molar silver nitrate was added to the kettle at 250 cc/minute, and the pAg was maintained at 7.25 by a simultaneous addition of solution B. This process was continued until the silver nitrate solution was exhausted, at which point the mixture was concentrated by ultrafiltration. The resulting silver salt dispersion contained fine particles of silver benzotriazole.

AgPMT Dispersion AF-1

A stirred reaction vessel was charged with 9.7 g of lime processed gelatin and 300 g of distilled water. A solution containing 14.1 g of phenylmercaptotetrazole, 90.2 g of distilled water, 16.0 g of acetone and 31.7 g of 2.5 molar sodium hydroxide was prepared (Solution C). The mixture in the reaction vessel was adjusted to a pAg of 7.25 and a pH of 5.8 by additions of Solution C, nitric acid, and sodium hydroxide as needed. A 200 cc solution of 0.54 molar silver nitrate was added to the kettle at 11 cc/minute, and the pAg was maintained at 7.25 by a simultaneous addition of solution C. This process was continued until the silver nitrate solution was exhausted, at which point 27 g of a 20% gelatin solution were added. The resulting silver salt dispersion contained fine particles of silver phenylmercaptotetrazole.

AgPMT/PMT Co-dispersion AF-2

These materials were ball-milled in an aqueous mixture, for 4 days using Zirconia beads in the following formula. For 1 g of phenylmercaptotetrazole, sodium triisopropylnaphthalene sulfonate (0.1 g), water (to 10 g), and beads (25 ml), were used. The beads were removed by filtration. Fifty percent of the phenylmercaptotetrazole was converted to silver-phenylmercaptotetrazole by addition of 0.5 moles silver nitrate per mole of phenylmercaptotetrazole.

Coatings were prepared according to the standard format listed below in Table 1-1, with variations consisting of changing the s phenylmercaptotetrazole source. The melt pH was adjusted to 3.5. All coatings were prepared on a 7 mil thick poly(ethylene terephthalate) support.

TABLE 7-1

| Component | Laydown |
|---|---|
| Silver (from emulsion E-1) | 0.54 g/m$^2$ |
| Silver (from silver salt SS-1) | 0.65 g/m$^2$ |
| Coupler M-1 (from coupler dispersion CDM-1) | 0.43 g/m$^2$ |
| Developer DEV-1 | 0.65 mmol/m$^2$ |
| Benzamide | 0.22 g/m$^2$ |
| Antifoggant (as defined in Table 7-2) | 0.32 g/m$^2$ |
| Lime processed gelatin | 4.75 g/m$^2$ |

Coupler Dispersion CDM-1:

Coupler Dispersion CDM-1

An oil based coupler dispersion was prepared by conventional means containing coupler M-1 (224EV) and tricresyl phosphate at a weight ratio of 1:0.5.

Structure

M-1

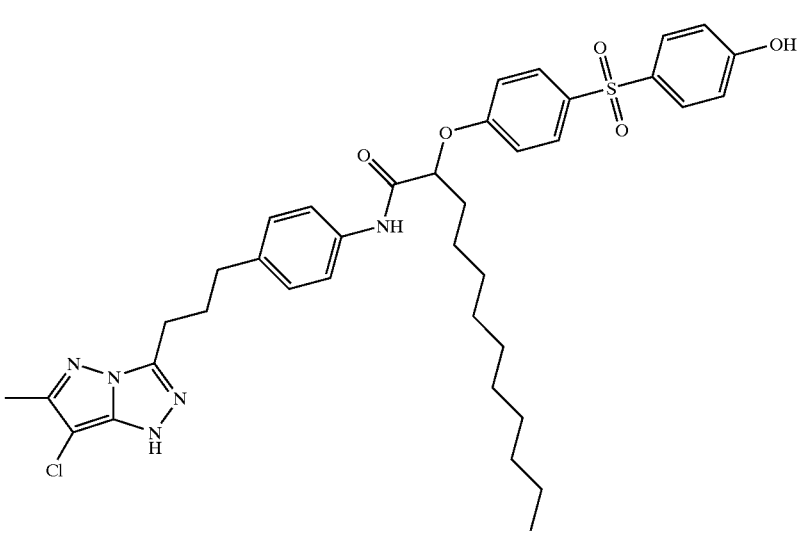

DEV-1

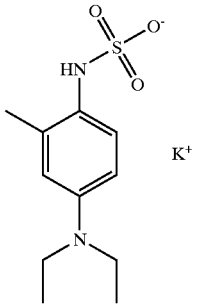

Comparative Examples

Comparative Coatings were made using the standard coating format with blocked developer DEV-1, without antifoggant.

Inventive Examples

Two inventive coatings were made using the standard coating format with blocked developer DEV-1 and, respectively antifoggant preparations AF-1 and AF-2.

Coating Evaluation

The resulting coatings were exposed through a step wedge to a 3.04 log lux light source at 3000K filtered by a Daylight 5A filter. The exposure time was 1/10 second. After exposure, the coating was thermally processed by contact with a heated platen for 20 seconds.

The coatings listed above performed as shown in the table below. A number of strips were processed at a variety of platen temperatures in order to yield an optimum strip process condition. From these data, the image discrimination was calculated. The image discrimination corresponds to the value:

$$D_p = \frac{D_{max} - D_{min}}{D_{min}}$$

Higher values of $D_p$ indicate antifoggants producing enhanced signal to noise, which are desirable.

The coatings listed above performed as shown in the Table 7-2 below.

TABLE 7-2

| Coating | Antifoggant | D-min | D-max | Dp |
|---|---|---|---|---|
| C-7-1 | None | 0.68 | 0.68 | 0.0 |
| I-7-1 | AF-1 | 0.24 | 0.80 | 2.3 |
| I-7-2 | AF-2 | 0.23 | 0.63 | 1.7 |

This table shows that the inventive antifoggants substantially improved peak discrimination compared to comparison coating.

EXAMPLE 8

To demonstrate the advantage of using a combination of silver salts of benzotriazole and 5-phenyl-1-mercaptotetrazole in photothermographic films, coatings containing the components in Table 8-1 were prepared on 7 mil poly(ethylene terephthalate) support.

Silver Salt Dispersion AF-3 (Silver 1-phenyl-5-mercapto tetrazole)

A stirred reaction vessel was charged with 431 g of lime processed gelatin and 6569 g of distilled water. A solution containing 320 g of 1-phenyl-5-mercaptotetrazole, 2044 g of distilled water, and 790 g of 2.5 molar sodium hydroxide was prepared (Solution D). The mixture in the reaction vessel was adjusted to a pAg of 7.25 and a pH of 8.00 by additions of Solution D, nitric acid, and sodium hydroxide as needed.

A 4 l solution of 0.54 molar silver nitrate was added to the kettle at 250 cc/minute, and the pAg was maintained at 7.25 by a simultaneous addition of solution D. This process was continued until the silver nitrate solution was exhausted, at which point the mixture was concentrated by ultrafiltration. The resulting silver salt dispersion contained fine particles of the silver salt of 1-phenyl-5-mercaptotetrazole.

Coupler Dispersion CDM-2

A coupler dispersion was prepared by conventional means containing coupler M-2 without any additional permanent solvents.

specified in Table 8-2 (amounts based on silver). The resulting coatings were exposed for one-tenth of a second through a step wedge to a 3.04 log lux light source at 3000K, filtered by a Daylight 5A filter. Following exposure, the coatings were thermally processed by contact with a heated platen for 20 seconds at 150 degrees Celsius. The coatings were then fixed in a solution Kodak Flexicolor® Fix to remove the silver halide. For each coating, the Status M red density at maximum exposure (red Dmax) was measured with an X-Rite® densitometer. The red Dmax values are reported in the last column of Table 8-2.

TABLE 8-1

| Component | Laydown g/m$^2$ |
|---|---|
| Silver (from emulsion E-1) | 0.86 |
| Coupler M-2 (from dispersion CDM-2) | 0.75 |
| Developer DEV-2 | 0.86 |
| Salicylanilide | 0.86 |
| Lime Processed Gelatin | 3.24 |

Structure

DEV-2

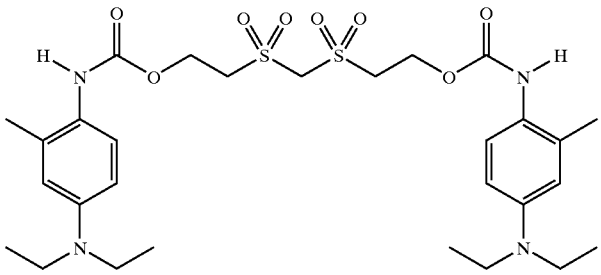

M-2

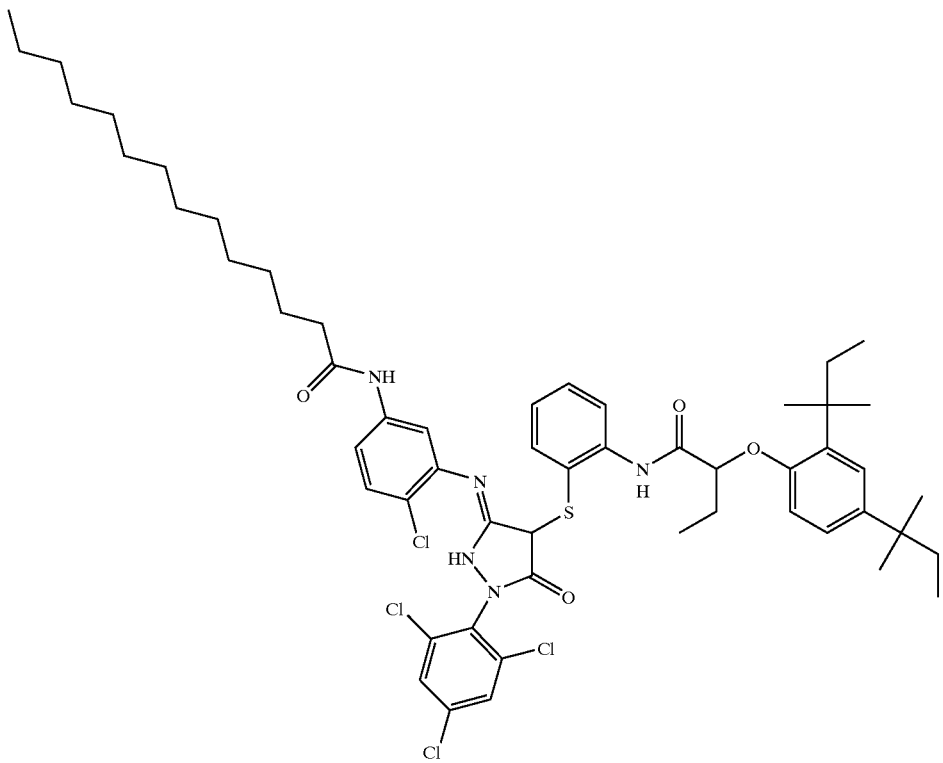

In addition to these common components, silver salts SS-1 and AF-3 were added to each coating in the amounts

TABLE 8-2

| Coating | SS-1 (g/m$^2$) | AF-3 (g/m$^2$) | Red Dmax |
|---|---|---|---|
| C-8-1 | 0.00 | 0.65 | 0.33 |
| C-8-2 | 0.00 | 0.32 | 0.40 |
| C-8-3 | 0.32 | 0.00 | 0.54 |
| C-8-4 | 0.65 | 0.00 | 0.60 |
| I-8-1 | 0.32 | 0.32 | 1.39 |

The data in Table 8-2 clearly show that using a mixture of a silver salt from a benzotriazole and a silver salt from a mercaptotetrazole is necessary to achieve high maximum density in a thermally processed film.

EXAMPLE 9

A further advantage of using a silver salt of a mercaptotetrazole compared to its free, uncomplexed form is demonstrated in the following experiment. Photothermographic coatings were prepared on 7 mil poly(ethylene terephthalate) support containing the common components listed in Table 9-1.

Dispersion AD-1 (1-phenyl-5-mercapto tetrazole (PMT))

A mixture was made up containing 9.6 grams of PMT, 0.96 grams of polyvinylpyrolidone, 0.96 grams of Triton X-200 surfactant, and 84.5 grams of distilled water. To this mixture was added 240 cc of 1.8 mm zirconium oxide beads and the dispersion was milled for three days on a roller mill to yield a fine particle dispersion of PMT.

TABLE 9-1

| Component | Laydown g/m$^2$ |
|---|---|
| Silver (from emulsion E-1) | 0.86 |
| Coupler M-2 (from dispersion CDM-2) | 0.75 |
| Developer DEV-2 | 0.86 |
| Salicylanilide | 0.86 |
| Lime Processed Gelatin | 3.24 |

In addition to these components, silver salts SS-1 and AF-3 and free 5-phenyl-1-mercaptetrazole (AD-1) were added to each coating in the amounts listed in Table 9-2. The resulting coatings were exposed for one-tenth of a second through a step wedge to a 3.04 log lux light source at 3000K, filtered by Daylight 5A and Wratten 2B filters. Following exposure, the coatings were thermally processed by contact with a heated platen for 20 seconds at 150 degrees Celsius. These coatings were then fixed in a solution of Kodak Flexicolor Fix to remove the silver halide. Another set of exposed coatings was processed through a standard KODAK FLEXICOLOR® (C-41) process as described in *British Journal of Photography Annual,* 1988, pp. 196–198. For each coating, the Status M green density at maximum exposure (green Dmax) was measured with an X-Rite densitometer. The green Dmax values for the thermally processed and for the C-41 processed coatings are presented in Table 9-2 below. The last column in Table 9-2 shows the percent loss in green Dmax exhibited by coatings that went through a standard C-41 process compared to the same coating formulation processed thermally at 150° C. A smaller percent loss is desirable because it signifies that a photographic element exhibits similar sensitometric behavior whether processed thermally or under standard C-41 conditions.

TABLE 9-2

| Coating | SS-1 (g/m$^2$) | AF-3 (g/m$^2$) | AD-1 (g/m$^2$) | Green Dmax (Thermal) | Green Dmax (C-41) | Percent Loss in Dmax in C-41 Process |
|---|---|---|---|---|---|---|
| I-9-1 | 0.32 | 0.32 | 0.00 | 2.02 | 0.79 | 60.9 |
| C-9-1 | 0.32 | 0.32 | 0.05 | 1.98 | 0.65 | 67.4 |
| C-9-2 | 0.32 | 0.32 | 0.11 | 2.02 | 0.53 | 74.0 |
| C-9-3 | 0.32 | 0.32 | 0.22 | 1.79 | 0.35 | 80.6 |
| C-9-4 | 0.32 | 0.32 | 0.32 | 2.32 | 0.43 | 81.4 |
| C-9-5 | 0.65 | 0 | 0.32 | 1.20 | 0.24 | 80.0 |

As the data in Table 9-2 demonstrate, coatings that contain the free phenylmercaptotetrazole AD-1 show greater maximum density loss when processed in standard C-41 conditions.

EXAMPLE 10

Processing conditions are as described in the example. Unless otherwise stated, the silver halide was removed after development by immersion in Kodak Flexicolor Fix solution. In general, an increase of approximately 0.2 in the measured density would be obtained by omission of this step. The following components are used in the examples. Also included is a list of all of the chemical structures.

All coatings contained the common elements as shown in Table 10-1. In addition, the levels of silver salts SS-1, AF-3, and PMT are as listed in Table 10-2 as a function of coating. The comparative example contains the PMT incorporated as the pure compound, while the inventive examples show the PMT incorporated as the silver salt.

TABLE 10-1

| Component | Laydown g/m$^2$ |
|---|---|
| Silver (from emulsion E-1) | 0.864 |
| Coupler M-1 (as dispersion CDM-1) | 0.54 |
| Developer DEV-2 | 0.864 |
| Salicylanilide | 0.864 |
| Lime Processed Gelatin | 3.24 |

TABLE 10-2

| Coating | SS-1 (silver) g/m$^2$ | AF-3 (silver) g/m$^2$ | AD-1 g/m$^2$ |
|---|---|---|---|
| C-10-1 | 0.648 | — | 0.324 |
| I-10-1 | 0.486 | 0.162 | — |
| I-10-2 | 0.324 | 0.324 | — |
| I-10-3 | 0.162 | 0.486 | — |

The use of the silver salt of PMT as opposed to incorporation of the PMT organic acid shows 2 main advantages. In the first place, coatings with silver-PMT show increased speed over coatings that do not contain silver-PMT as shown in Table 10-3 below. To measure speed, the coatings of Table 10-2 were exposed through a step tablet to a light source filtered to simulate a color temperature of 5500 K. The light source was further filtered by a Wratten #9 filter to allow only red and greed portions of the visible light spectrum to expose the film. The light source has an intensity of 2.4 log(lux), and an exposure time of 0.1 seconds was used.

After exposure, the coating was processed at 145 C. for 20 seconds to yield a visible image. Densitometry was performed on this image to produce an H&D curve from which speed was measured using a contrast normalized speed metric. Table 10-3 shows the measured speeds of these coatings, all normalized to the speed of the control coating.

TABLE 10-3

| Coating | Relative Speed (log(E)) |
|---|---|
| C-10-1 | 0 |
| I-10-1 | 0.16 |
| I-10-2 | 0.09 |
| I-10-3 | 0.21 |

Table 10-3 shows that moderate speed increases can be obtained by incorporation of PMT as a silver salt as opposed to incorporation of the PMT organic acid.

In addition to the fresh processed coatings exemplified in Table 10-3, the same coatings were exposure to a condition of 38 C. and a relative humidity of 60% for 1 week in order to study the stability of the coatings to aging. Table 10-4 below shows the results of this testing, where the parameter Δ-Speed refers the difference in photographic speed of the coating after simulated aging to that of the coating prior to simulated aging. Negative numbers represent a speed loss upon aging.

TABLE 10-3

| Coating | Relative Speed (log(E)) |
|---|---|
| C-10-1 | 0 |
| I-10-1 | 0.16 |
| I-10-2 | 0.09 |
| I-10-3 | 0.21 |

Although there is some loss of speed upon aging with several of the inventive coatings, it is clear from Table 10-4 that the speed losses upon aging are much less severe for coatings employing the silver salt of PMT as opposed to the comparative coating that was constructed using the PMT organic acid.

EXAMPLE 11

Processing conditions are as described in the inventive multilayer example that follows. The following components are used in the example. Also included is a list of all of the chemical structures.

Silver Salt Dispersion SS-2

A stirred reaction vessel was charged with 431 g of lime processed gelatin and 6569 g of distilled water. A solution containing 214 g of benzotriazole, 2150 g of distilled water, and 790 g of 2.5 molar sodium hydroxide was prepared (Solution E). The mixture in the reaction vessel was adjusted to a pAg of 7.25 and a pH of 8.00 by additions of Solution E, nitric acid, and sodium hydroxide as needed.

A 4 l solution of 0.54 molar silver nitrate was added to the kettle at 250 cc/minute, and the pAg was maintained at 7.25 by a simultaneous addition of solution E. This process was continued until the silver nitrate solution was exhausted, at which point the mixture was concentrated by ultrafiltration. The resulting silver salt dispersion contained fine particles of silver benzotriazole.

Antifogging Silver Salt Dispersion AF-4

A stirred reaction vessel was charged with 431 g of lime processed gelatin and 6569 g of distilled water. A solution containing 320 g of 1-phenyl-5-mercaptotetrazole , 2044 g of distilled water, and 790 g of 2.5 molar sodium hydroxide was prepared (Solution F). The mixture in the reaction vessel was adjusted to a pAg of 7.25 and a pH of 8.00 by additions of Solution F, nitric acid, and sodium hydroxide as needed.

A 4 l solution of 0.54 molar silver nitrate was added to the kettle at 250 cc/minute, and the pAg was maintained at 7.25 by a simultaneous addition of solution F. This process was continued until the silver nitrate solution was exhausted, at which point the mixture was concentrated by ultrafiltration. The resulting silver salt dispersion contained fine particles of the silver salt of 1-phenyl-5-mercaptotetrazole.

Silver Halide Emulsions

The emulsions employed in these examples are all silver iodobromide tabular grains precipitated by conventional means as known in the art. Table 11-1 below lists the various emulsions, along with their iodide content (the remainder assumed to be bromide), their dimensions, and the sensitizing dyes used to impart spectral sensitivity. All of these emulsions have been given chemical sensitizations as known in the art to produce optimum sensitivity.

TABLE 11-1

| Emulsion | Spectral sensitivity | Iodide content (%) | Diameter (μm) | Thickness (μm) | Dyes |
|---|---|---|---|---|---|
| EY-1 | yellow | 1.3 | 0.54 | 0.084 | SY-1 |
| EY-2 | yellow | 4.1 | 1.25 | 0.137 | SY-1 |
| EY-3 | yellow | 2 | 1.23 | 0.125 | SY-1 |
| EY-4 | yellow | 2 | 0.45 | 0.061 | SY-1 |
| EY-5 | yellow | 2 | 0.653 | 0.093 | SY-1 |
| EM-1 | magenta | 1.3 | 0.55 | 0.084 | SM-1 + SM-3 |
| EM-2 | magenta | 4.1 | 1.22 | 0.111 | SM-1 + SM-2 |
| EM-3 | magenta | 2 | 1.23 | 0.125 | SM-1 + SM-2 |
| EM-4 | magenta | 2 | 0.45 | 0.061 | SM-1 + SM-2 |
| EM-5 | magenta | 2 | 0.653 | 0.093 | SM-1 + SM-2 |
| EC-1 | cyan | 1.3 | 0.55 | 0.084 | SC-1 |
| EC-2 | cyan | 4.1 | 1.2 | 0.11 | SC-1 |
| EC-3 | cyan | 2 | 1.23 | 0.125 | SC-1 + SC-2 |
| EC-4 | cyan | 2 | 0.45 | 0.061 | SC-1 + SC-2 |
| EC-5 | cyan | 2 | 0.653 | 0.093 | SC-1 + SC-2 |

Coupler Dispersion CDM-2

An oil based coupler dispersion was prepared by conventional means containing coupler M-2 and tricresyl phosphate at a weight ratio of 1:0.5.

Coupler Dispersion CDC-1

An oil based coupler dispersion was prepared by conventional means containing coupler C-1 and dibutyl phthalate at a weight ratio of 1:2.

Coupler Dispersion CDY-1

An oil based coupler dispersion was prepared by conventional means containing coupler Y-1 (381 AQF) and dibutyl phthalate at a weight ratio of 1:0.5.

M-2
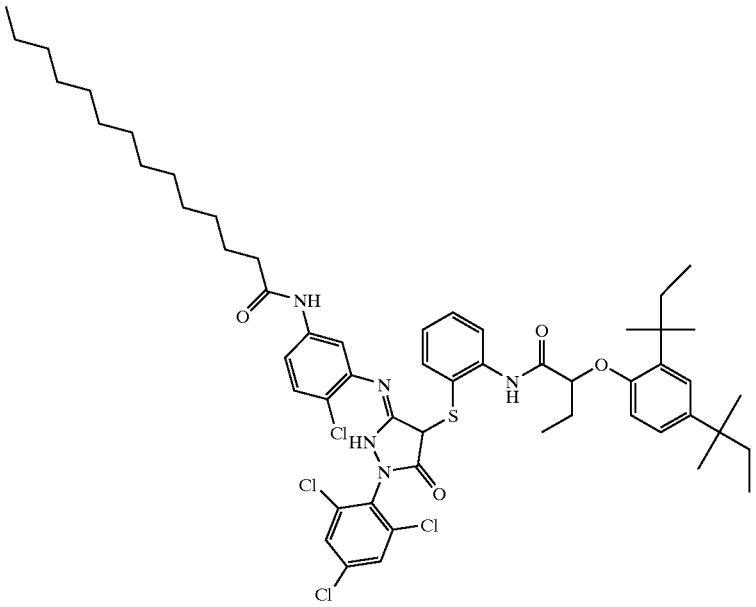
C-1
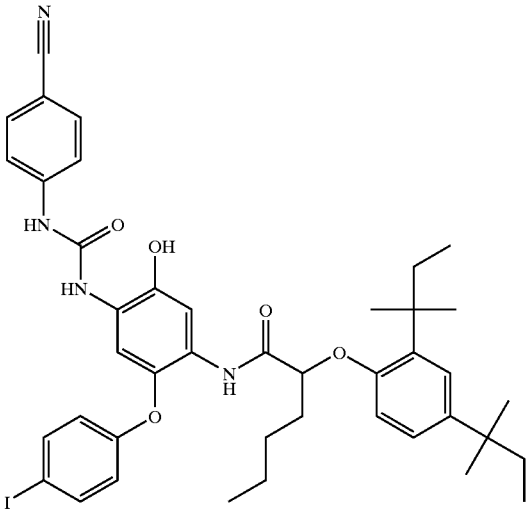

-continued
Y-1
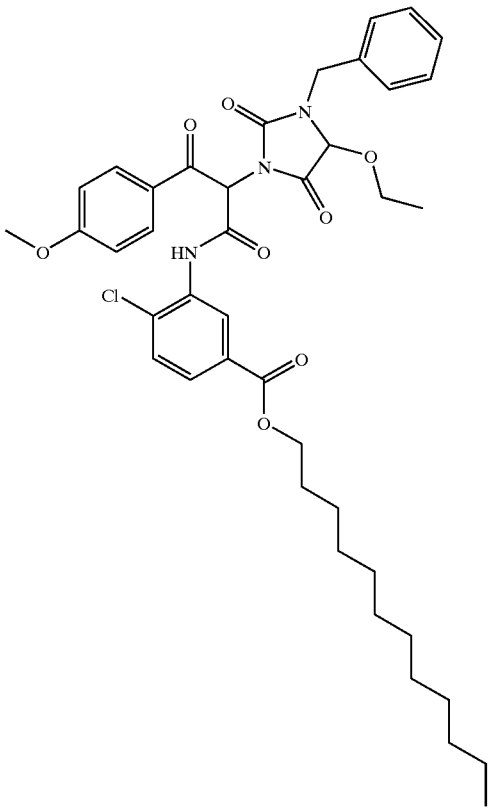
SY-1
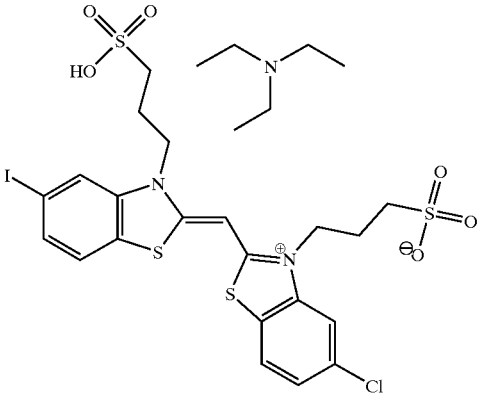
SY-2
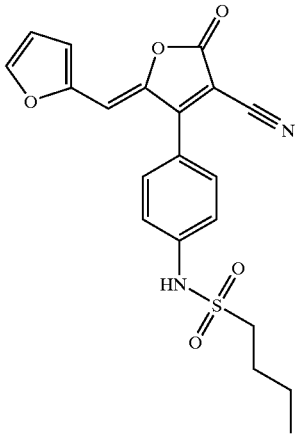

-continued
SM-1
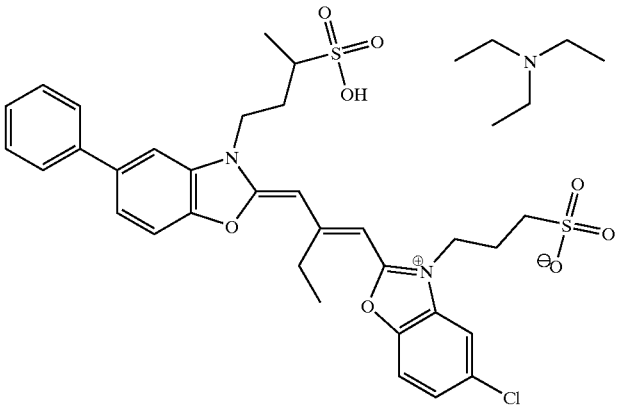
SM-2
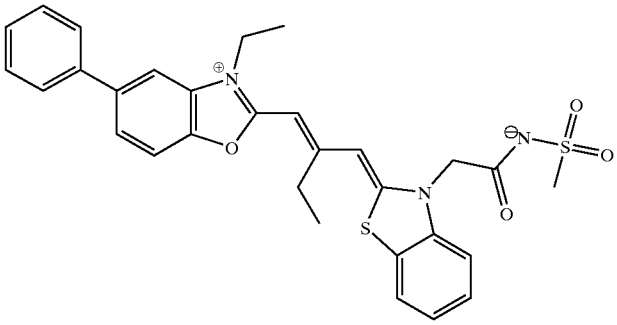
SM-3
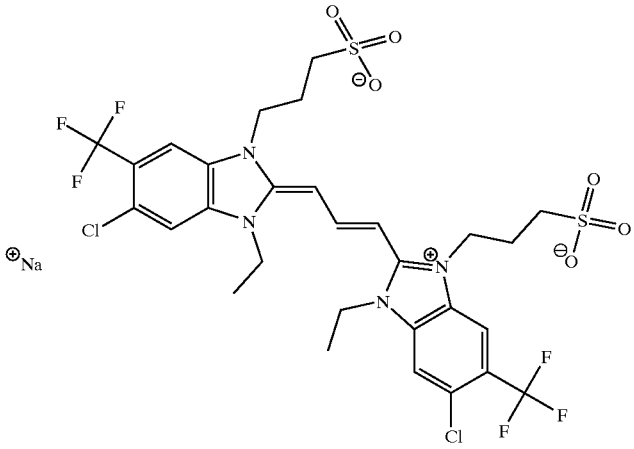
SC-1
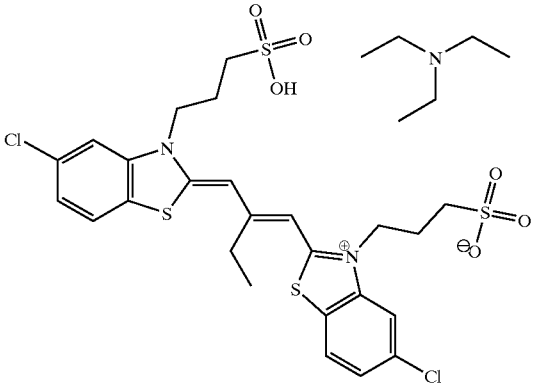

-continued

SC-2

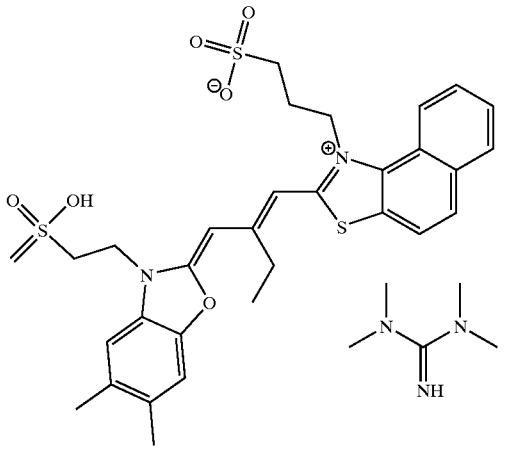

HAR-1

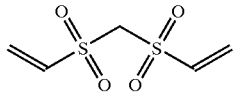

A multilayer imaging element IMF-1 as described in Table 11-2 was created to allow for use in full color photothermographic elements intended for capturing live scenes. The multilayer element of this example was capable of producing an image with no wet processing steps.

TABLE 11-2

| | |
|---|---|
| Overcoat | 1.1 g/m$^2$ Gelatin<br>0.32 g/m$^2$ HAR-1 |
| Fast Yellow | 0.54 g/m$^2$ AgBrI from emulsion EY-3<br>0.17 g/m$^2$ silver benzotriazole from SS-2<br>0.17 g/m$^2$ silver-1-phenyl-5-mercaptotetrazole from AF-4<br>0.29 g/m$^2$ coupler Y-1 from dispersion CDY-1<br>0.46 g/m$^2$ Developer DBV-2<br>0.46 g/m$^2$ Salicylanilide<br>2.3 g/m$^2$ Gelatin |
| Slow Yellow | 0.27 g/m$^2$ AgBrI from emulsion EY-4<br>0.16 g/m$^2$ AgBrI from emulsion EY-5<br>0.15 g/m$^2$ silver benzotriazole from SS-2<br>0.15 g/m$^2$ silver-1-phenyl-5-mercaptotetrazole from AF-4<br>0.25 g/m$^2$ coupler Y-1 from dispersion CDY-1<br>0.40 g/m$^2$ Developer DEV-2<br>0.40 g/m$^2$ Salicylanilide<br>2.0 g/m$^2$ Gelatin |
| Yellow Filter | 0.08 g/m$^2$ SY-2<br>1.07 g/m$^2$ Gelatin |
| Fast Magenta | 0.54 g/m$^2$ AgBrI from emulsion EM-3<br>0.17 g/m$^2$ silver benzotriazole from SS-2<br>0.17 g/m$^2$ silver-1-phenyl-5-mercaptotetrazole from AF-4<br>0.29 g/m$^2$ coupler M-2 from dispersion CDM-2<br>0.46 g/m$^2$ Developer DEV-2<br>0.46 g/m$^2$ Salicylanilide<br>2.3 g/m$^2$ Gelatin |
| Slow Magenta | 0.27 g/m$^2$ AgBrI from emulsion EM-4<br>0.16 g/m$^2$ AgBrI from emulsion EM-5<br>0.15 g/m$^2$ silver benzotriazole from SS-2<br>0.15 g/m$^2$ silver-1-phenyl-5-mercaptotetrazole from AF-4<br>0.25 g/m$^2$ coupler M-2 from dispersion CDM-2<br>0.40 g/m$^2$ Developer DEV-2<br>0.40 g/m$^2$ Salicylanilide<br>2.0 g/m$^2$ Gelatin |
| Interlayer | 1.07 g/m$^2$ Gelatin |
| Fast Cyan | 0.54 g/m$^2$ AgBrI from emulsion EC-3<br>0.17 g/m$^2$ silver benzotriazole from SS-2<br>0.17 g/m$^2$ silver-1-phenyl-5-mercaptotetrazole from AF-4<br>0.29 g/m$^2$ coupler C-1 from dispersion CDC-1<br>0.46 g/m$^2$ Developer DEV-2 |

TABLE 11-2-continued

| | |
|---|---|
| Overcoat | 1.1 g/m$^2$ Gelatin<br>0.32 g/m$^2$ HAR-1 |
| Slow Cyan | 0.46 g/m$^2$ Salicylanilide<br>2.3 g/m$^2$ Gelatin<br>0.27 g/m$^2$ AgBrI from emulsion EC-4<br>0.16 g/m$^2$ AgBrI from emulsion EC-5<br>0.15 g/m$^2$ silver benzotriazole from SS-2<br>0.15 g/m$^2$ silver-1-phenyl-5-mercaptotetrazole from AF-4<br>0.25 g/m$^2$ coupler C-1 from dispersion CDC-1<br>0.40 g/m$^2$ Developer DEV-2<br>0.40 g/m$^2$ Salicylanilide<br>2.0 g/m$^2$ Gelatin |
| Antihalation Layer | 0.05 g/m$^2$ Carbon<br>1.6 g/m$^2$ Gelatin |
| Support | Polyethylene terephthalate support (7 mil thickness) |

The resulting coating was exposed through a step wedge to a 1.8 log lux light source at 5500K and Wratten 2B filter. The exposure time was 0.1 seconds. After exposure, the coating was thermally processed by contact with a heated platen for 20 seconds at 145 C. Cyan, magenta, and yellow densities were read using status M color profiles, to yield the densities listed in Table 11-3 below. It is clear from these densities that the coating serves as a useful photographic element capturing multicolor information.

TABLE 11-3

| Record | Dmin | Dmax |
|---|---|---|
| Cyan | 0.38 | 1.47 |
| Magenta | 0.72 | 2.65 |
| Yellow | 0.68 | 1.80 |

The film element IMF-1 of Example 11 was further loaded into a single lens reflex camera equipped with a 50 mm/f 1.7 lens. The exposure control of the camera was set to ASA 100 and a live scene indoors without the use of a flash was captured on the above element. The element was developed by heating for 20 seconds at 145 C. and no subsequent processing was done to the element.

The resulting image was scanned with a Nikon LS2000 film scanner. The digital image file thus obtained was loaded into Adobe Photoshop (version 5.0.2) where corrections were made digitally to modify tone scale and color saturation, thus rendering an acceptable image. The image was viewed as softcopy by means of a computer monitor. The image file was then sent to a Kodak 8650 dye sublimation printer to render a hardcopy output of acceptable quality. This demonstrates the use of a photothermographic element in a complete imaging chain.

Comparative Example 12

A comparative film example CMF-1 was a product coating of KODAK GOLD 100 film. This is a film element suitable for processing according to Process C-41 as described in the *British Journal of Photography Annual* for 1988 at pages 196–198 but with a modified bleach solution having 1,3-propylenediamine tetraacecetic acid. The processed film element exhibited ISO sensitivity of ISO 100 and formed excellent density in all color records.

Film examples IMF-1 and comparison CMF-1 above were exposed through a step wedge to a 1.8 log lux light source at 5500K and Wratten 2B filter. The exposure time was 0.1 seconds. The processes below were performed on the film samples. After processing, the sensitometric response of red, green, and blue density were read using Status M color profiles.

Process 1 (Comparison)—Heat development on a heated platen for 10 seconds, 160° C.

Process 2 (Comparison)—Heat development as per Process 1 followed by exposure to light, then bleach and fix as per C-41 process Process 3 (Invention)—Heat development as per Process 1 followed by exposure to light, then full C-41 process (including development)

Process 4 (Comparison)—C-41 development followed by water wash

Process 5 (Comparison)—C-41 development followed by water wash, exposure to light, then bleach and fix as per C-41 process Process 6 (Comparison)—C-41 development followed by water wash, exposure to light, then full C-41 process (including development)

For the purposes of these experiments, the exposure to light steps intermediate in Processes 2, 3, 5, and 6 was accomplished by laying the film samples onto an illumination box for 30 minutes. In a practical system, this exposure could well be the exposure received from a scanner illumination source during a scanning operation. The sensitometry was read at the end of all processes as well as after heat development in Processes 2 and 3 and after the water wash in Processes 5 and 6. These intermediate sensitometric reads in processes 2, 3, 5, and 6 will be designated as Process 2A, 3A, 5A, and 6A respectively, while the final process sensitometric reads will be designated as 2B, 3B, 5B, and 6B respectively.

The process of the invention is to heat process photothermographic film and then be able to stabilize the image and improve the signal to noise by remediating the film with a complete C-41 process. This following examples demonstrate this by focusing in on the green layer density that is produced by the above six processes. It is understood that the same principles apply equally well to the red and blue layers of the multicolor film elements.

Table 13-1 contains information on the minimum and maximum density of the image after heat processing. In this table, discrimination is defined as $D_{max}-D_{min}/D_{min}$. It is clear from the results that only the photothermographic film element IMF-1 can be developed in this manner.

TABLE 13-1

| Film | Process | Green $D_{min}$ | Green $D_{max}$ | Green $_{discrim.}$ |
|---|---|---|---|---|
| IMF-1 | 1 (Comp.) | 1.31 | 3.56 | 1.72 |
| IMF-1 | 2A (Comp.) | 1.29 | 3.56 | 1.76 |
| IMF-1 | 3A (Comp.) | 1.28 | 3.58 | 1.80 |
| CMF-1 (Comp.) | 1 (Comp.) | 1.98 | 1.98 | 0.00 |
| CMF-1 (Comp.) | 2A (Comp.) | 1.98 | 1.98 | 0.00 |
| CMF-1 (Comp.) | 3A (Comp.) | 1.98 | 1.98 | 0.00 |

Comparative Example 14

This comparative experiment shows the result of a photothermographic film being alternatively processed. Table 14-1 contains information on the minimum and maximum density of the image after C-41 development. The definition of image discrimination is the same as in the above examples. The densitometer had difficulty measuring density above about 5.0, so there is high noise in some of the density measurements. It is clear from the results that the photothermographic film element IMF-1 can be efficaciously developed through the wet C-41 process. Combined with the results of Example 13, film IMF-1 is capable of being developed by both dry and wet processes whereas film comparison CMF-1 is only capable of being developed by a wet process.

TABLE 14-1

| Film | Process | Green $D_{min}$ | Green $D_{max}$ | Green$_{discrim.}$ |
|---|---|---|---|---|
| IMF-1 | 4 (Comp.) | 1.69 | 2.33 | 0.38 |
| IMF-1 | 5A (Comp.) | 1.69 | 2.36 | 0.40 |
| IMF-1 | 6A (Comp.) | 1.73 | 2.36 | 0.36 |
| CMF-1 (Comp.) | 4 (Comp.) | 2.10 | 6.55 | 2.12 |
| CMF-1 (Comp.) | 5A (Comp.) | 2.22 | 6.11 | 1.75 |
| CMF-1 (Comp.) | 6A (Comp.) | 2.15 | 6.37 | 1.96 |

Comparative Example 15

For comparison, this example shows that the C-41 process is incapable of delivering good images when two sequential development steps are separated by an exposure to light. Table 15-1 below contains data of the final samples through processes 5 and 6. The data for Process 5 confirm that image discrimination is lost as the result of the second development step and is not due to the bleach and fix steps of the C-41 process. The very low image discriminations for samples of process 6B show the failure of the full C-41 process to remediate images already developed through the C-41 developer. This will be important when these results are compared to the results of the next example.

TABLE 15-1

| Film | Process | Green $D_{min}$ | Green $D_{max}$ | $Green_{discrim.}$ |
|---|---|---|---|---|
| IMF-1 | 5B (Comp.) | 0.70 | 0.96 | 0.37 |
| IMF-1 | 6B (Comp.) | 1.11 | 1.19 | 0.07 |
| CMF-1 (Comp.) | 5B (Comp.) | 0.83 | 2.96 | 2.57 |
| CMF-1 (Comp.) | 6B (Comp.) | 3.03 | 3.36 | 0.11 |

EXAMPLE 16

This example shows that the photothermographic film can be remediated through both the C-41 bleach and fix steps as well as through the entire C-41 process (including a second development), as shown in Table 16-1 below. This is an entirely unexpected result based on the results of Example 15. We did not carry film sample CMF-1 (comparison) to completion in this example because the heat development process did not produce useful images.

TABLE 16-1

| Film | Process | Green $D_{min}$ | Green $D_{max}$ | $Green_{discrim.}$ |
|---|---|---|---|---|
| IMF-1 | 2B (Comp.) | 0.45 | 2.50 | 4.56 |
| IMF-1 | 3B (Invention) | 1.12 | 2.65 | 1.37 |

EXAMPLE 17

This example compares the discriminations among the various processes for film samples IMF-1 and comparison CMF-1. The results are summarized in Table 17-1 below. The discrimination ratio in the last column is the discrimination for the given process divided by the discrimination for the base process of each film. For film IMF-1, the base process is the heat development of Process 1. For film CMF-1, the base process is the C-41 development of Process 4. The failure of a process is noted when the ratio is less than 10 percent of the base process. This clearly occurred with Processes 1, 2, and 3 for film CMF-1, and Process 6 for both films.

EXAMPLE 18

The remediation processes for photothermographic film are useful to stabilize the film against continued development, printout, and staining. In addition, the remediation processes lower the ultimate film density (designated as $D_{max}$) such that more efficient scanning can occur. This is indicated in Table 18-1 below.

The invention has been described in detail with particular reference to preferred embodiments, but it will be understood that variations and modifications can be effected within the spirit and scope of the invention.

What is claimed is:

1. A method of processing color photographic film that has been imagewise exposed in a camera, said film having at least three light-sensitive unit which have their individual sensitivities in different wavelength regions, each of the units comprising at least one light-sensitive silver-halide emulsion, binder, and dye-providing coupler, which method in order comprises:

(a) thermally developing the film step without any externally applied developing agent, comprising heating said film to a temperature greater than 80° C. in an essentially dry process, such that an internally located blocked developing agent in reactive association with each of said three light-sensitive units becomes unblocked to form a developing agent, whereby the unblocked developing agent forms dyes by reacting with the dye-providing couplers to form a color negative image;

(b) wet-chemical processing the developed film of step(a) by contacting it with a non-blocked developing agent, under agitation at a temperature of 30 to 50° C. under aqueous alkaline conditions, without forming a color negative image in the film by reaction of the non-blocked developing agent with the dye-providing couplers inside the silver-halide emulsions, (c) desilvering said film in one or more desilvering solutions to remove unwanted silver and/or silver halide, thereby forming a color negative image; and (d) thereafter forming a positive-image color print from the desilvered film.

2. The method of claim 1 wherein the film comprises at least one blocked inhibitor that is released upon thermal development which inhibitor has substantially no effect in dry thermal development of step (a), and wherein when the thermal development and concomitant release of the inhibitor precedes the wet-chemical processing of step (b), the effect in the wet-chemical processing is such that no development occurs.

3. The method of claim 1 wherein the film is backwards compatible with respect to thermal development and wet-chemical processing and comprises at least one blocked inhibitor that is released upon thermal development which inhibitor has substantially no effect in dry thermal development of step (a), and wherein the wet-chemical processing of step (b) does not have the capability to release the inhibitor, but wherein when thermal development and concomitant release of the inhibitor precedes the wet-chemical process, the effect in the wet-chemical process is such that no development occurs.

4. The method of claim 1 wherein step (b) and step (c) is in accordance with a C-41 photoprocessing standard.

5. The method of claim 3, wherein the blocked inhibitor is selected from the following compounds:

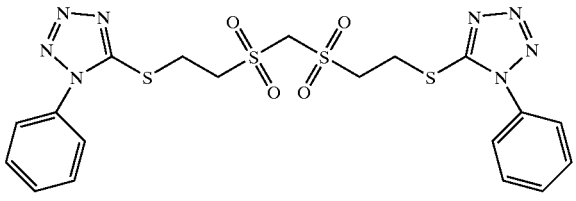

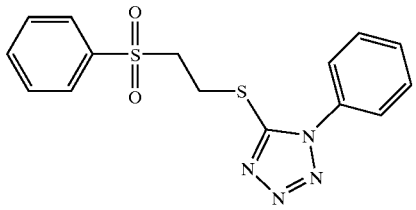

-continued

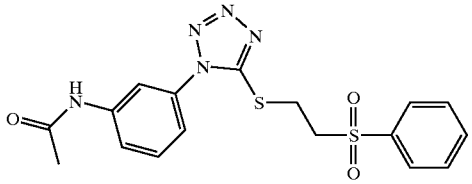

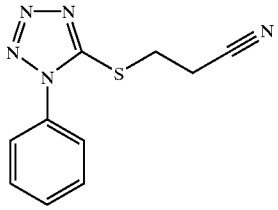

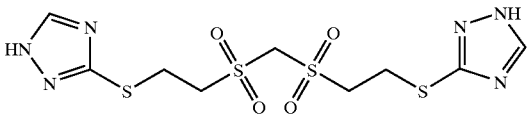

6. The method of claim 1, wherein the color print in step (d) is generated by thermal-diffusion or ink-jet printing.

7. The method of claim 1, wherein the color print in step (d) is generated by optically printing on photographic paper.

8. The method of claim 1, wherein the blocked developing agent comprises a group having the following structure:

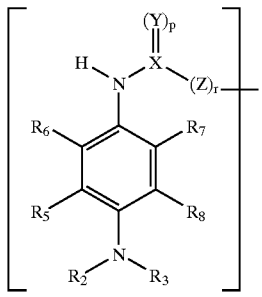

wherein $R_2$ and $R_3$ are independently hydrogen or a substituted or unsubstituted alkyl group or $R_2$ and $R_3$ are connected to form a ring;

$R_5$, $R_6$, $R_7$, and $R_8$ are independently hydrogen, halogen, hydroxy, amino, alkoxy, carbonamido, sulfonamido, alkylsulfonamido or alkyl, or $R_5$ can connect with $R_2$ or $R_6$ and/or $R_8$ can connect to $R_3$ or $R_7$ to form a ring;

X represents carbon or sulfur;

Y represents oxygen, sulfur or N—$R_1$, where $R_1$ is substituted or unsubstituted alkyl or substituted or unsubstituted aryl;

p is 1 or 2;

Z represents carbon, oxygen or sulfur;

r is 0 or 1;

with the proviso that when X is carbon, both p and r are 1, when X is sulfur, Y is oxygen, p is 2 and r is 0.

9. The method of claim 1, wherein the non-blocked developing agent is a compound, or a photographically compatible salt form thereof, selected from the group consisting of:

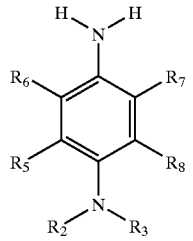

wherein $R_2$ and $R_3$ are independently hydrogen or a substituted or unsubstituted alkyl group or $R_2$ and $R_3$ are connected to form a ring;

$R_5$, $R_6$, $R_7$, and $R_8$ are independently hydrogen, halogen, hydroxy, amino, alkoxy, carbonamido, sulfonamido, alkylsulfonamido or alkyl, or $R_5$ can connect with $R_2$ or $R_6$ and/or $R_8$ can connect to $R_3$ or $R_7$ to form a ring.

10. The method of claim 1, wherein the blocked developing agent, after being unblocked, is the same compound as the non-blocked developing agent.

11. The method of claim 1 further comprising forming an electronic representation of an image comprising the step of scanning the imagewise exposed and developed and processed film after step (a).

12. The method of claim 11 comprising following step (a) the steps of:

scanning said developed image to form an analog electronic representation of said developed image;

digitizing said analog electronic representation to form a digital image;

digitally modifying said digital image; and storing, transmitting, printing, or displaying said modified digital image.

13. The method of claim 1 wherein the blocked developer has a half-life ($t_{1/2}$)≦20 min, and a peak discrimination, at a temperature of at least 60° C., of at least 2.0, which blocked developer is represented by the following structure:

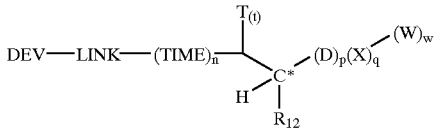

wherein:

DEV is a developing agent;

LINK is a linking group;

TIME is a timing group;

n is 0, 1, or 2;

t is 0, 1, or 2, and when t is not 2, the necessary number of hydrogens (2−t) are present in the structure;

C* is tetrahedral ($sp^3$ hybridized) carbon;

p is 0 or 1;

q is 0 or 1;

w is 0 or 1;

p+q=1 and when p is 1, q and w are both 0; when q is 1, then w is 1;

$R_{12}$ is hydrogen, or a substituted or unsubstituted alkyl, cycloalkyl, aryl or heterocyclic group or $R_{12}$ can combine with W to form a ring;

T is independently selected from a substituted or unsubstituted, referring to the following T groups, alkyl group, cycloalkyl group, aryl, or heterocyclic group, an inorganic monovalent electron withdrawing group, or an inorganic divalent electron withdrawing group capped with at least one C1 to C10 organic group, either an $R_{13}$ or an $R_{13}$ and $R_{14}$ group; or T is joined with W or $R_{12}$ to form a ring; or two T groups can combine to form a ring;

D is a first activating group selected from substituted or unsubstituted, referring to the following D groups, heteroaromatic group or aryl group or monovalent electron withdrawing group, wherein the heteroaromatic can optionally form a ring with T or $R_{12}$;

X is a second activating group and is a divalent electron withdrawing group;

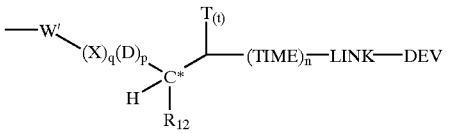

W' is independently selected from a substituted or unsubstituted, referring to the following W' groups, alkyl, cycloalkyl, aryl or heterocyclic group; and wherein W' in combination with T or $R_{12}$ can form a ring;

$R_{13}$, $R_{14}$, $R_{15}$, and $R_{16}$ can independently be selected from substituted or unsubstituted alkyl, aryl, or heterocyclic group; and any two members of the following set: $R_{12}$, T , and either D or W, that are not directly linked may be joined to form a ring provided that creation of the ring will not interfere with the functioning of the blocking group.

14. The method of claim 13 wherein discrimination Dp is 1 to 10 and Dp is at a temperature of 100 to 160° C.

15. A method of claim 13, where LINK is represented by the following structure:

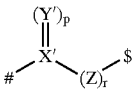

wherein

X' represents carbon or sulfur;

Y' represents oxygen, sulfur or N—$R_1$, where $R_1$ is substituted or unsubstituted alkyl or substituted or unsubstituted aryl;

p is 1 or 2;

Z represents carbon, oxygen or sulfur, r is 0 or 1;

with the proviso that when X' is carbon, both p and r are 1, when X' is sulfur, Y' is oxygen, p is 2 and r is 0;

# denotes the bond to DEV;

$ denotes the bond to TIME or $T_{(t)}$ substituted carbon.

16. The method of claim 15, where LINK has the following structure:

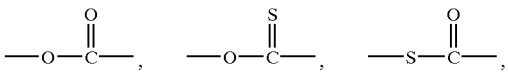

-continued

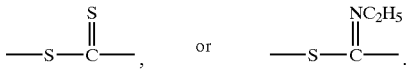

17. The method of claim 16 wherein LINK is

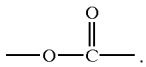

18. The method according to claim 1, wherein the blocked developing agent is represented by the following structure:

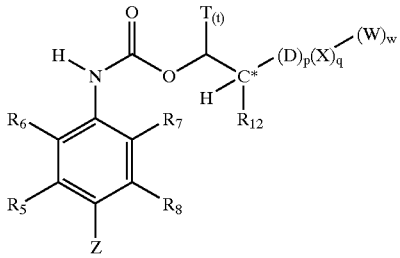

wherein:

Z is OH or $NR_2R_3$, where $R_2$ and $R_3$ are independently hydrogen or a substituted or unsubstituted alkyl group or $R_2$ and $R_3$ are connected to form a ring;

$R_5$, $R_6$, $R_7$, and $R_8$ are independently hydrogen, halogen, hydroxy, amino, alkoxy, carbonamido, sulfonamido, alkylsulfonamido or alkyl, or $R_5$ can connect with $R_3$ or $R_6$ and/or $R_8$ can connect to $R_2$ or $R_7$ to form a ring;

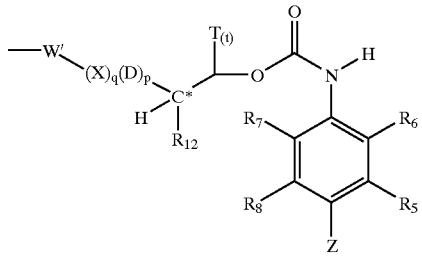

wherein T, t, C*, $R_{12}$, D, p, X, q, W' and w are as defined above.

19. The method according to claim 18, wherein X is a sulfonyl group and Z is $NR_2R_3$.

20. The method of claim 1 wherein the film comprises an internally blocked developing agent, at least one silver salt or complex of an organic compound as an oxidizing agent, and a silver salt of a mercapto functional organic compound having C1 to C12 carbon atoms, wherein the mercapto functional organic compound is present in the range of 5 to 3,000 g/mol of imaging silver, to effectively inhibit fog during thermal processing of the chromogenic photothermographic film.

* * * * *